US012514331B2

(12) United States Patent
Elder et al.

(10) Patent No.: US 12,514,331 B2
(45) Date of Patent: Jan. 6, 2026

(54) SOLE STRUCTURE FOR AN ARTICLE OF FOOTWEAR

(71) Applicant: NIKE, Inc., Beaverton, OR (US)

(72) Inventors: Zachary M. Elder, Portland, OR (US); Dervin A. James, Hillsboro, OR (US); Lee D. Peyton, Tigard, OR (US); Hector R. Quinonez, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/765,849

(22) Filed: Jul. 8, 2024

(65) Prior Publication Data

US 2025/0017320 A1 Jan. 16, 2025

Related U.S. Application Data

(60) Provisional application No. 63/513,619, filed on Jul. 14, 2023.

(51) Int. Cl.

| | |
|---|---|
| ***A43B 13/20*** | (2006.01) |
| ***A43B 13/18*** | (2006.01) |
| ***A43B 21/28*** | (2006.01) |

(52) U.S. Cl.

CPC ..... *A43B 13/20* (2013.01); *A43B 13/181* (2013.01); *A43B 13/185* (2013.01); *A43B 13/186* (2013.01); *A43B 21/28* (2013.01)

(58) Field of Classification Search

CPC ..... A43B 21/28; A43B 21/32; A43B 13/20; A43B 13/181; A43B 13/185

USPC ..... 36/29

See application file for complete search history.

(56) References Cited

U.S. PATENT DOCUMENTS

| | | | | |
|---|---|---|---|---|
| 4,183,156 | A | 1/1980 | Rudy | |
| 4,219,945 | A | 9/1980 | Rudy | |
| 4,535,553 | A * | 8/1985 | Derderian | A43B 13/181 36/28 |
| 4,936,029 | A | 6/1990 | Rudy | |
| 5,042,176 | A | 8/1991 | Rudy | |
| 5,220,737 | A | 6/1993 | Edington | |

(Continued)

FOREIGN PATENT DOCUMENTS

CN 103181652 A 7/2013

OTHER PUBLICATIONS

Grailed, Maison Margiela, Margiela Bubble Sole GAT Sneakers "RARE", https://www.grailed.com/listings/55399545-maison-margiela-margiela-bubble-sole-gat-sneakers-rare.

(Continued)

*Primary Examiner* — Marie D Bays

(74) *Attorney, Agent, or Firm* — Quinn IP Law

(57) ABSTRACT

A sole structure for an article of footwear includes a cushioning component that has an outer surface and at least partially defines a chamber that is at least partially surrounded by the outer surface. At least a portion of the outer surface has a protruding shape in the absence of a compressive load of at least a predetermined magnitude on the cushioning component. The sole structure includes a sole component that includes a projection that either extends through the outer surface of the cushioning component and within the chamber, or interfaces with a recess in the outer surface of the cushioning component, or protrudes from an inner surface of the cushioning component into the chamber.

20 Claims, 27 Drawing Sheets

(56) References Cited

U.S. PATENT DOCUMENTS

| | | | | |
|---|---|---|---|---|
| 5,363,570 | A | 11/1994 | Allen et al. | |
| 5,718,063 | A * | 2/1998 | Yamashita | A43B 1/0072 36/35 B |
| 6,013,340 | A | 1/2000 | Bonk et al. | |
| 6,082,025 | A | 7/2000 | Bonk et al. | |
| 6,127,026 | A | 10/2000 | Bonk et al. | |
| 6,203,868 | B1 | 3/2001 | Bonk et al. | |
| 6,321,465 | B1 | 11/2001 | Bonk et al. | |
| 6,385,864 | B1 * | 5/2002 | Sell, Jr. | A43B 13/20 36/35 B |
| 6,568,102 | B1 * | 5/2003 | Healy | A43B 13/20 36/35 R |
| 6,971,193 | B1 | 12/2005 | Potter et al. | |
| 9,958,107 | B1 | 5/2018 | Hobbs et al. | |
| 10,686,481 | B2 | 6/2020 | Barnett et al. | |
| 11,044,964 | B2 | 6/2021 | Meeker | |
| 2004/0154189 | A1 | 8/2004 | Wang | |
| 2009/0151196 | A1 | 6/2009 | Schindler et al. | |
| 2016/0295967 | A1 | 10/2016 | Campos, II et al. | |
| 2018/0338577 | A1 * | 11/2018 | Elder | A43B 3/0057 |
| 2019/0261737 | A1 | 8/2019 | Walsh et al. | |
| 2020/0359737 | A1 * | 11/2020 | Sung | A43B 13/181 |
| 2021/0145121 | A1 * | 5/2021 | Page | A43B 13/122 |
| 2022/0248804 | A1 * | 8/2022 | Chang | A43B 13/026 |
| 2023/0354959 | A1 * | 11/2023 | Andrews | A43B 7/32 |

OTHER PUBLICATIONS

Shoes available on Temu, Apr. 22, 2024.

Macys, Women's Skech-Air-Inspire Memory Foam Training Sneakers from Finish Line, accessed Jun. 25, 2024, https://www.macys.com/shop/product/skechers-womens-skech-air-inspire-memory-foam-training-sneakers-from-finish-line?ID=1532357.

Hydraulics, Bubble sole, literally, Maison Margiela Sneaker, Mar. 2, 2020, Sandton, South Africa, https://www.facebook.com/hydraulicsstores/posts/bubble-sole-literally-the-new-maison-margiela-sneakers-undeniably-creativeonly-a/3099676210056658/.

* cited by examiner

SOLE STRUCTURE FOR AN ARTICLE OF FOOTWEAR

CROSS-REFERENCE TO RELATED APPLICATION

This application claims the benefit of priority to U.S. Provisional Application No. 63/513,619, filed Jul. 14, 2023, which is hereby incorporated by reference in its entirety.

TECHNICAL FIELD

The present disclosure generally relates to a sole structure of an article of footwear.

BACKGROUND

An article of footwear typically includes a sole structure configured to be located under a wearer's foot to space the foot away from the ground. Sole structures may be configured to provide cushioning, motion control, and/or resilience.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
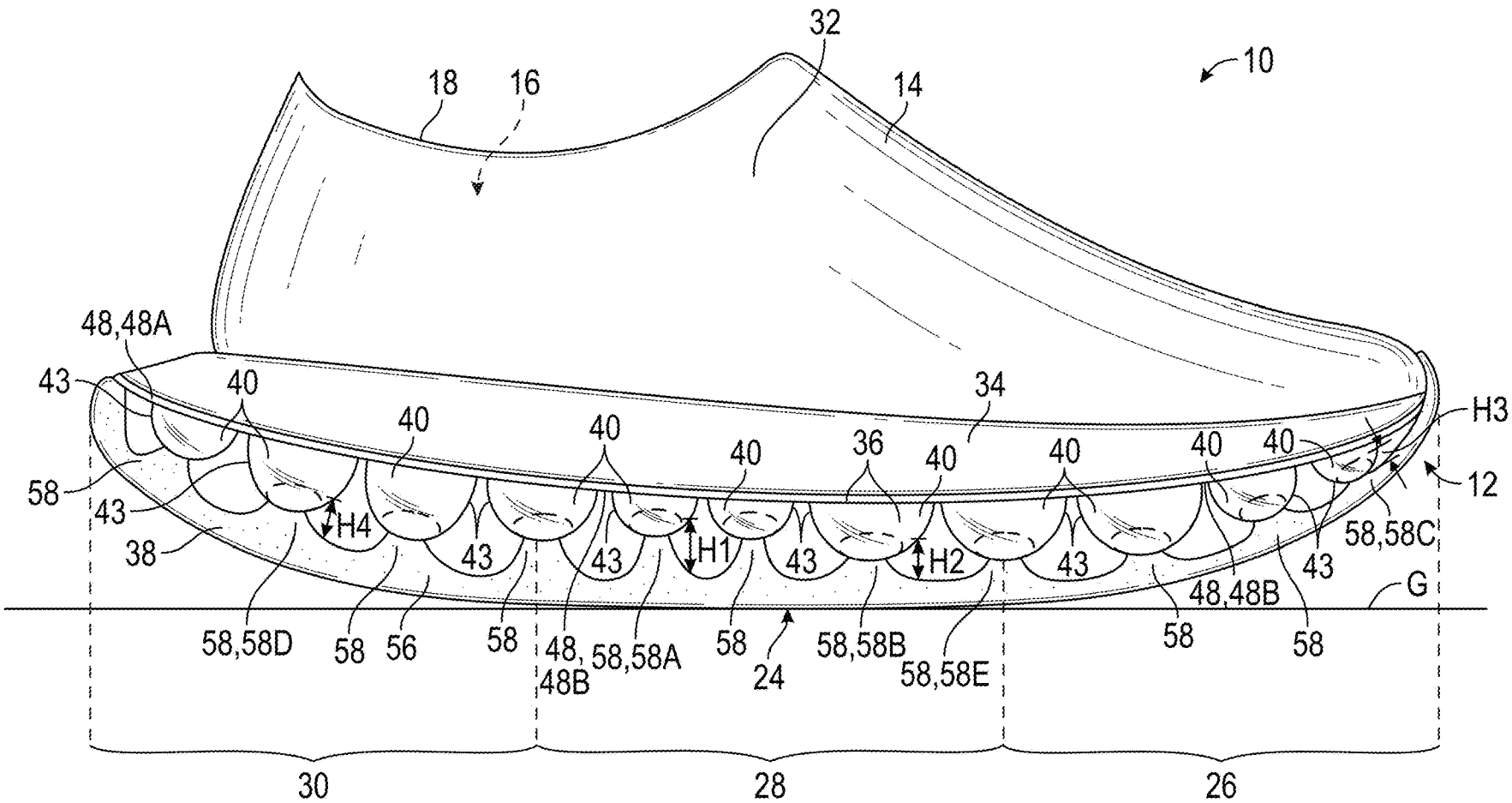
FIG. 1 is a medial side view of an article of footwear including a sole structure.

Disclosed herein is a sole structure for an article of footwear that provides targeted and tuned cushioning via a cushioning component that has an outer surface with a protruding shape and defines a chamber, and a sole component that may include a projection that interfaces with the chamber. The protruding shape of the chamber resiliently compresses under loading, such as at least partly due to the projection, and may repeatedly invert and revert upon compressive loading and unloading of the sole structure.

Compressive stiffness is dependent upon and may be tuned (e.g., controlled) according to the relative geometries of the chamber and the projection, among other factors. In some examples, the sole structure may absorb a dynamic compressive load due to impact with the ground in stages of progressive cushioning (referred to as staged or graded cushioning) according to the relative stiffness values of the components of the sole structure described herein. Underfoot loads are "dosed" or "staged" to the wearer, with each stage having a different effective stiffness and an unloading behavior (i.e., behavior when the dynamic compressive force is removed) that may provide significant energy return. Alternatively, the sole structure may be configured so that the various components compress at least partially in parallel (e.g., simultaneously) as an integrated system.

More specifically, an example sole structure for an article of footwear includes a cushioning component that has an outer surface and at least partially defines a chamber that is at least partially surrounded by the outer surface. At least a portion of the outer surface has a protruding shape in the absence of a compressive load of at least a predetermined magnitude on the cushioning component. The sole structure also includes a sole component that includes a projection. In an example, the projection may extend through an aperture in the outer surface of the cushioning component and within the chamber or, in another example, may interface with a recess in the outer surface of the cushioning component or, in still another example, may protrude from an inner surface of the cushioning component into the chamber.

The outer surface of the cushioning component may compress on and/or around the projection upon application of the compressive load of at least the predetermined magnitude on the cushioning component, causing the protruding shape to at least partially compress. As discussed herein, the geometry of the cushioning component and the sole component, including the geometry of the protruding shape and the projection, affects the threshold compressive load needed to cause compression of the protruding shape, such as the at least partial inversion of the protruding shape, as well as the rate of compression and decompression of the cushioning component to achieve a desired stiffness profile.

For example, the projection may at least partially invert the protruding shape of the outer surface of the cushioning component under the compressive load and the outer surface may revert back to the protruding shape upon removal of the compressive load.

In some examples, the protruding shape is a protruding dome shape that includes a base portion subjected to hoop tensile forces under compressive loading and a crown portion extending outward from the base portion and subjected to hoop compressive forces under the compressive loading. The crown portion inverts relative to the base portion under the compressive load and resiliently returns to extending outward from the base portion upon removal of the compressive load.

The chamber may be a fluid-filled chamber that contains gas, such as air, and may be sealed or unsealed. If sealed, the fluid-filled chamber may be at ambient pressure or inflated to above ambient pressure when in an unloaded state. The pressure of the fluid-filled chamber also affects the rate of compression and decompression and the resulting stiffness profile.

In an example, the sole component may include a base and the projection may extend from the base. In addition to compressing on or around the projection, upon sufficient loading, the outer surface of the cushioning component may compress against the base during a stage in which compression of the chamber may eventually "bottom out" against the base. At least a portion of the projection may gradually taper in width from the base toward the protruding shape. As compressive loading progresses, the outer surface of the protruding shape may interface with the widening projection as it nears the base. For example, the projection may be round in a cross-section perpendicular to a length of the projection, and the area of the round cross-section may increase in a direction toward the base.

In an example in which the projection extends through an aperture in the outer surface of the protruding shape, the projection may extend into the chamber at the aperture.

In some implementations, the cushioning component includes a lip surrounding the aperture at the chamber. For example, the lip may extend inward into the chamber. The lip may reinforce the aperture to mitigate stress at the aperture during compression. Additionally, the lip may act as a guide for the projection as the projection moves relative to the protruding shape through the aperture.

A portion of the projection extending within the chamber may be wider than the aperture. The projection may be bonded to the cushioning component within the chamber and seal the aperture. For example, the projection may be a foam that thermally bonds to the cushioning component. For example, the foam may expand within the chamber when heated and thermally bond to an inner surface of the cushioning component in the chamber.

In an example in which the projection interfaces with a recess in the outer surface of the cushioning component rather than extending through an aperture in the outer surface, the recess may be concave and a portion of the projection interfacing with the recess may be convex. In other words, the projection may nest against the protruding dome surface in the recess.

As used herein, "stiffness" is the ratio of change of load to displacement in compression of a cushioning layer (e.g., the ratio of change in compressive load (such as force in Newtons) to displacement of the cushioning layer (such as displacement in millimeters along the axis of the compressive load)).

The cushioning component may have a constant stiffness (i.e., a linear rate of change of load to displacement) during an initial stage of compression, a slight drop in stiffness when the protruding shape inverts around the projection or otherwise compresses, and then a non-linear stiffness, such as an exponentially increasing rate of change of load to displacement in compression as the outer surface of the cushioning component "bottoms out" against the base of the sole component.

The cushioning component may be formed to have another protruding shape opposite from the protruding shape that interfaces with the projection. For example, the protruding shape may be a first protruding shape, and the outer surface of the cushioning component may have a second protruding shape extending outward in a direction opposite from the first protruding shape. This may occur, for example, when the cushioning component includes two sheets, such as two polymeric sheets, that are secured to one another to define the chamber therebetween. A first sheet may define the first protruding shape and a second sheet fixed to the first sheet may define the second protruding shape. The second protruding shape may protrude less than the first protruding shape and may interface, for example, with another sole layer of the sole structure.

In other examples, rather than including a first sheet and a second sheet, the cushioning component may be a single sheet, such as a single polymeric sheet molded or otherwise formed with the protruding shape, or with multiple protruding shapes in examples including multiple cushioning components. For example, the sole structure may include multiple cushioning components each of which is an integral portion of a single sheet.

In examples with a cushioning component that is a single sheet or with multiple cushioning components that are integral portions of a single sheet, an outer perimeter of the single sheet may be nonplanar. For example, the outer perimeter may have a curvature that enables the single sheet to be disposed underfoot in the sole structure, while also wrapping upward along the sides, rear, and/or front of the sole structure, such as onto other components of the sole structure or onto a footwear upper. With such a nonplanar single sheet, each of the multiple cushioning components may at least partially define a respective chamber and the sheet may be configured so that at least some of the respective chambers blend into a common chamber, such as in a tri-lobe or other configuration, for example.

In examples in which a cushioning component or multiple cushioning components are integral portions of a single sheet, a thickness of the single sheet may be greater along a first portion of one of the cushioning components than along a second portion of the cushioning component. The first portion may be nearer to an outer perimeter of the sole structure than to a center of the sole structure. For example, the thicker first portion may be nearer to the medial side or the lateral side than the second portion, with the thinner second portion further inward toward a longitudinal axis of the sole structure. Similarly, the thicker first portion may be nearer the outer perimeter at the front of the sole structure or nearer the outer perimeter at the rear of the sole structure, with the thinner second portion further inward toward a center of the sole structure. Strategically providing thicker portions of the single sheet nearer to the outer perimeter may provide greater stability during compressive loading.

In examples in which the sole structure includes the projection and the protruding shape discussed herein, the projection may extend toward the protruding shape. For example, in an implementation, the protruding shape extends generally downward and the projection extends generally upward when the sole structure is incorporated in an article of footwear and worn on a foot with the sole structure positioned between the foot and a ground plane. Compressive loading of the sole structure thus compresses the outer surface of the protruding shape of the cushioning component downward onto, over, or against the projection. In another embodiment, the protruding shape may be configured to extend generally upward and the projection extend generally downward when the sole structure is incorporated in an article of footwear and worn on a foot with the sole structure positioned between the foot and a ground plane. In either orientation, because the projection extends toward the protruding shape, compression of the sole structure causes the outer surface of the protruding shape to compress, and in some examples at least partially invert. In some examples, the protruding shape interfaces with progressively more of the projection and, eventually, the base from which the projection extends.

Some sole structures within the scope of the disclosure may include multiple cushioning components as described. For example, the cushioning component discussed above may be one of a plurality of cushioning components included in the sole structure, each having an outer surface at least a portion of which has a protruding shape in the absence of a compressive load of at least a respective predetermined magnitude on the cushioning component.

The magnitude of the threshold compressive load that causes the protruding shape to deform and, in some cases, at least partially invert (e.g., the "predetermined magnitude") may vary amongst the plurality of cushioning components included in the sole structure. In other words, the cushioning components may be specifically configured (e.g., tuned) to provide a different desired stiffness at different locations of the sole structure.

Each of the cushioning components may define at least a portion of the chamber or a separate chamber in fluid communication with the chamber or fluidly-isolated from the chamber.

In implementations including a plurality of cushioning components, the sole component may include a plurality of projections, each paired with a respective one of the cushioning components and either extending through the outer surface of the respective one of the cushioning components or interfacing with a recess in the outer surface of the respective one of the cushioning components. The respective one of the cushioning components thus compresses against and/or around the projection upon application of the compressive load of at least the respective predetermined magnitude on the respective one of the cushioning components, and, in some cases, at least partially inverts the protruding shape of the respective one of the cushioning components.

In such implementations, the geometries of the various cushioning components and the base and projections of the sole component may be selected to provide a tuned stiffness profile. For example, the projections may vary in height in at least one of a forefoot region, a midfoot region, or a heel region of the sole structure. Additionally or alternatively, a height of at least one of the projections in the forefoot region, the midfoot region, or the heel region may be different than a height of at least one of the projections in a different one of the forefoot region, the midfoot region, or the heel region. Generally, each of the projections may be round at a cross-section perpendicular to a length of the projection, although the projections are not limited to a round cross-sectional shape within the scope of the disclosure.

Each projection may have a projection width at the outer surface of the respective one of the cushioning components toward which the projection extends. Each protruding shape of the outer surface of the respective one of the cushioning components toward which the projection extends may have a protruding shape width. A ratio of the projection width to the protruding shape width may vary in at least one of the forefoot region, the midfoot region, or the heel region of the sole structure and/or may vary between one of the forefoot region, the midfoot region, or the heel region and at least one different one of the forefoot region, the midfoot region, or the heel region.

Each projection may have an area of interface with the outer surface of the respective one of the cushioning components toward which the projection extends, and each protruding shape of the outer surface of the respective one of the cushioning components toward which the projection extends may have a protruding surface area. A ratio of the area of interface to the protruding surface area may vary in at least one of the forefoot region, the midfoot region, or the heel region of the sole structure and/or may vary between one of the forefoot region, the midfoot region, or the heel region and at least one different one of the forefoot region, the midfoot region, or the heel region.

In an example, the sole structure may include a bladder disposed within the chamber of the cushioning component. The bladder may have a tensile component secured to opposing inner surfaces of the bladder. Such a bladder may be referred to as an "internal" bladder as it is disposed within the chamber.

The internal bladder may be secured to a sole layer of the sole structure, with the cushioning component positioned between the sole layer and the sole component. Alternatively or in addition, the internal bladder may be secured to at least one of the sole layer or the cushioning component.

In some implementations, the aperture in the outer surface of the cushioning component is a first aperture, the bladder defines a second aperture, and the projection extends through the first aperture and into the second aperture. Stated differently, the projection extends into the chamber through the aperture in the cushioning component and extends at least partially in the aperture in the bladder. Such a bladder may be referred to as having a "donut" shape where the second aperture is a through hole, for example.

In an example, the sole structure may include a bladder disposed external to the chamber and adjacent to the protruding shape. Such a bladder may be referred to herein as an "external" bladder as it is external to the chamber. The external bladder may include a tensile component secured to inner surfaces of the external bladder.

The external bladder may be secured to a sole layer of the sole structure or to the sole component, with the cushioning component positioned between the sole layer and the sole component.

The external bladder may have an aperture through which the protruding shape of the cushioning component at least partially extends. The aperture may be a through hole in the external bladder, for example. In embodiments in which the sole structure includes multiple cushioning components each having a protruding shape as described, the external bladder may have multiple additional apertures, which may be through holes, and each corresponding with a respective one of the protruding shapes of the multiple cushioning components.

In an implementation, the sole component may be a first sole layer and the projection may be an integral extension of the first sole layer. The sole structure may further include a second sole layer disposed such that the cushioning component is between the first sole layer and the second sole layer. The projection may extend through the aperture in the protruding shape and may be secured to the second sole layer. In this manner, the first and second sole layers are integrally connected by the projection during the entire loading and unloading cycle. The compression profile of the sole structure may therefore be less staged than otherwise.

In an example, the cushioning component includes a body defining the chamber and the outer surface with the protruding shape. The body has an annular sidewall section having an equilibrium state at a first position and at a first angle relative to a longitudinal axis of the body in an expanded configuration of the cushioning component. For example, "an equilibrium state" is the position and angle of the annular sidewall section in the absence of applied loads (such as compressive loads applied along the longitudinal axis of the body). The body "self-biases" the annular sidewall section to remain at the equilibrium state (at the first position and at the first angle) in the absence of applied loads. The annular sidewall section is configured to elastically deform by snap-through buckling to a collapsed configuration when under the compressive load of at least the predetermined magnitude. More particularly, due to the snap-through buckling, the body has a first length along the longitudinal axis of the chamber in the expanded configuration and a second length along the longitudinal axis of the body in the collapsed configuration, the second length less than the first length. A body configured with such an annular sidewall section may be referred to as a snap-through mechanism. The compression profile of the body is at least partly characterized by the snap-through buckling. The body may provide a haptic indicator of the snap-through buckling. As used herein, "snap-through buckling" describes the deformation behavior of a structure in which displacement of the structure seemingly jumps from a first configuration to a second configuration once a predetermined compression load is applied, the jump occurring without a corresponding increase in the applied load. Stated differently, in some examples, rather than a more linear deformation, the body stays generally in an equilibrium state even as compressive loading increases up to the predetermined compressive load, and then rapidly deforms under the predetermined compressive load. The deformation is described as buckling as the shape of the annular sidewall section may become less planar along the outer surface as it at least partially inverts. The body and annular sidewall sections and the sole structure disclosed herein in which they are included exhibit resilient deformation so that the body returns to the equilibrium state when the compressive load is removed.

In some implementations that have a body configured for snap-through buckling, a resilient member may be disposed within the chamber. For example, the resilient member may be an elastomeric foam member that may be disposed within the chamber and may absorb some of the compressive load and limit the buckling of the body at the annular sidewall section. The resilient return of the resilient member when the compressive load is removed or lessened may also assist with urging the annular sidewall section back to the equilibrium state.

In some examples, the body of the cushioning component may include multiple annular sidewall sections, each configured to exhibit snap-through buckling under a different compressive load. For example, the annular sidewall section as described may be referred to as a first annular sidewall section, and the body may further include a second annular sidewall section spaced apart from the first annular sidewall section along the longitudinal axis of the body. The second annular sidewall section may have an equilibrium state at a second angle relative to the longitudinal axis of the body in the expanded configuration of the cushioning component. A magnitude of the first angle may be different than a magnitude of the second angle such that the second annular sidewall section is configured to elastically deform by snap-through buckling to a collapsed configuration when under a compressive load of a different magnitude than the compressive load at which the first annular sidewall section elastically deforms by snap-through buckling.

In an example, a sole layer for an article of footwear includes a cushioning component having an outer surface and at least partially defining a chamber, the chamber at least partially surrounded by the outer surface. At least a portion of the outer surface has a protruding dome shape in the absence of at least a compressive load of at least a predetermined magnitude on the cushioning component. The protruding dome shape includes a base portion and a crown portion protruding outward from the base portion. The outer surface of the protruding dome shape has either an aperture or a recess in the crown portion. The crown portion of the protruding dome shape at least partially inverts relative to the base portion under the compressive load, and reverts back to protrude outward from the base portion upon removal of the compressive load.

A method of manufacturing a sole structure, such as any of the sole structures described herein, includes providing a sole layer including a cushioning component that has an outer surface and that at least partially defines a chamber at least partially surrounded by the outer surface. At least a portion of the outer surface has a protruding shape in the absence of at least a compressive load of at least a predetermined magnitude on the cushioning component. The method includes positioning a sole component so that a projection of the sole component either extends through an aperture in the outer surface of the cushioning component and within the chamber or interfaces with a recess in the outer surface of the cushioning component.

In some examples, the method may further include securing the projection to the cushioning component. Securing the projection to the cushioning component may include heating the projection. For example, heating the projection may expand foam material of the projection to bond the projection to the cushioning component within the fluid-filled chamber and seal the aperture (e.g., thermal bonding).

In an implementation, the method may further include pressurizing the fluid-filled chamber with gas or air. Additionally, the method may include bonding a first polymeric sheet to a second polymeric sheet to define the fluid-filled chamber and the protruding dome shape.

In an example, a sole structure for an article of footwear includes a cushioning component having an outer surface and at least partially defining a chamber at least partially surrounded by the outer surface. At least a portion of the outer surface has a protruding shape in the absence of a compressive load of at least a predetermined magnitude on the cushioning component. A sole component is disposed external to the cushioning component. An external bladder is disposed external to the chamber and between the sole component and the protruding shape and against the protruding shape. In some implementations, the bladder may have a tensile component secured to opposing inner surfaces of the bladder. The protruding shape of the cushioning component compresses against the external bladder under the compressive load.

In some implementations, the external bladder may define an aperture extending at least partially through the external bladder. The aperture may be a through hole. The protruding shape may nest at least partially in the aperture of the external bladder and/or compress against the external bladder under the compressive load.

The cushioning component may be one of a plurality of cushioning components included in the sole structure, each having an outer surface at least a portion of which has a protruding shape in the absence of a compressive load of at least a respective predetermined magnitude on the cushioning component. The aperture in the external tensile component may be a first through hole, and the external tensile component may include a plurality of additional through holes. The protruding shape of each of the plurality of cushioning components may nest at least partially in a respective one of the additional through holes and/or compress against the external bladder under the compressive load.

In another example, a sole structure for an article of footwear may include a cushioning component including a body, the body having an outer surface and at least partially defining a chamber at least partially surrounded by the outer surface. At least a portion of the outer surface may have a protruding shape in the absence of a compressive load of at least a predetermined magnitude on the cushioning component. The sole structure may also include a sole component that interfaces with the outer surface of the cushioning component. The body may have an annular sidewall section that has an equilibrium state at a first position and at a first angle relative to a longitudinal axis of the body in an expanded configuration of the cushioning component. The annular sidewall section may be configured to elastically deform by snap-through buckling to a collapsed configuration when under the compressive load. The body has a first length along the longitudinal axis of the body in the expanded configuration and a second length along the longitudinal axis of the body in the collapsed configuration, the second length less than the first length. In some examples, the body may provide a haptic indicator of the snap-through buckling.

The annular sidewall section may be a first annular sidewall section, and the body may further include a second annular sidewall section spaced apart from the first annular sidewall section along the longitudinal axis of the body. The second annular sidewall section may have an equilibrium state disposed at a second angle relative to the longitudinal axis of the body in the expanded configuration of the cushioning component. A magnitude of the first angle may be different than a magnitude of the second angle such that the second annular sidewall section is configured to elastically deform by snap-through buckling to a collapsed configuration when under a compressive load of a different magnitude than the compressive load at which the first annular sidewall section elastically deforms.

In some examples having a cushioning component with a body having an annular sidewall portion, a resilient member may be disposed within the chamber. A resilient member, such as a foam member or a bladder, for example, may limit the movement of the annular sidewall portion during compression and/or assist with moving the annular sidewall portion back to the equilibrium state upon removal of the compressive load.

In an example, the sole component and the projection may be an integral, monolithic part of the cushioning component as a single, unitary structure with the sole component including both a ground-facing portion protruding outward from the outer surface of the cushioning component and the projection protruding inward from the inner surface of the cushioning component into the chamber.

In an implementation, a sole layer may overlie the cushioning component, and the cushioning component may compress around the projection upon application of the compressive load of at least the predetermined magnitude on the cushioning component, at least partially inverting the protruding shape. Additionally, upon sufficient inversion of the protruding shape, the projection may contact and resiliently deform the sole layer.

In an implementation, the sole layer may include a bladder defining an interior cavity configured to retain a fluid at or above ambient pressure. In some examples, a tensile component may be disposed within the interior cavity and secured to opposing inner surfaces of the bladder.

The protrusion may have a center axis and may move along the center axis toward and away from the bladder during resilient deformation of the protruding shape.

In some implementations, the protrusion may have a noncylindrical shape around the center axis. In some implementations, the protrusion may include multiple arms extending outward from the center axis, the multiple arms pressing against the bladder during resilient deformation of the protruding shape. For example, the multiple arms may include four arms spaced around the center axis. A protrusion with a noncylindrical shape may distribute deformation of the tethers in a manner that results in increased energy return.

The above features and advantages and other features and advantages of the present teachings are readily apparent from the following detailed description of the modes for carrying out the present teachings when taken in connection with the accompanying drawings. It should be understood that even though in the following the embodiments may be separately described, single features thereof may be combined in additional embodiments.

Referring to the drawings wherein like reference numbers refer to like components throughout the views, FIG. 1 shows an article of footwear 10. The article of footwear 10 includes a sole structure 12 and an upper 14 secured to the sole structure 12. The upper 14 is configured to form a foot-receiving cavity 16 with an ankle opening 18 above the sole structure 12 that receives and retains a foot so that the foot is supported on the sole structure 12 when the sole structure 12 is positioned below the foot, and between the foot and the ground, which is represented by a ground plane G, also referred to herein simply as the ground G.

The article of footwear 10 as well as the upper 14 and the sole structure 12 include a forefoot region 26, a midfoot region 28, and a heel region 30. The forefoot region 26 generally includes portions of the article of footwear 10 corresponding with the toes and the metatarsophalangeal joints (which may be referred to as MPT or MPJ joints) connecting the metatarsal bones of the foot and the proximal phalanges of the toes. The midfoot region 28 generally includes portions of the article of footwear 10 corresponding with the arch area and instep of the foot, and the heel region 30 corresponds with rear portions of the foot, including the calcaneus bone. The forefoot region 26, the midfoot region 28, and the heel region 30 are not intended to demarcate precise areas of the article of footwear 10 but are instead intended to represent general areas of the article of footwear 10 to aid in the following discussion.

Figure 12:
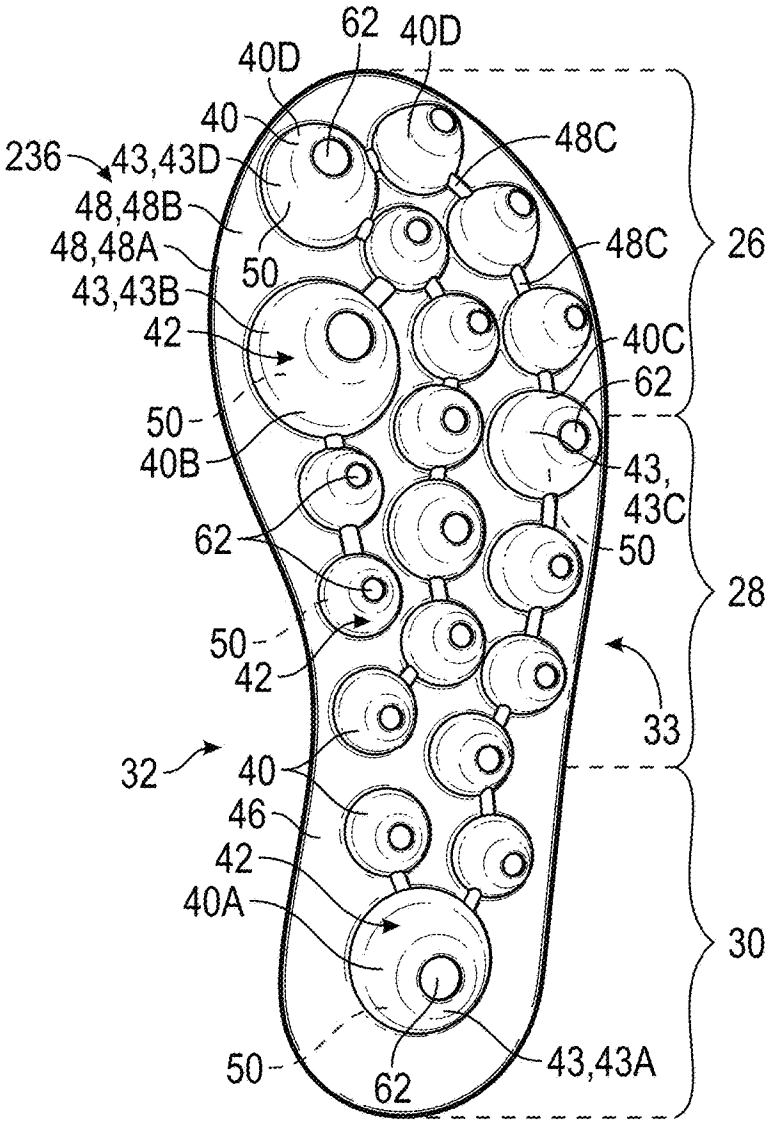
FIG. 12 is a bottom perspective view of an alternative sole layer including multiple cushioning components for use in a sole structure of an article of footwear.

The article of footwear 10 has a medial side 32 (shown) and a lateral side (not shown, but understood by those skilled in the art, and similar to lateral side 33 as indicated with respect to the sole layer 236 of FIG. 12). The lateral side and the medial side 32 extend through each of the forefoot region 26, the midfoot region 28, and the heel region 30, and correspond with opposite sides of the article of footwear 10, each falling on an opposite side of a longitudinal midline of the article of footwear 10. The lateral side is thus considered to be opposite from the medial side 32. The article of footwear 10 as shown is configured for a left foot. An article of footwear configured for a right foot may be a mirror image of the article of footwear 10.

In order from the top (i.e., the proximal side of the sole structure 12 nearest the foot-receiving cavity 16) to the bottom (i.e., the distal side of the sole structure 12 at a ground contact surface 24), the sole structure 12 includes a first layer 34, a second layer 36, and a third layer 38, each of which are discussed further herein. The third layer 38 is also referred to herein as a sole component. These components of the sole structure 12 function as a system having various beneficial properties discussed herein and may be referred to together as a midsole system. Each layer 34, 36, and 38 may alternatively be referred to as a sole layer or as a midsole layer. An outsole (not shown) or multiple outsole components may be secured to the bottom of the sole component 38 or the sole component 38 may form the ground contact surface 24 of the sole structure 12, as shown, functioning as part of the midsole system and also as an outsole.

Each of the first layer 34, the second layer 36, and the sole component 38 extends in the forefoot region 26, the midfoot region 28, and the heel region 30. The first layer 34 may be a foam layer providing resilient cushioning. The first layer 34 overlies the second layer 36 and has a distal side interfacing with a proximal side of the second layer 36 in the forefoot region 26, the midfoot region 28, and the heel region 30. The second layer 36 underlies the first layer 34, and has a distal side interfacing with a proximal side of the sole component 38 in the forefoot region 26, the midfoot region 28, and the heel region 30. The second layer 36 may be secured to the first layer 34 and to the sole component 38 such as by thermal bonding and/or with adhesive, or otherwise.

The second layer 36 includes multiple cushioning components 40 each defined at a portion of an outer surface 42 of the second layer 36. The outer surface 42 is indicated by reference number with respect to one of the cushioning components 40 in FIG. 1 but includes the entire outer surface of each of the cushioning components 40 as well as the outer surface of the remainder of the second layer 36 (e.g., at the bonded portions 48 such as the peripheral flange 48A and webbing 48B discussed herein). The portion of the outer surface 42 at each of the cushioning components 40 has a protruding shape 43 (only some are labelled in FIG. 1) when the cushioning component 40 is unloaded (e.g., not under a compressive load) or at least in the absence of at least a compressive load of at least a predetermined magnitude on the cushioning component 40 (e.g., when a compressive load on the cushioning component 40 is less than a threshold compressive load) as further discussed herein. The protruding shapes 43 are shown as protruding dome shapes in FIG. 1, but are not limited to dome shapes. For example, within the scope of the disclosure, the protruding shape of a cushioning component, such as cushioning component 40, could be cylindrical, a tapered frustoconical shape, or another protruding shape that is not a dome shape. For purposes of discussion of FIG. 1, the protruding shapes 43 may be referred to as protruding dome shapes, and may also referred to herein as first protruding dome shapes.

As used herein a "protruding dome shape" is a protruding shape that may be but need not be entirely rounded or hemispherical, could have edges and/or corners (e.g., multiple sides), etc. Because the polymeric sheets 44, 46 themselves create the protruding dome shapes 54, 43, respectively, rather than inflation pressure within the fluid-filled chambers 50, the protruding dome shapes 54, 43 is not limited to a rounded shape as they would tend to be when created by internal pressure.

Although the protruding dome shapes 43 of the second sole layer 36 are shown protruding downward in FIG. 1, in other implementations, a second sole layer may include one or more cushioning components that protrude generally upward, with a sole layer having projections 58 like the third sole layer 38 disposed above the cushioning components and extending toward the cushioning components.

Although multiple cushioning components 40 are shown, in some implementations only a single cushioning component 40 is included in the second layer 36 such as, for example, in the heel region 30. Only some of the cushioning components 40 are visible in the medial side view of the article of footwear 10 in FIG. 1, and additional cushioning components 40 may be dispersed over the width and length of the sole structure 12 similar to as shown in some of the specific implementations of sole layers of FIGS. 12-17 and of FIGS. 31-43.

Figure 6:
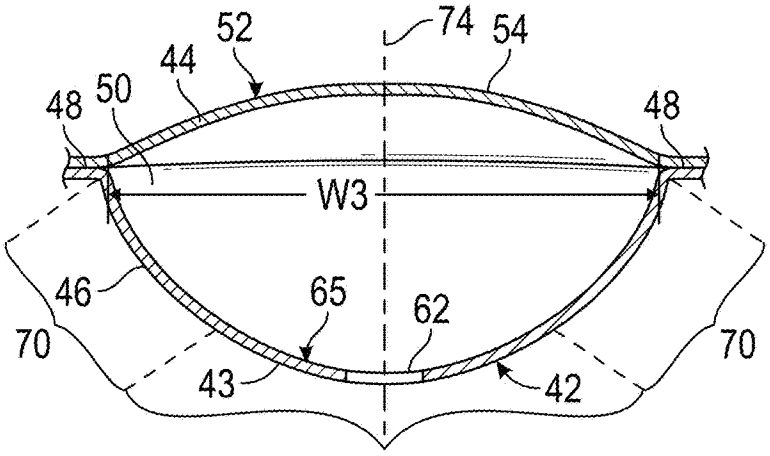
FIG. 6 is a cross-sectional view of a cushioning component included in the sole structure of FIGS. 1-3.
Figure 11:
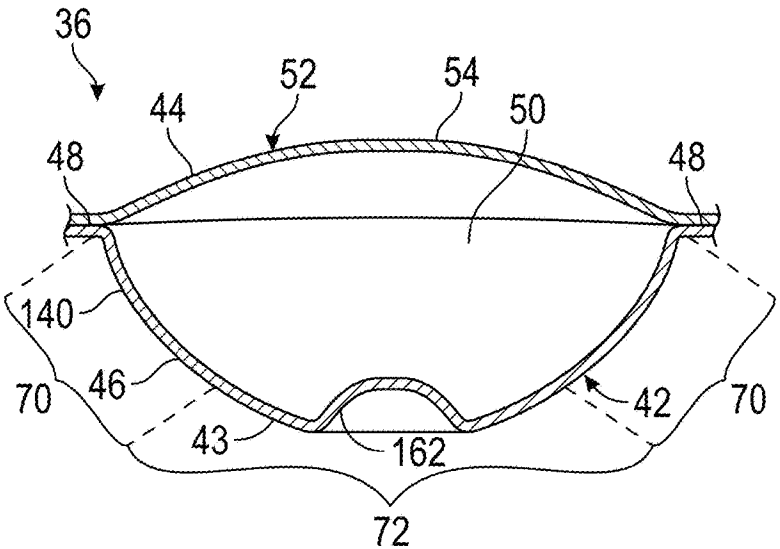
FIG. 11 is a cross-sectional view of a cushioning component included in the sole structure of FIGS. 7-8.

As discussed herein, the cushioning components 40 may be formed by a first polymeric sheet 44 and a second polymeric sheet 46 bonded together at bonded portions 48 to at least partially define a fluid-filled chamber 50, as indicated in FIG. 6 with respect to cushioning component 40E and in FIG. 11 with respect to cushioning component 140, for example. The second polymeric sheet 46 may also be referred to as the bottom sheet and the portion of the outer surface 42 of the second layer 36 that forms each of the protruding shapes 43 shown in FIG. 1 is the outer surface of the second polymeric sheet 46. The bonded portions 48 include the peripheral flange 48A extending around an outer periphery of the second layer 36, as visible in FIG. 1, and webbing 48B which extends between adjacent cushioning components 40 as shown in FIG. 1 (only some of the webbing 48B is indicated by reference number in FIG. 1).

Figure 14:
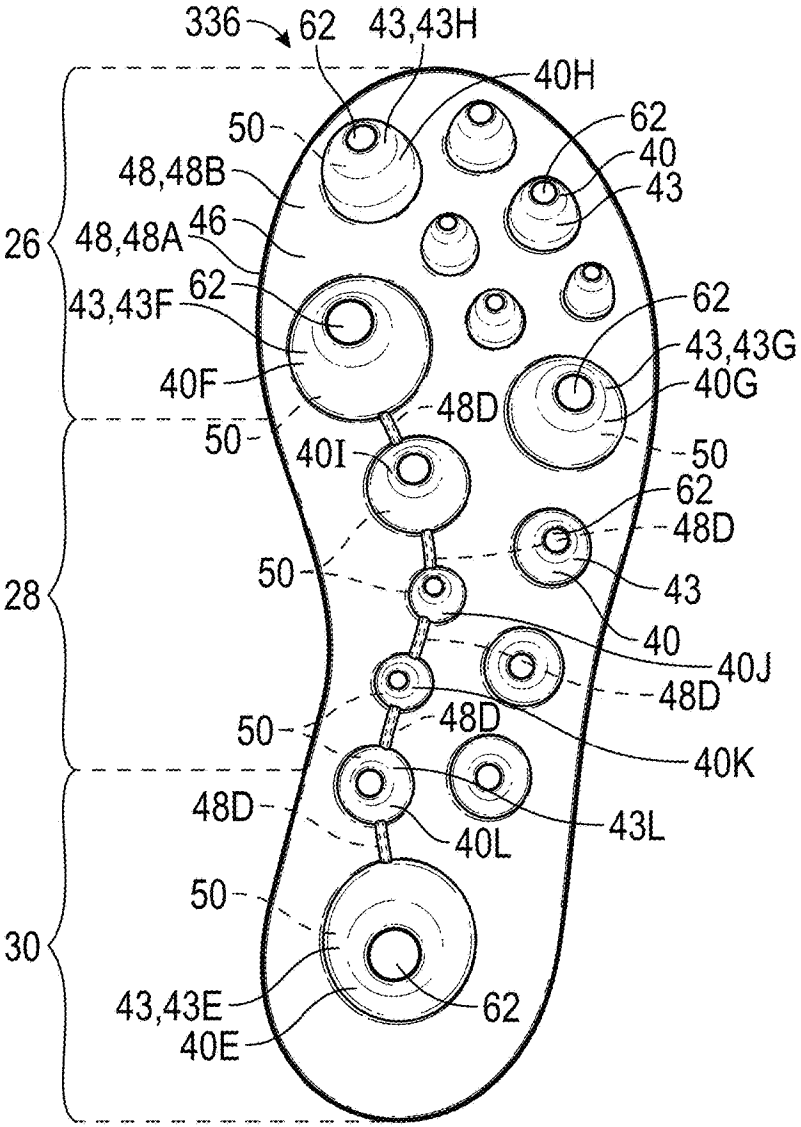
FIG. 14 is a bottom perspective view of another alternative sole layer including multiple cushioning components for use in a sole structure of an article of footwear.

In some implementations, channels are formed by the polymeric sheets 44, 46 and fluidly connect two or more of the fluid-filled chambers 50, as discussed with respect to the sole layer 336 of FIG. 14. The channels may be formed by the polymeric sheets 44, 46 to extend through the webbing 48B, for example.

In some implementations described herein, one or more cushioning components are formed by a single sheet, such as the second polymeric sheet 46, without an additional polymeric sheet such as the first polymeric sheet 44. For example, FIGS. 32-42 show examples of such cushioning components 1140, 1240, and 1440 formed of a single sheet.

Figure 8:
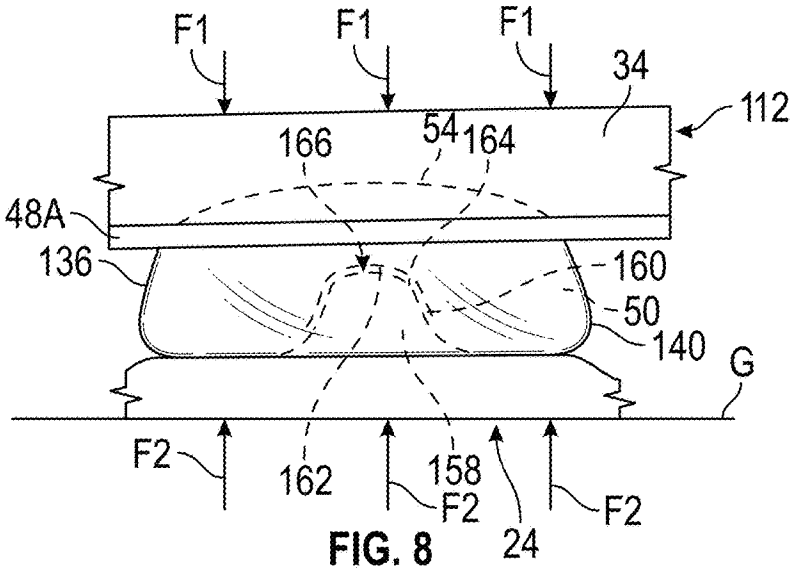
FIG. 8 is a fragmentary side view of the portion of the sole structure of FIG. 7 under a compressive load.

The first polymeric sheet 44 may have an outer surface 42 that forms additional protruding shapes 54 (also referred to herein as second protruding shapes or second protruding dome shapes) extending in an opposite direction than the protruding dome shapes 43 of the second polymeric sheet 46, as indicated in FIGS. 8 and 11, for example. The first layer 34 may have recesses 55 (see FIGS. 2 and 7) in a bottom surface in which the additional protruding shapes 54 nest so that the additional protruding shapes 54 are not visible in the medial side view of FIG. 1.

The first and second polymeric sheets 44, 46 may be a single layer of polymeric material capable of retaining air or gas in the fluid-filled chambers 50 when sealed. Examples of polymer materials for the polymeric sheets 44, 46 include thermoplastic elastomers, such as elastomers derived from thermoplastic polyurethanes, thermoplastic polyamides, thermoplastic polyolefins, and combinations thereof. In one example, the polymeric sheets 44, 46 may be a polyether block amide PEBAX®, available from Arkema, Inc. in King of Prussia, Pennsylvania USA.

Furthermore, each of the first and second polymeric sheets 44, 46 may be formed from multi-layer films of one or more thermoplastic elastomer layers interlaced with one or more gas-barrier layers. For instance, each of the first and second polymeric sheets 44, 46 may include alternating layers of one or more thermoplastic polyurethanes and one or more copolymers of ethylene and vinyl alcohol (EVOH), such as a flexible microlayer membrane as disclosed in U.S. Pat. Nos. 6,082,025 and 6,127,026 to Bonk et al. which are incorporated by reference in their entireties. Alternatively, the layers may include one or more ethylene-vinyl alcohol copolymers, one or more thermoplastic polyurethanes, and a regrind material of the ethylene-vinyl alcohol copolymer(s) and thermoplastic polyurethane(s). Additional suitable materials for the first and second polymeric sheets 44, 46 are disclosed in U.S. Pat. Nos. 4,183,156 and 4,219,945 to Rudy which are incorporated by reference in their entireties. Further suitable materials for the first and second polymeric sheets 44, 46 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the cushioning components described herein, engineering properties such as tensile strength, stretch properties, fatigue characteristics, dynamic modulus, and loss tangent can be considered. For example, the thicknesses of the first and second polymeric sheets 44, 46 used to form the cushioning component shown in FIG. 6 can be selected to provide these characteristics.

Furthermore, in some embodiments, the first and second polymeric sheets 44, 46 function as gas barriers for retaining one or more gases within the cushioning component, where the gas transmission rate of the polymeric sheets 44, 46, such as an oxygen gas or nitrogen gas transmission rate, can be measured using ASTM D1434-23. Examples of oxygen gas and/or nitrogen gas transmission rates for the polymeric sheets 44, 46 (and the cushioning component) (as measured using ASTM D1434-23) include rates of less than or equal to about 4 cubic centimeters per square meter of the sheets 44, 46 per day, and less than or equal to about 3 cubic centimeters per square meter of the sheets 44, 46 per day.

As such, any of the above materials used to form the polymeric sheets 44, 46 results in the protruding shapes 54 and 43 existing in and being defined by the respective polymeric sheets 44, 46 even prior to the polymeric sheets 44, 46 being bonded to one another and even prior to possibly inflating and sealing the fluid-filled chambers 50. Stated differently, the second polymeric sheet 46 is formed with the protruding shapes 43 such as by injection molding, extrusion, thermoforming, etc., and the protruding shapes 43 exist even when the second polymeric sheet 46 is not assembled in the sole structure 12. Similarly, the first polymeric sheet 44 is formed with the additional protruding shapes 54 such as by injection molding, extrusion, thermoforming, etc., and the additional protruding shapes 54 exist even when the first polymeric sheet 44 is not assembled in the sole structure 12. In this case, the material and formed structure of the polymeric sheets 44, 46 rather than pressure on the polymeric sheets 44, 46 from fluid in the fluid-filled chamber 50 causes the protruding shapes 54, 43, respectively.

The sole component 38 includes a base 56 and a projection 58 that extends toward and is disposed relative to the protruding shape 43 of the outer surface 42 of the cushioning component 40. In an implementation with multiple cushioning components 40, there are multiple corresponding projections 58 such that a respective protruding shape 43 compresses around and is made to at least partially invert by a respective projection 58 of the sole component 38 when the sole structure 12 is under a compressive load of at least a predetermined magnitude at that cushioning component 40 (referred to herein as a threshold compressive load), such as it may be when under dynamic compressive loading due to impact of the ground contact surface 24 of the sole structure 12 with the ground plane G). The cushioning component 40 resiliently deforms, with the inverted portion of the outer surface 42 reverting back to the protruding shape 43 as the cushioning component 40 is unloaded (e.g., the magnitude of the compressive load lessens).

Figure 34:
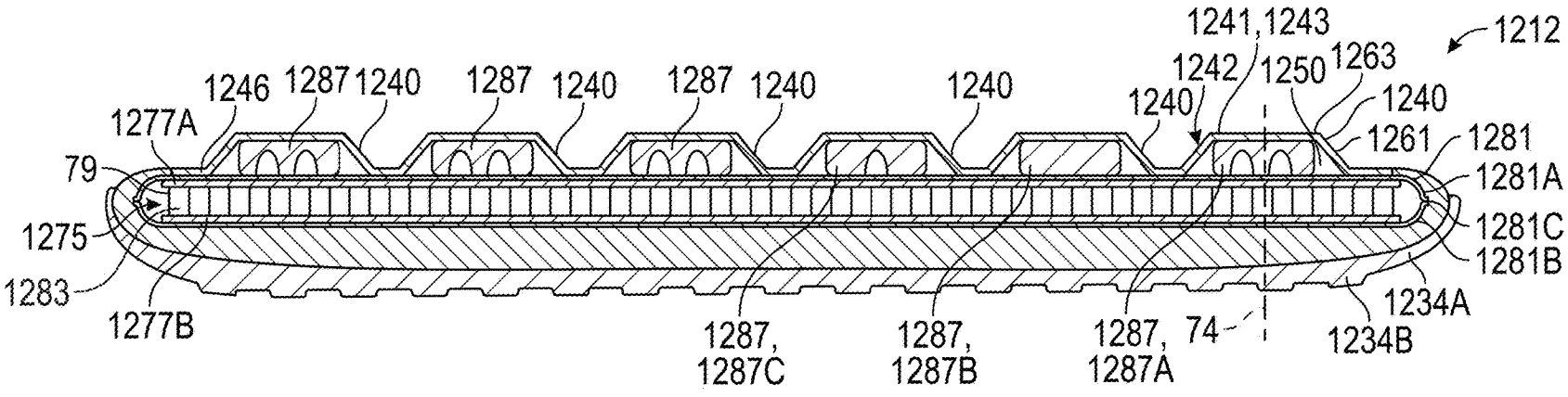
FIG. 34 is a cross-sectional view taken at lines 34-34 in FIG. 35 of a sole structure having multiple cushioning components configured for snap-through buckling.

In the embodiment shown in FIG. 1, the protruding shapes 43 of the cushioning components 40 extend generally downward and the projections 58 extend generally upward when the sole structure 12 is incorporated in the article of footwear 10 and worn on a foot with the sole structure 12 positioned between the foot and the ground plane G. In other embodiments, a sole component having a base and projections similar to sole component 38 could be configured to overlie the second layer 36, being positioned above the second layer 36. Optionally, a foam cushioning layer similar to the first layer 34 could be positioned below the second layer 36. In such an embodiment, the second layer 36 could be arranged so that the protruding shapes 43 extend generally upward and the projections 58 extend generally downward toward the protruding shapes 43 when the sole structure is incorporated in an article of footwear 10 and worn on a foot with the sole structure positioned between the foot and the ground plane G. FIG. 34 shows an example of a sole structure 1212 having cushioning components 1240 with protruding shapes that extend generally upward, for example.

In an embodiment with multiple cushioning components 40, the compression profile of each cushioning component 40 may be independent of each other cushioning component 40 and may be tuned to be suitable for its location on the sole structure 12. For example, when the sole structure 12 impacts the ground at the heel region 30, a cushioning component 40 in the heel region 30 will resiliently deform as described prior to deformation of a cushioning component 40 in the forefoot region 26, which will resiliently deform as the foot rolls forward to the forefoot region 26 and when the sole structure 12 pushes away from the ground plane G in a propulsive phase of the gait cycle just prior to toe-off.

As is apparent in FIG. 1, the projections 58 vary in height in at least one of the forefoot region 26, the midfoot region 28, or the heel region 30 of the sole structure 12. It is apparent, for example, that the projection labeled 58A in the midfoot region 28 has a height H1 which is greater than a height H2 of the projection labelled 58B, which is also in the midfoot region 28. The projections 58 in the heel region 30 also vary in height from one another, and the projections 58 in the forefoot region 26 vary in height from one another although to a less noticeable extent than in the midfoot region 28 in FIG. 1.

A height of at least one of the projections 58 in the forefoot region 26, the midfoot region 28, or the heel region 30 is different than a height of at least one of the projections 58 in a different one of the forefoot region 26, the midfoot region 28, or the heel region 30. For example, the height H3 of projection 58C in the forefoot region 26 is different than the height H1 of projection 58A in the midfoot region 28, and both the height H3 of the projection 58C in the forefoot region 26 and the height H1 of the projection 58A in the midfoot region 28 are different than the height H4 of the projection 58D in the heel region 30.

Figure 3:
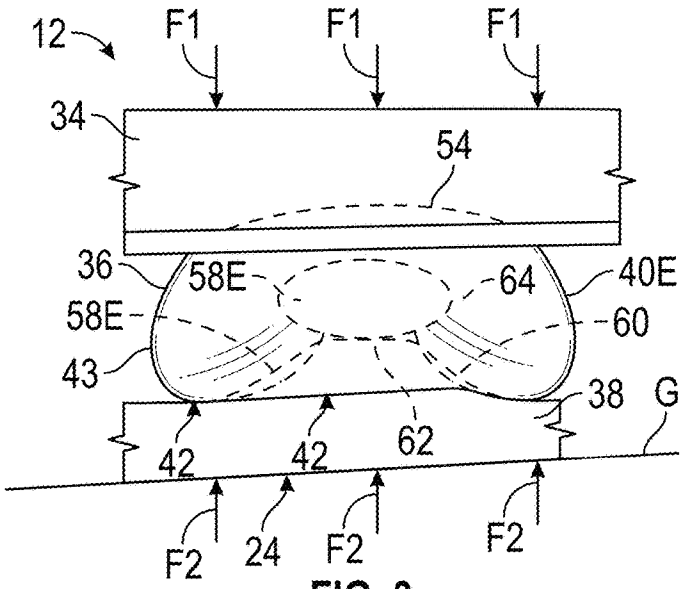
FIG. 3 is a fragmentary side view of the portion of the sole structure of FIG. 2 under a compressive load.
Figure 2:
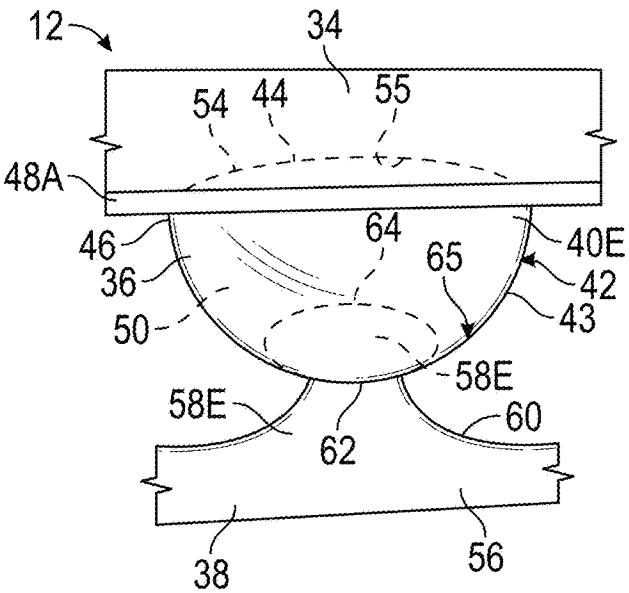
FIG. 2 is a fragmentary side view of a portion of the sole structure of FIG. 1 in an unloaded state.

FIG. 2 is a fragmentary side view of a portion of the sole structure 12 of FIG. 1 is an unloaded state. FIG. 3 is a fragmentary side view of the portion of the sole structure 12 of FIG. 2 under a compressive load F1 of at least a predetermined magnitude. FIGS. 2-3 particularly show the portion of the sole structure 12 that includes one of the cushioning components 40 labelled 40E and one of the projections 58 labelled 58E in FIG. 1.

Figure 4:
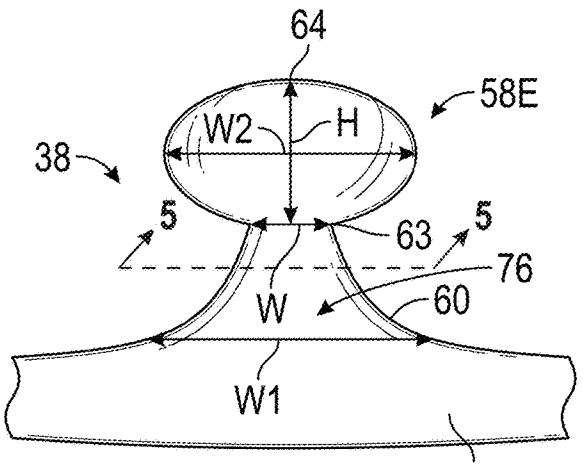
FIG. 4 is a fragmentary side view of a sole component included in the sole structure of FIGS. 1-3.

The projection 58E includes a stem 60 that extends through the outer surface 42 of the cushioning component 40E at an aperture 62 in the cushioning component 40E. The aperture 62 is shown best in FIG. 6. As shown in FIG. 4, the stem 60 tapers in width from width W1 at the base 56 to a narrowest portion of width W at the end 63 of the stem 60 that may be the width of the aperture 62. The projection 58E includes an enlarged head 64 at the end 63 of the stem 60 that is disposed within the fluid-filled chamber 50. The enlarged head 64 has a width W2 that is wider than the aperture 62 and may be formed from foam, such as expanded foam. The enlarged head 64 may be sealed to the inner surface 65 of the cushioning component 40E at the aperture 62 to seal the aperture 62. For example, the foam may thermally bond to the inner surface 65 of the second polymeric sheet 46. In FIG. 2, the additional protruding shape 54 of the first polymeric sheet 44 is indicated with a hidden line where it fits into a recess 55 at a lower side of the first layer 34.

The sole component 38, including the stem 60 and head 64, may be an elastomeric foam and a unitary foam component (such as a unitary injection-molded foam component) or may be a plurality of fused expanded foam pellets.

The elastomeric foam of the sole component 38 may be a foamed polymeric material including one or more polymers. The one or more polymers may include an elastomer, including a thermoplastic elastomer (TPE). The one or more polymers may include aliphatic polymers, aromatic polymers, or mixture of both. In one example, the one or more polymers may include homopolymers, copolymers (including terpolymers), or mixtures of both homopolymers and copolymers. The copolymers may be random copolymers, block copolymers, alternating copolymers, periodic copolymers, or graft copolymers, for instance. The one or more polymers may include polymers chosen from polyolefins, polyacrylates, ionomeric polymers, vinyl polymers, polysiloxanes, fluoropolymers, polystyrenes, polyamides, polyimides, polyesters, polyethers, polyurethanes, and any combination thereof. The one or more polymers may include polymers chosen from polyolefins, polyamides, polyesters, and polyurethanes. The one or more polymers may include polymers chosen from polyamides and polyesters. The one or more polymers may include olefinic homopolymers or copolymers or a mixture of olefinic homopolymers and copolymers. Examples of olefinic polymers include polyethylene (PE) and polypropylene (PP). For example, the PE may be a PE homopolymer such as a low-density PE or a high-density PE, a low molecular weight PE or an ultra-high molecular weight PE, a linear PE or a branched chain PE, etc. The PE may be an ethylene copolymer such as, for example, an ethylene-vinyl acetate (EVA) copolymer, an ethylene-vinyl alcohol (EVOH) copolymer, an ethylene-ethyl acrylate copolymer, an ethylene-unsaturated monofatty acid copolymer, etc. The one or more polymers may include a polyacrylate such as a polyacrylic acid, an ester of a polyacrylic acid, a polyacrylonitrile, a polyacrylic acetate, a polymethyl acrylate, a polyethyl acrylate, a polybutyl acrylate, a polymethyl methacrylate, a polyvinyl acetate, etc., including derivatives thereof, copolymers thereof, and any mixture thereof, in one example. The one or more polymers may include an ionomeric polymer. The ionomeric polymer may be a polycarboxylic acid or a derivative of a polycarboxylic acid, for instance. The ionomeric polymer may be a sodium salt, a magnesium salt, a potassium salt, or a salt of another metallic ion. The ionomeric polymer may be a fatty acid modified ionomeric polymer. Examples of ionomeric polymers include polystyrene sulfonate, and ethylene-methacrylic acid copolymers. The one or more polymers may include a polycarbonate. The one or more polymers may include a fluoropolymer. The one or more polymers may include a polysiloxane. The one or more polymers may include a vinyl polymer such as polyvinyl chloride (PVC), polyvinyl acetate, polyvinyl alcohol, etc. The one or more polymers may include a polystyrene. The polystyrene may be a styrene copolymer such as, for example, an acrylonitrile butadiene styrene (ABS), a styrene acrylonitrile (SAN), a styrene ethylene butylene styrene (SEBS), a styrene ethylene propylene styrene (SEPS), a styrene butadiene styrene (SBS), etc. The one or more polymers may include a polyamide (PA). The PA may be a PA 6, PA 66, PA 11, or a copolymer thereof. The polyester may be an aliphatic polyester homopolymer or copolymer such as polyglycolic acid, polylactic acid, polycaprolactone, polyhydroxybutyrate, and the like. The polyester may be a semi-aromatic copolymer such as polyethylene terephthalate (PET) or polybutylene terephthalate (PBT). The one or more polymers may include a polyether such as a polyethylene glycol or polypropylene glycol, including copolymers thereof. The one or more polymers may include a polyurethane, including an aromatic polyurethane derived from an aromatic isocyanate such as diphenylmethane diisocyanate (MDI) or toluene diisocyanate (TDI), or an aliphatic polyurethane derived from an aliphatic isocyanate such as hexamethylene diisocyanate (HDI) or isophone diisocyanate (IPDI), or a mixture of both an aromatic polyurethane and an aliphatic polyurethane.

The foamed polymeric material may be a chemically foamed polymeric material, which is foamed using a chemical blowing agent that forms a gas when heated. For example, the chemical blowing agent can be an azo compound such as adodicarbonamide, sodium bicarbonate, or an isocyanate. Alternatively, or additionally, the foamed polymeric material may be a physically foamed polymeric material, which is foamed using a physical blowing agent which changes phase from a liquid or a supercritical fluid to a gas due to changes in temperature and/or pressure.

Optionally, in addition to the one or more polymers, the foamed polymeric material may further include one or more fillers such as glass fiber, powdered glass, modified or natural silica, calcium carbonate, mica, paper, wood chips, modified or natural clays, modified or unmodified synthetic clays, talc, etc. Similarly, the polymeric material optionally may further include one or more colorants, such as pigments or dyes. Other optional components of the polymeric material include processing aids, ultra-violet light absorbers, and the like.

While the polymeric material which is foamed may start off as a thermoplastic material, in some examples, the polymeric material may be crosslinked during the foaming process or after it has been foamed, resulting in the foamed polymeric material being a crosslinked foamed polymeric material, i.e., a foamed material in which covalent crosslinking bonds exist between at least a portion of the one or more polymers. A crosslinked foamed polymeric material can be formed by including a crosslinking agent in the polymeric material used to form the foam, or by exposing the foamed polymeric material to crosslinking conditions, such as gamma rays. In one example, the crosslinking agent can be a peroxide-based crosslinking agent such as dicumyl peroxide. The foamed polymeric material may be fully thermoset, or may retain some thermoplastic properties so that it can be softened by heat but not fully melt. Alternatively, the foamed polymeric material can be an uncrosslinked foamed polymeric material which remains fully thermoplastic after being foamed. Thermoplastic foamed polymeric materials can be recycled by melting them.

FIG. 3 shows the portion of the sole structure 12 of FIG. 2 under an example of compressive loading with a downward load F1 distributed on the first layer 34 by the weight of the wearer during impact with the ground plane G and a reaction load F2 of the same magnitude as the downward load F1 resulting from the ground plane G acting on the ground contact surface 24. Depending on their relative stiffnesses, compression of the first layer 34, the cushioning component 40E of the second layer 36, and the sole component 38 will progress serially or in parallel. The performance of the sole structure 12 under compressive loading is described with respect to the cushioning component 40E but applies equally to each of the cushioning components 40 when loaded as described.

Figure 5:
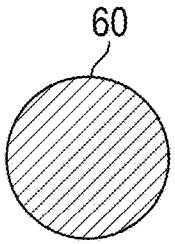
FIG. 5 is a cross-sectional view of a projection of the sole component of FIG. 4 taken at lines 5-5 in FIG. 4.

Assuming that the compressive load F1 is at least the predetermined magnitude, the cushioning component 40E will begin to compress around the stem 60 of the projection 58E and onto the base 56 as shown in FIG. 3. Specifically, the outer surface 42 of the cushioning component 40E compresses against the base 56. As compressive loading progresses, the outer surface 42 of the cushioning component 40E interfaces with the widening stem 60 of the projection 58E as it nears the base 56, gradually increasing the rate of change of stiffness of the resiliently deforming cushioning component 40E. The stem 60 of the projection 58E is round in a cross-section perpendicular to a length of the projection 58E, as shown in FIG. 5, and the area of the round cross section increases in a direction toward the base 56.

As shown in FIG. 3, the protruding shape 43 of the outer surface 42 of the cushioning component 40E partially inverts under at least the predetermined compressive load F1 with the outer surface 42 surrounding the stem 60 and resting against the surface of stem 60 as well as the surface of the base 56 surrounding the stem 60. The head 64 remains in the fluid-filled chamber 50 and is closer to the top of the now-compressed fluid-filled chamber 50. In some implementations, the sole structure 12 may be configured so that the head 64 will bear loading of the first layer 34 (e.g., the fluid-filled chamber 50 sufficiently reduces in height so that the head 64 touches the inner surface of the first polymeric sheet 44 at the additional protruding shape 54) and the load of the first layer 34 is transferred directly to the head 64). Upon removal of the compressive load F1 (and reaction load F2), the inverted portion of the outer surface 42 reverts back to the protruding dome shape 43.

With reference to FIG. 6, the protruding shape 43 of the outer surface 42 of the cushioning component 40E includes a base portion 70 that extends partway down and completely around the protruding shape 43, having an annular surface area. The protruding shape 43 also includes a crown portion 72 extending from the base portion 70 and also having an annular shape (a circular shape less the area of the aperture 62).

The base portion 70 is subjected to hoop tensile forces under the compressive loading and the crown portion 72 is subjected to hoop compressive forces under the compressive loading. Hoop forces are forces along the outer surface 42 at any particular circle (referred to as a hoop) on the outer surface 42 formed by the intersection of the outer surface 42 with a plane perpendicular to the center axis 74 of the cushioning component 40E. The center axis 74 may also be referred to herein as the longitudinal axis of the cushioning component 40E. Such circles in the base portion 70 have tensile forces along their perimeter. Such circles in the crown portion 72 have compressive forces along their perimeter. This causes the crown portion 72 to collapse inward (e.g., invert) relative to the base portion 70 under a compressive load on the sole structure 12 at the cushioning component 40E and in a direction along the center axis 74 and of at least the predetermined magnitude (e.g., the threshold compressive load).

The cushioning component 40E may have a constant stiffness (i.e., a linear rate of change of load to displacement) during an initial stage of compression, such as prior to inversion of the crown portion 72 of the protruding shape 43, a drop in stiffness when the crown portion 72 of the protruding shape 43 inverts and the outer surface 42 at the crown portion 72 collapses around the projection 58E (e.g., around the stem 60 of the projection 58E), and then a non-linear stiffness, such as an exponentially increasing rate of change of load to displacement in compression as the outer surface 42 of the cushioning component 40E contacts the base 56 of the sole component 38, compressing against the base 56 and the stem 60, and eventually bottoming out (reaching maximum compression) against the base 56 of the sole component 38, assuming the compressive load is of a great enough magnitude to cause bottoming out.

As the compressive load is removed, the crown portion 72 resiliently returns to again extend outward from the base portion 70 upon removal of the compressive load of at least the predetermined magnitude (and hence, removal of the hoop compressive forces). For example, the internal biasing forces of the preformed protruding shape 43 may urge the crown portion 72 to return to protruding outward from the base portion 70 (e.g., the outer surface 42 of the protruding shape 43 reverts from the inverted position of FIG. 3 to the protruding position of FIG. 2). Additionally, the trapped gas or air in the fluid-filled chamber 50 may help to urge the crown portion 72 to return to protruding outward from the base portion 70. The enlarged head 64 may also help to pull the crown portion 72 back to the outwardly-protruding shape 43 as the sole component 38 and the second layer 36 move apart from one another as the forces compressing the second layer 36 toward the sole component 38 are removed.

The relative geometry of each cushioning component 40, the specific projection 58, and the base 56 at the specific projection 58 with which the cushioning component 40 interacts during compressive loading affects the compression profile of the sole structure 12. For example, each projection 58 has a projection width at the outer surface 42 of the respective one of the cushioning components 40 toward which the projection extends. FIG. 4 shows a projection width W at the end of the stem 60. The projection width varies as the stem 60 tapers from a wider projection width W1 at the base 56 to the projection width W at the end of the stem 60. Each protruding shape 43 (as a protruding dome shape) has a protruding dome width. FIG. 6 shows a protruding dome width W3 of the protruding dome shape 43, taken at the maximum width of the protruding shape 43.

As can be seen in FIG. 1, a ratio of the projection width of a projection 58 to the protruding dome width (e.g., width W3 in FIG. 6) may vary in at least one of the forefoot region 26, the midfoot region 28, or the heel region 30 of the sole structure 12 as is evident from the differently sized protruding shapes 43 in FIG. 1 and the projections 58 of different widths (only some of which are labeled by reference number in FIG. 1). This is true whether the projection width of the projection 58 is taken at the end of the stem 60 near the head 64, which will be the width of the projection 58 at the aperture 62 (e.g., width W in FIG. 4) or taken at the end of the stem 60 at the base 56 (e.g., width W1 in FIG. 4).

As is also apparent in FIG. 1, the ratio of the projection width to the protruding dome width varies between one of the forefoot region 26, the midfoot region 28, or the heel region 30 and at least one different one of the forefoot region 26, the midfoot region 28, or the heel region 30. In fact, in the embodiment of FIG. 1, the ratio of the projection width to the protruding dome width varies between each of the forefoot region 26, the midfoot region 28, and the heel region 30 and each different one of the forefoot region 26, the midfoot region 28, and the heel region 30.

The volume and/or width and/or height of the heads 64 may vary in any of or between any of the forefoot region 26, the midfoot region 28, and the heel region 30. FIG. 4 indicates the height H of the head 64 of the projection 58E. For example, it is apparent in FIG. 1 that the volume, widths, and heights of some of the heads 64 in the forefoot region 26 are different than (e.g., smaller than) the volume, width, and height of at least one of the heads 64 in the midfoot region 28, and different than the volume, width, and height of at least one of the heads in the heel region 30. The volume, width, and height of the head 64 may affect the rate of compression of the sole structure 12. For example, by occupying space within the fluid-filled chamber 50, the total volume of gas or air in the fluid-filled chamber 50 is reduced by the volume of the head 64. The height of the head 64 also affects how soon during compression of the sole structure 12 the compressive load is transferred to, and partially borne by, the projection 58. The width of the stem 60 also at least partially determines the portion of the outer surface 42 that will invert (e.g., the portion that will be considered the crown portion 72), as a wider stem 60 necessitates a wider aperture 62.

Each projection 58 has an area of interface with the outer surface 42 of the respective one of the cushioning components 40 toward which the projection 58 extends. For example, as evidenced in FIG. 3, the area of interface of projection 58E in FIG. 4 is the area of the outer surface 76 of the projection 58E extending entirely around the projection 58E and extending from the end of the stem 60 at the head 64 (e.g., where the width W is marked in FIG. 4) to the end of the stem 60 at the base 56 (e.g., where the width W1 is marked in FIG. 4). Likewise, each protruding shape 43 (as a protruding dome shape) has a protruding dome surface area. For example, the surface area of the protruding shape 43 of the cushioning component 40E in FIG. 6 is the area of the outer surface 42 of the cushioning component 40E, including the base portion 70 and the crown portion 72 (e.g., the surface area of the second polymeric sheet 46 at the protruding shape 43 of the cushioning component 40E). A larger aperture 62 will decrease the surface area of the protruding shape 43. The ratio of the area of interface of the projection 58 to the surface area of the protruding shape 43 of the cushioning component 40E partly determines how much of the protruding shape 43 will invert upon application of the compressive load of at least the predetermined magnitude (e.g., determines what part of and how much of the surface area of the protruding shape 43 will be the crown portion 72) and thus what portion of the compression profile of the sole structure 12 will proceed with a linear rate of compression.

The ratio of the area of interface of a specific projection 58 to the surface area of the protruding shape 43 of the cushioning component 40 with which the specific projection 58 interacts during compressive loading may vary in at least one of the forefoot region 26, the midfoot region 28, or the heel region 30 of the sole structure 12. It is apparent in FIG. 1 that this ratio of the area of interface of a specific projection 58 to the surface area of the protruding shape 43 of the cushioning component 40 with which the specific projection 58 interfaces varies in each of the forefoot region 26, the midfoot region 28, and the heel region 30 based on the differently sized protruding dome shapes 43 (e.g., protruding shapes 43 having different widths) and the projections 58 having different heights and/or widths, as discussed above. It is also apparent that this ratio of the area of interface of a specific projection 58 to the surface area of the protruding shape 43 of the cushioning component 40 with which the specific projection 58 interfaces varies between one of the forefoot region 26, the midfoot region 28, or the heel region 30 and at least one different one of the forefoot region 26, the midfoot region 28, or the heel region 30. In fact, the ratio of the area of interface of a specific projection 58 to the surface area of the protruding shape 43 of the cushioning component 40 with which the specific projection 58 interfaces varies between each of the forefoot region 26, the midfoot region 28, and the heel region 30 and also varies in each different one of the forefoot region 26, the midfoot region 28, or the heel region 30 in the embodiment shown, based on FIG. 1.

Figure 7:
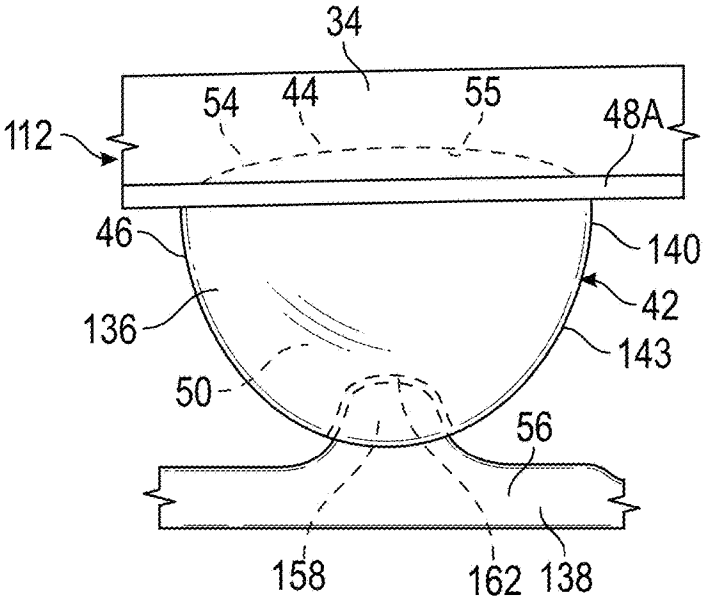
FIG. 7 is a fragmentary side view of a portion of an alternative sole structure for the article of footwear of FIG. 1 in an unloaded state.

FIG. 7 is a fragmentary side view of a portion of an alternative sole structure 112 for the article of footwear 10 of FIG. 1 in an unloaded state. The sole structure 112 includes the first layer 34 of FIG. 1, a second layer 136 that extends in each of the forefoot region 26, midfoot region 28, and heel region 30 like the sole structure 12, and has a plurality of cushioning components 140 configured like cushioning components 40 except that, instead of an aperture 62, each of the cushioning components 140 (one shown in FIG. 7) has a recess 162 in the outer surface 42 of the protruding shape 43, as best shown in FIG. 11. The recess 162 may be molded into the protruding shape 43 of the cushioning component 140. In the cross-sectional view of FIG. 11, approximately one half of the recess 162 is shown, and the recess 162 is a bowl-shaped cavity. In FIG. 7, the additional protruding shape 54 of the first polymeric sheet 44 is indicated with a hidden line where it fits into the recess 55 at the lower side of the first layer 34.

The sole structure 112 includes a sole component 138 similar to sole component 38 and formed from any of the materials described with respect to the sole component 38. The sole component 138 includes the base 56 as described with respect to the sole structure 12. In place of the projections 58, the sole component 138 includes a plurality of projections 158 (one shown in FIG. 7) each of which extends toward and is disposed relative to the protruding shape 43 of the outer surface 42 of a respective one of the multiple cushioning components 140. In implementations in which the second layer 136 includes only one cushioning component 140 and therefore only one protruding shape 43, the sole component 138 only includes one corresponding projection 158.

Figure 10:
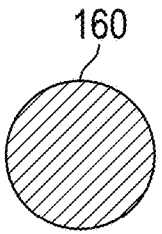
FIG. 10 is a cross-sectional view of a projection of the sole component of FIG. 9 taken at lines 10-10 in FIG. 9.
Figure 9:
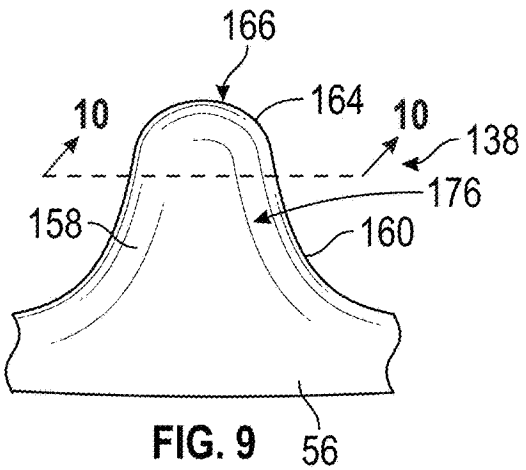
FIG. 9 is a fragmentary side view of a sole component included in the sole structure of FIGS. 7-8.

Each projection 158 has the stem 160 like stem 60 as described with respect to the projection 58 but, instead of an enlarged head 64, the stem 160 has an end 164 with a convex outer surface 166 that interfaces with the recess 162. Stated differently, the end 164 fits within the recess 162 and the convex outer surface 166 of the end 164 fits against the outer surface 42 of the protruding shape 43 at the recess 162. The stem 160 tapers in width from the base 56 to the end 164 as shown in FIG. 9. The stem 160 is circular in cross-section, as shown in FIG. 10, but could have other shapes.

In an implementation with multiple cushioning components 140, there are multiple corresponding projections 158 each paired with one of the cushioning components such that a respective protruding shape 43 compresses around and is made to at least partially invert by a respective projection 158 of the sole component 138 when the sole structure 112 is under a compressive load of at least a predetermined magnitude at that cushioning component 140 (also referred to herein as a threshold compressive load), such as shown in FIG. 8 with the downward load F1 distributed on the first layer 34 by the weight of the wearer during impact with the ground plane G and the reaction load F2 of the same magnitude as the downward load F1 resulting from the ground plane G acting on the ground contact surface 24. The cushioning component 140 resiliently deforms, with the projection 158 interfacing with the protruding shape 43 and at least partially inverting the protruding shape 43 as shown in FIG. 8 as the outer surface 42 compresses around the projection 158 and, eventually compressing against the base 56. The inverted portion of the outer surface 42 reverts back to the protruding shape 43 as the cushioning component 140 is unloaded (e.g., the magnitude of the compressive load lessens). In some implementations discussed herein, a resilient member, such as a resilient foam member or a bladder, may be disposed within the chamber of the protruding shape to assist with the inverted portion to revert back to the protruding shape when the compressive load is removed.

As configured, the protruding shape 43 has a base portion 70 subjected to hoop tensile forces and a crown portion 72 subjected to hoop compressive forces under compressive loading as described with respect to the cushioning component 40. As compressive loading progresses, the outer surface 42 of the cushioning component 140 interfaces with the widening stem 160 of the projection 158 as it nears the base 56. The compression profile of the sole structure 112 at the cushioning component 140 may include a constant stiffness (e.g., a linear rate of change of load to displacement) during an initial stage of compression, a slight drop in stiffness when the protruding shape 43 inverts around the projection 158, and then a non-linear stiffness, such as an exponentially increasing rate of change of load to displacement in compression as the outer surface 42 of the cushioning component 140 "bottoms out" against the base 56 of the sole component 138.

As shown in FIG. 8, the protruding shape 43 of the outer surface 42 of the cushioning component 140 partially inverts under the compressive load F1 with the outer surface 42 surrounding the stem 160 and resting against the surface of stem 160 as well as the surface of the base 56 surrounding the stem 160. The sole structure 112 may be configured so that the end 164 of the projection 158 will bear loading of the first layer 34 (e.g., the fluid-filled chamber 50 sufficiently reduces in height so that the end 164 touches the inner surface of the first polymeric sheet 44 at the additional protruding shape 54 and the load of the first layer 34 is transferred directly to the end 164). Upon removal of the compressive load F1, the inverted portion of the outer surface 42 reverts back to the protruding shape 43.

The relative geometry of each cushioning component 140, the specific projection 158, and the base 56 at the specific projection 158 with which the cushioning component 140 interacts during compressive loading affects the compression profile of the sole structure 112. For example, each projection 58 has a projection width at the outer surface 42 of the respective one of the cushioning components 140 toward which the projection 158 extends. The projection width varies as the stem 160 tapers from a wider projection width at the base 56 to the projection width at the end 164. Each protruding shape 43 has a protruding dome width as described with respect to the embodiment of FIG. 6.

Like the sole structure 12, a ratio of the projection width of a projection 158 to the protruding dome width may vary in at least one of the forefoot region 26, the midfoot region 28, or the heel region 30 of the sole structure 112. Like the sole structure 12, the ratio of the projection width to the protruding dome width of the projections 158 and the cushioning components 140 of the sole structure 112 may vary between one of the forefoot region 26, the midfoot region 28, or the heel region 30 and at least one different one of the forefoot region 26, the midfoot region 28, or the heel region 30. Moreover, the volume and/or width and/or height of the projections 158 may vary in any of or between any of the forefoot region 26, the midfoot region 28, and the heel region 30.

Each projection 158 has an area of interface with the outer surface 42 of the respective one of the cushioning components 140 toward which the projection 158 extends. For example, as evidenced in FIG. 8, the area of interface of projection 158 is the area of the outer surface 176 of the projection 158 extending entirely around the projection 158, including the area of the convex outer surface 166 of the convex end 164, and extending from the end 164 to the end of the stem 160 at the base 56. Likewise, each protruding shape 43 (as a protruding dome shape) has a protruding dome surface area. For example, the surface area of the protruding shape 43 of the cushioning component 140 in FIG. 11 is the area of the outer surface 42 of the cushioning component 140, including the base portion 70 and the crown portion 72. The area of the crown portion 72 includes surface area of the concave recess 162. The ratio of the area of interface of the projection 158 to the surface area of the protruding shape 43 of the cushioning component 140 partly determines how much of the protruding shape 43 will invert upon application of the compressive load of at least the predetermined magnitude (e.g., determines what part of and how much of the surface area of the protruding shape 43 will be the crown portion 72) and thus what portion of the compression profile of the sole structure 112 will proceed with a linear rate of compression.

The ratio of the area of interface of a specific projection 158 to the surface area of the protruding shape 43 of the cushioning component 140 with which the specific projection 158 interacts during compressive loading may vary in at least one of the forefoot region 26, the midfoot region 28, or the heel region 30 of the sole structure 12, and may vary in each of the forefoot region 26, the midfoot region 28, and the heel region 30 based on differently sized protruding shapes 43 and the projections 158 having different heights and/or widths, as discussed above with respect to the corresponding components of the sole structure 12. The ratio of the area of interface of a specific projection 158 to the surface area of the protruding shape 43 of the cushioning component 140 with which the specific projection 158 interfaces may vary between one of the forefoot region 26, the midfoot region 28, or the heel region 30 and at least one different one of the forefoot region 26, the midfoot region 28, or the heel region 30, may vary between each of the forefoot region 26, the midfoot region 28, and the heel region 30, and may vary in each different one of the forefoot region 26, the midfoot region 28, or the heel region 30 similar to the sole structure 12 described with respect to FIG. 1.

An example method of manufacturing a sole structure is described with respect to the sole structure 12 and the sole structure 112. The method includes providing a sole layer 36 or 136 including a cushioning component 40 or 140 having an outer surface 42 and at least partially defining a fluid-filled chamber 50 at least partially surrounded by the outer surface 42. At least a portion of the outer surface 42 has a protruding shape 43 or 143 in the absence of at least a compressive load of at least a predetermined magnitude on the cushioning component 40 or 140. The method includes positioning a sole component 38 or 138 so that a projection 58 or 158 of the sole component 38 or 138 extends toward the outer surface 42 of the cushioning component 40 or 140 and either extends through an aperture 62 in the outer surface 42 of the cushioning component 40 and within the fluid-filled chamber 50 or interfaces with a recess 162 in the outer surface 42 of the cushioning component 140.

The method further includes securing the projection 58 or 158 to the cushioning component 40 or 140. Securing the projection 58 or 158 to the cushioning component 40 or 140 may include heating the projection 58 or 158. For example, heating the projection 58 may expand foam material of the projection 58 to bond the projection 58 to the cushioning component 40 within the fluid-filled chamber 50 and seal the aperture 62. The method may further include pressurizing the fluid-filled chamber 50 with gas or air. Additionally, the method may include bonding a first polymeric sheet 44 to a second polymeric sheet 46 to define the fluid-filled chamber 50 and the protruding shape 43 or 143.

Figure 13:
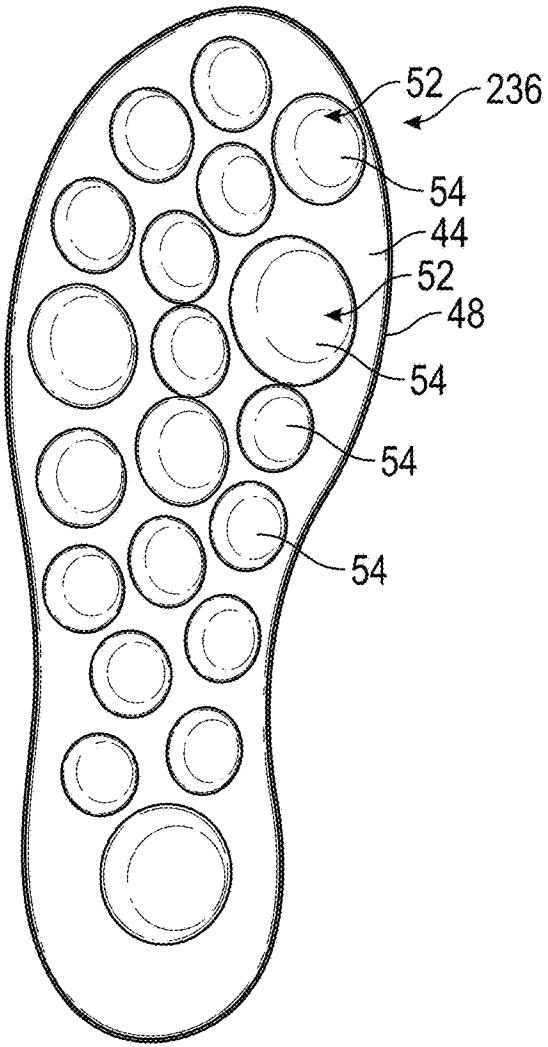
FIG. 13 is a top perspective view of the sole layer of FIG. 12.

FIG. 12 is a bottom perspective view of an alternative sole layer 236 including multiple cushioning components 40 for use in a sole structure of an article of footwear. FIG. 13 is a top perspective view of the sole layer 236. The sole layer 236 is formed by the second polymeric sheet 46 described herein defining the protruding shapes 43 with apertures 62, only some of which are labelled in FIG. 12. The sole layer 236 is also formed by the first polymeric sheet 44 defining the additional shapes 54 as shown in FIG. 13, only some of which are labelled.

The number, placement, and size of the protruding shapes 43 and additional protruding shapes 54 may be different than those of the sole layer 36 of FIG. 1. Only some of the cushioning components 40 and apertures 62 are indicated with reference numbers in FIG. 12 for clarity in the drawing, but it is apparent that the cushioning components 40 extend in each of the forefoot region 26, the midfoot region 28, and the heel region 30, and vary in size, such as in width, between one of the forefoot region 26, the midfoot region 28, and the heel region 30 and at least one different one of the forefoot region 26, the midfoot region 28, and the heel region 30. In fact, the cushioning components 40 vary in size between each of the forefoot region 26, the midfoot region 28, and the heel region 30 and also vary in size within each of the forefoot region 26, the midfoot region 28, and the heel region 30 (e.g., the forefoot region 26 includes cushioning components 40 of different sizes, the midfoot region 28 includes cushioning components 40 of different sizes, and the heel region 30 includes cushioning components 40 of different sizes). As shown, the largest protruding shapes 43 are disposed to align with the calcaneus bone in the heel region 30 (see protruding shape 43A of cushioning component 40A), functioning as a "crash pad" during a heel strike (heel landing), to align with the metatarsal joints in the forefoot region 26 (see protruding shapes 43B and 43C of cushioning components 40B and 40C, respectively), and to align with the big toe in the forefoot region 26 (see protruding shape 43D of cushioning component 40D).

The second polymeric sheet 46 also forms ribs 48C extending between some of the adjacent protruding shapes 43 to add support to the protruding shapes 43 by discouraging side-to-side tilting during compression and thereby encouraging compression of each protruding shape 43 along a respective center axis of each dome shape 43. The ribs 48C are formed by the material of the second polymeric sheet 46, such as by molding the second polymeric sheet 46 or otherwise.

As shown, the fluid-filled chambers 50 of the cushioning components 40 of the sole layer 236 are fluidly isolated from one another when a sole layer having projections 58 with enlarged heads 64 extending through the apertures 62 (like the sole component 38), is used with the sole layer 236. For example, the sole layer 236 may be used in place of sole layer 36 in the article of footwear 10 of FIG. 1, and may overlie the sole component 38 when worn on a foot and disposed between the foot and the ground plane G.

Figure 15:
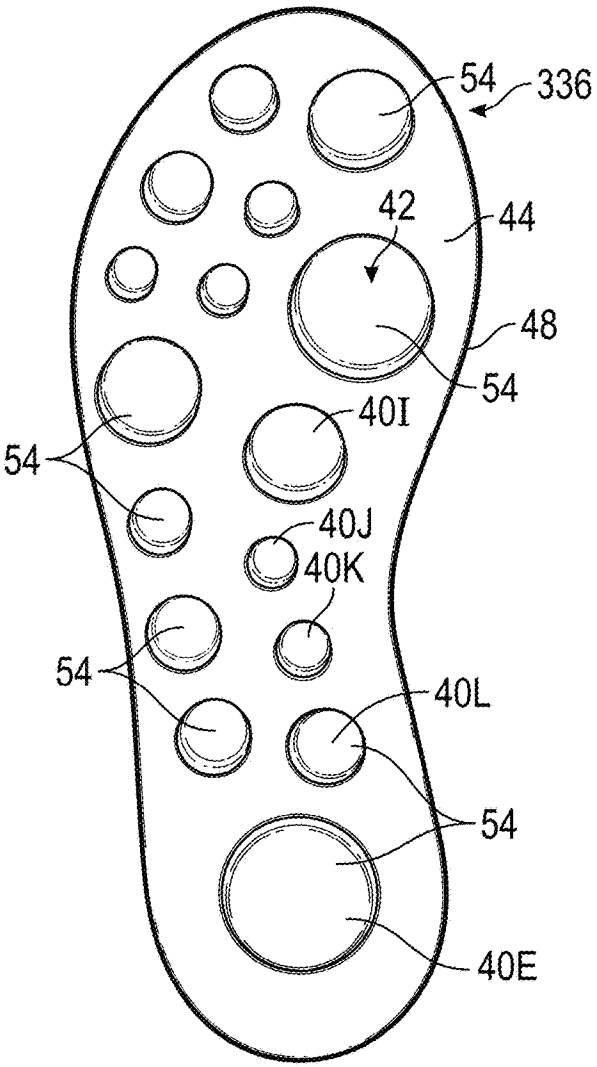
FIG. 15 is a top perspective view of the sole layer of FIG. 14.

FIG. 14 is a bottom perspective view of an alternative sole layer 336 including multiple cushioning components 40 for use in a sole structure of an article of footwear. FIG. 15 is a top perspective view of the sole layer 336. The sole layer 336 is formed by the second polymeric sheet 46 described herein defining the protruding shapes 43 with apertures 62, only some of which are labelled in FIG. 14. The sole layer 336 is also formed by the first polymeric sheet 44 defining the additional protruding shapes 54 as shown in FIG. 15, only some of which are labelled.

The fluid-filled chambers 50 of the sole layer 336 are each sealed when a sole layer having projections 58 with enlarged heads 64 extending through the apertures 62, like the sole component 38, is used with the sole layer 336. For example, the sole layer 336 may be used in place of sole layer 36 in the article of footwear 10 of FIG. 1, and may overlie the sole component 38 when worn on a foot and disposed between the foot and the ground plane G. Although each of the fluid-filled chambers 50 are sealed by the enlarged heads 64 in such an embodiment, at least some of the fluid-filled chambers 50 may be in fluid communication with one another via channels 48D as described herein.

The number, placement, and size of the protruding shapes 43 and additional protruding shapes 54 may be different than those of the sole layer 36 of FIG. 1. Only some of the cushioning components 40 and apertures 62 are indicated with reference numbers in FIG. 14 for clarity in the drawing, but it is apparent that the cushioning components 40 extend in each of the forefoot region 26, the midfoot region 28, and the heel region 30, and vary in size, such as in width, between one of the forefoot region 26, the midfoot region 28, and the heel region 30 and at least one different one of the forefoot region 26, the midfoot region 28, and the heel region 30. In fact, the cushioning components 40 vary in size between each of the forefoot region 26, the midfoot region 28, and the heel region 30 and also vary in size within each of the forefoot region 26, the midfoot region 28, and the heel region 30 (e.g., the forefoot region 26 includes cushioning components 40 of different sizes, the midfoot region 28 includes cushioning components 40 of different sizes, and the heel region 30 includes cushioning components 40 of different sizes). As shown, the largest protruding shapes 43 are disposed to align with the calcaneus bone in the heel region 30 (see protruding shape 43E of cushioning component 40E), functioning as a "crash pad", to align with the metatarsal joints in the forefoot region 26 (see protruding shapes 43F and 43G of cushioning components 40F and 40G, respectively), and to align with the big toe in the forefoot region 26 (see protruding shape 43H of cushioning component 40H).

The second polymeric sheet 46 also forms channels 48D extending between and connecting some of the cushioning components 40 to provide fluid communication between the fluid-filled chambers 50. The connected protruding shapes 43 may be adjacent protruding shapes 43, as shown in FIG. 14. Additionally, channels could connect protruding shapes 43 that are not adjacent one another. The channels 48D are formed by the material of the second polymeric sheet 46, such as by molding the second polymeric sheet 46 or otherwise. Alternatively or in addition, the additional protruding shapes 54 could be connected by channels formed in the first polymeric sheet 44 to provide fluid communication between the fluid-filled chambers 50.

The channels 48D enable fluid to move from one fluid-filled chamber 50 to a connected fluid-filled chamber 50 through the channel 48D connecting them. For example, during compressive loading, some of the fluid in one of the fluid-filled chambers 50 may be pushed out of the fluid-filled chamber 50 into the connected fluid-filled chamber 50. This increases the compressive stiffness of the cushioning component 40 to which the fluid was pushed. The fluid-filled chambers 50 connected by the channels 48D may track the loading pattern of a typical heel strike and forward roll of a foot. This allows the fluid in the interconnected fluid-filled chambers 50 to displace forward in correspondence with the forward progression of foot loading, providing a relatively stiffer fluid-filled chambers 50 in forward ones of the interconnected cushioning components 40. The loading pattern of the foot roll can push some of the fluid (e.g., gas or air) in the interconnected fluid-filled chambers 50 from the heel toward the midfoot, allowing the pressure at the heel cushioning component 40E at impact to be lower than the loaded pressure of the midfoot cushioning component 40J, for example, enabling a softer heel landing. As shown, the protruding shapes 43 of some of the cushioning components 40 are connected by the channels 48D.

As shown, the fluid-filled chambers 50 of the cushioning components 40F and 40I are in fluid communication by one of the channels 48D, the cushioning components 40I and 40J are in fluid communication by another one of the channels 48D, cushioning components 40J and 40K are in fluid communication by yet another one of the channels 48D, cushioning components 40K and 40L are in fluid communication by still another one of the channels 48D, and cushioning components 40L and 40E are in fluid communication by a final one of the channels 48D. As a result, the fluid-filled chambers 50 of each of the cushioning components 40F, 40I, 40J, 40K, 40L, and 40E are in fluid communication.

Figure 16:
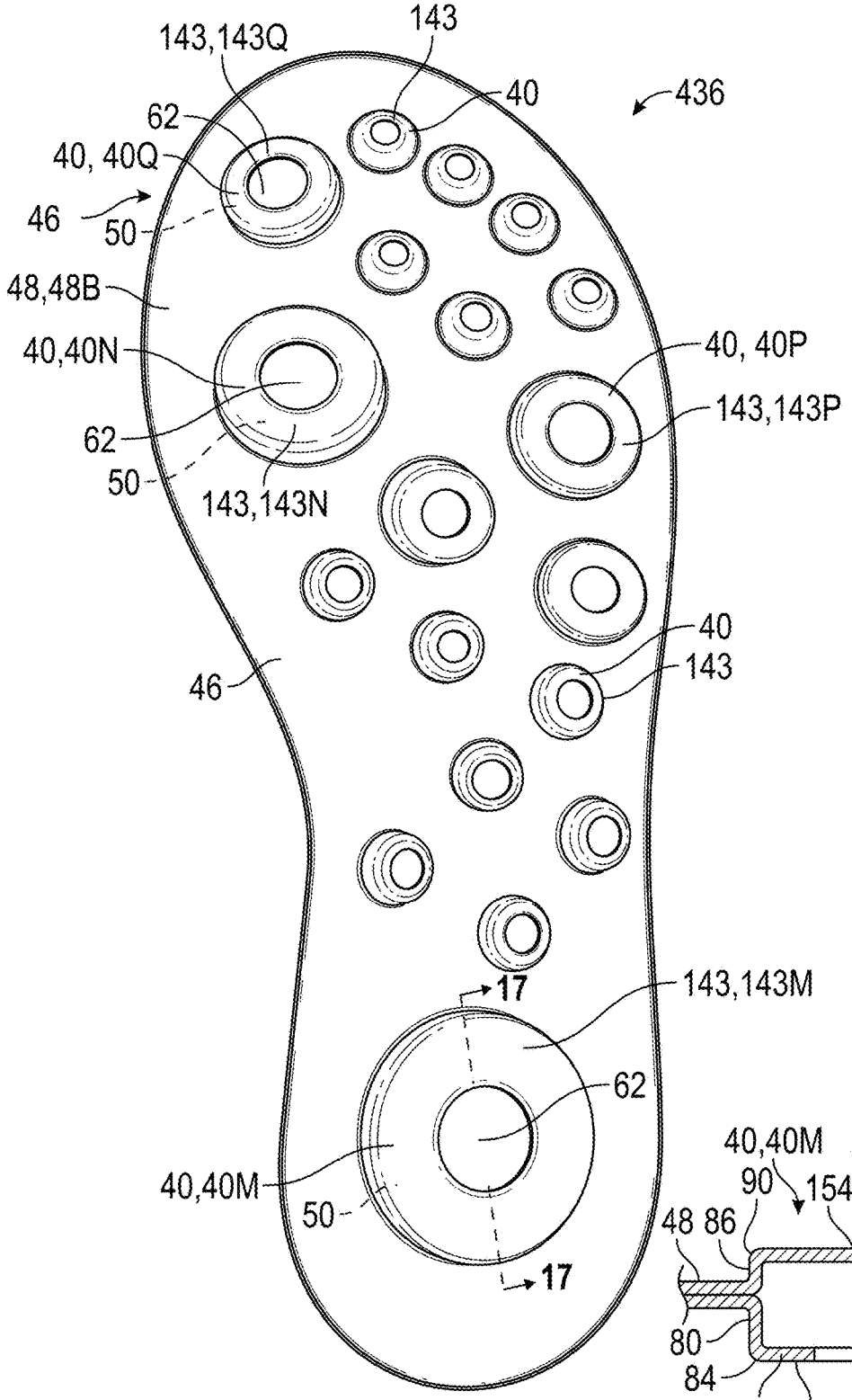
FIG. 16 is a bottom perspective view of another alternative sole layer including multiple cushioning components for use in a sole structure of an article of footwear.
Figure 17:
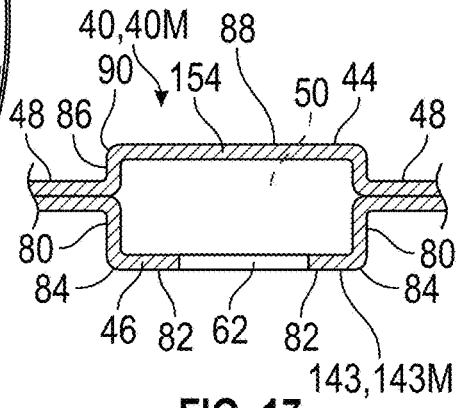
FIG. 17 is a fragmentary cross-sectional view of the sole layer of FIG. 16 taken at lines 17-17 in FIG. 16.

FIG. 16 is a bottom perspective view of an alternative sole layer 436 including multiple cushioning components 40 for use in a sole structure of an article of footwear. The sole layer 436 is formed by the second polymeric sheet 46 described herein defining protruding shapes 143 (also referred to herein as first protruding shapes or first protruding dome shapes) with apertures 62, only some of which are labelled in FIG. 16. The sole layer 436 is also formed by the first polymeric sheet 44 defining additional protruding shapes 154 (also referred to herein as second protruding shapes or second protruding dome shapes), one of which is shown in FIG. 17. The protruding shapes 143 and additional protruding shapes 154 of at least some of the cushioning components 40 of the alternative sole layer 436 have a less rounded shape than those shown in the sole layer 36. Stated differently, the protruding shape 143 defines a side wall 80 and a bottom wall 82 with a corner 84 therebetween. Similarly, the protruding shape 154 has a side wall 86, a top wall 88, and a corner 90 therebetween. The protruding shapes 143 and the additional protruding shapes 154 are thus more cylindrical than the protruding shapes 43 and the additional protruding shapes 54 of the sole layer 36. As defined herein, the protruding shapes 143 may still be referred to as protruding dome shapes. This less-rounded construction may cause either a lesser portion or a greater portion of the protruding shape 143 to invert under compressive loading than the protruding shape 43 depending upon the relative heights and width of the protruding shape 143 as well as the thickness of the polymeric sheet 46. Additionally, the less-rounded construction including the bottom wall 82 may provide greater stability against any side-to-side tipping under compression even without any ribs such as ribs 48C of FIG. 12.

Similar to the sole layer 336, the fluid-filled chambers 50 of the sole layer 436 are each sealed when a sole layer having projections 58 with enlarged heads 64 extending through the apertures 62, like the sole component 38, is used with the sole layer 436. For example, the sole layer 436 may be used in place of sole layer 36 in the article of footwear 10 of FIG. 1, and may overlie the sole component 38 when worn on a foot and disposed between the foot and the ground plane G. The fluid-filled chambers 50 are shown each in isolation from each other (e.g., not in fluid-communication). However, in an alternative embodiment, at least some of the fluid-filled chambers 50 may be in fluid communication with one another via channels 48D as described herein.

The number, placement, and size of the protruding shapes 143 and additional protruding shapes 154 may be different than those of the sole layer 36 of FIG. 1. Only some of the cushioning components 40 and apertures 62 are indicated with reference numbers in FIG. 16 for clarity in the drawing, but it is apparent that the cushioning components 40 extend in each of the forefoot region 26, the midfoot region 28, and the heel region 30, and vary in size, such as in width, between one of the forefoot region 26, the midfoot region 28, and the heel region 30 and at least one different one of the forefoot region 26, the midfoot region 28, and the heel region 30. In fact, the cushioning components 40 vary in size between each of the forefoot region 26, the midfoot region 28, and the heel region 30 and also vary in size within each of the forefoot region 26, the midfoot region 28, and the heel region 30 (e.g., the forefoot region 26 includes cushioning components 40 of different sizes, the midfoot region 28 includes cushioning components 40 of different sizes, and the heel region 30 includes cushioning components 40 of different sizes). As shown, the largest protruding shapes 143 are disposed to align with the calcaneus bone in the heel region 30 (see protruding shape 143M of cushioning component 40M), functioning as a "crash pad", to align with the metatarsal joint in the forefoot region 26 (see protruding shapes 143N and 143P of cushioning components 40N and 40P, respectively), and with the big toe in the forefoot region 26 (see protruding dome shape 143Q of cushioning component 40Q).

Figure 18:
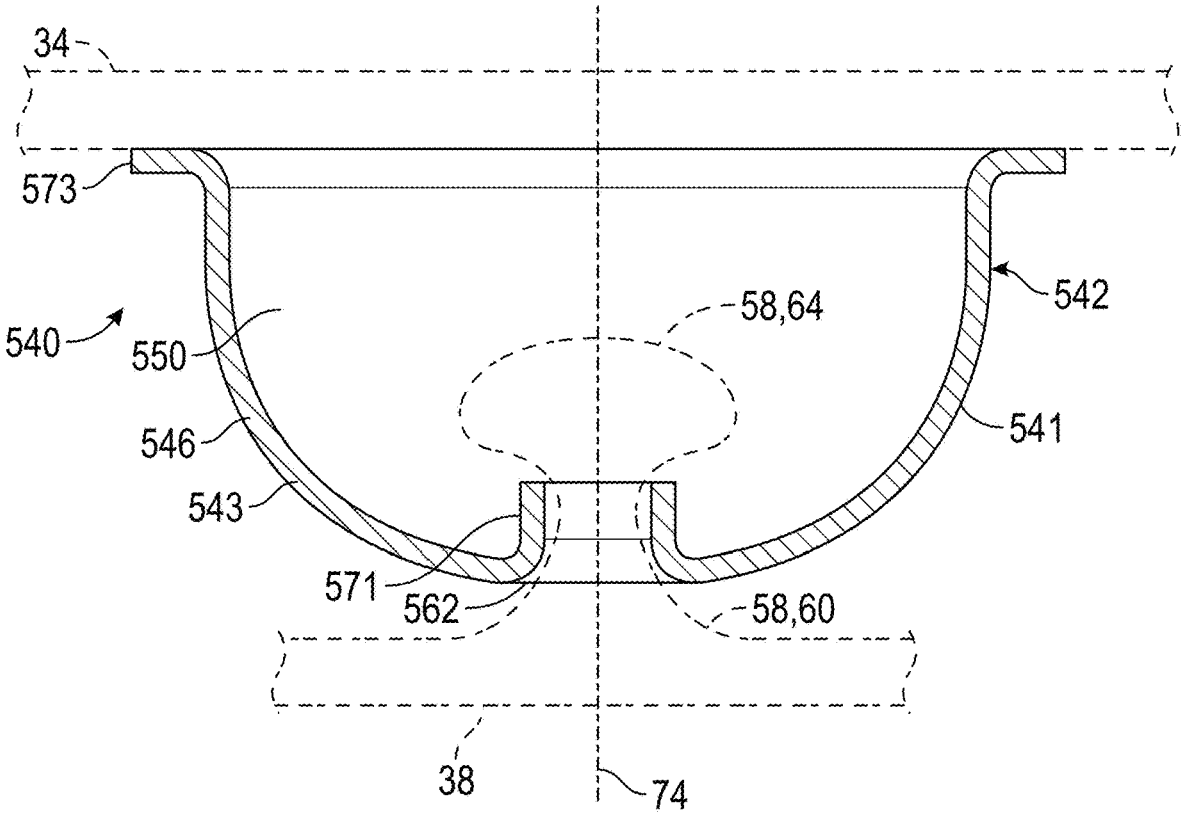
FIG. 18 is a cross-sectional view of an example of a cushioning component having a lip and showing a sole layer and a sole component in phantom.
Figure 19:
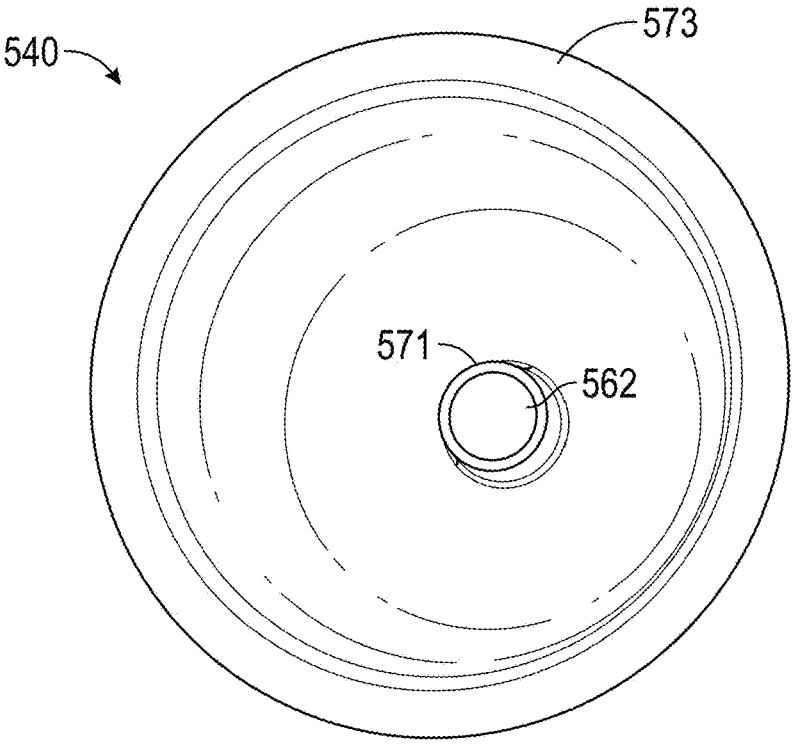
FIG. 19 is a perspective view of the cushioning component of FIG. 18.

FIG. 18 is a cross-sectional view of an example of a cushioning component 540 having a lip 571. The sole layers 34 and 38 described with respect to FIG. 2 are shown in phantom positioned relative to the cushioning component 540, except that the sole layer 34 may include but need not include the recess 55 when used with the cushioning component 540. FIG. 19 is a perspective view of the cushioning component 540 of FIG. 18. The cushioning component 540 is similar to cushioning component 40 described herein and includes a sheet 546 that defines a body 541 with an outer surface 542 having a protruding shape 543, that is shown as a protruding dome shape but is not limited to a dome shape. The sheet 546 at least partially surrounds a chamber 550 and is configured to have the protruding shape 543 in the absence of a compressive load of at least a predetermined magnitude. The cushioning component 540 may function similarly to the cushioning component 40 or any of the other cushioning components described herein. For example, the cushioning component 540 may at least partially invert when under a compressive load of at least the predetermined magnitude, and may be configured to revert back to the protruding shape 543 when the compressive load is removed. In the example shown, the sheet 546 has a perimeter flange 573 that may be secured to a sole layer, such as the sole layer 34. In other words, the cushioning component 540 may be a single sheet, without being bonded to a second sheet such as sheet 44 of FIG. 2.

The lip 571 surrounds an aperture 562 in the outer surface 542 that extends through the sheet 546 at the chamber 550. In the embodiment shown, the lip 571 extends inward into the chamber 550. Alternatively or in addition, the lip 571 could extend outward, away from the chamber 550, or both inward into the chamber 550 and outward away from the chamber 550. The lip 571 is shown extending generally coaxial with a longitudinal axis 74 (also referred to herein as the center axis) of the cushioning component 540. During a compression cycle, stress on the protruding shape 543 may tend to be concentrated at the aperture 562. The lip 571 may tend to reinforce the aperture 562, thereby mitigating stress at the aperture 562 during compression of the cushioning component 540. Additionally, the lip 571 may act as a guide for the projection 58 during manufacturing and/or during wear as the projection 58 moves relative to the protruding shape 543 through the aperture 562 and/or as the protruding shape 543 moves along the stem 60 as it partially inverts and returns to an uncompressed shape.

Figure 20:
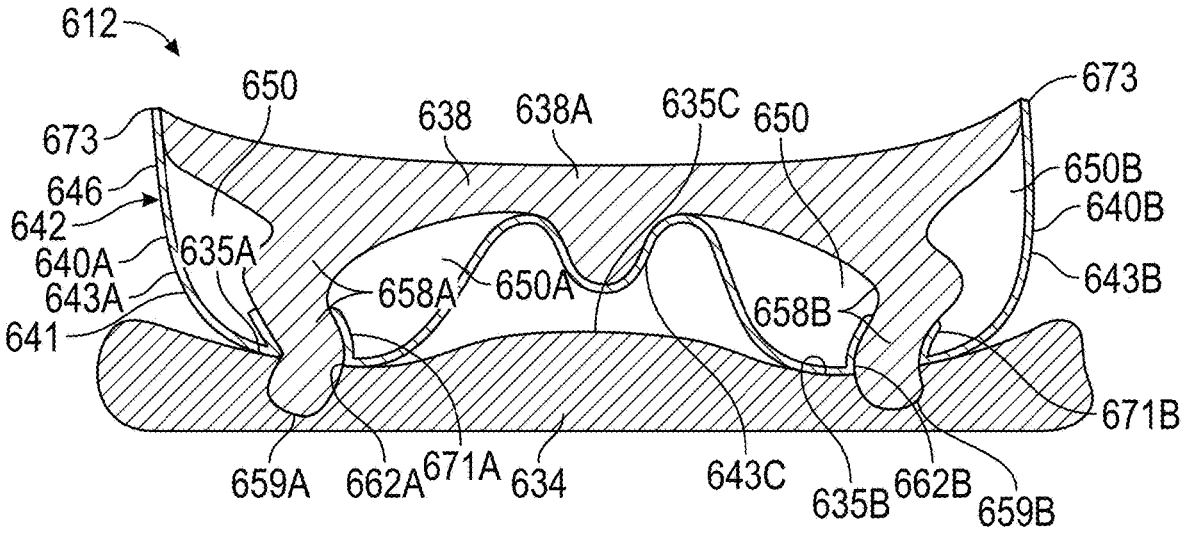
FIG. 20 is a cross-sectional view of an example of a sole structure including multiple cushioning components, a sole component configured as a first sole layer having multiple projections that extend through apertures in the cushioning components, and a second sole layer to which the projections are secured.

FIG. 20 is a cross-sectional view of an example of a sole structure 612 that includes a single sheet 646 that integrally forms multiple cushioning components 640A and 640B. While only two of the multiple cushioning components are shown at the cross-section of FIG. 20, the single sheet 646 may extend through all or part of the forefoot region, midfoot region, and heel region of an article of footwear, such as the sheet 46 of FIG. 6, and may form and define additional cushioning components.

The cushioning components 640A and 640B described herein include the sheet 646 that defines a body 641 with an outer surface 642 defining multiple protruding shapes 643A and 643B, respectively. An additional protruding shape 643C is also defined by the body 641 and the outer surface 642. The cushioning components 640A and 640B function similarly as described with respect to cushioning component 40 or any of the other cushioning components described herein. The protruding shapes 643A, 643B, 643C are shown as protruding dome shapes but are not limited to dome shapes. The protruding shapes 643A and 643B are shown in the absence of a compressive load of at least a predetermined magnitude, and at least partially invert under at least such a compressive load, and may be configured to revert back to the protruding shapes 643A, 643B shown when the compressive load is removed.

The sheet 646 at least partially surrounds a chamber 650. The chamber 650 is common to all of the cushioning components 640A and 640B, but may become subdivided by placement of a sole component therein, referred to as sole layer 638 or first sole layer 638, as described. For example, the cushioning component 640A defines a sub-chamber 650A and the cushioning component 640B defines a sub-chamber 650B.

In the example shown, an outer perimeter 673 of the sheet 646 is secured to the sole layer 638. There is no additional sheet included in either sole component 640A or 640B, such as no sheet 44 of FIG. 2 used to close the chamber 650. The outer perimeter 673 may be nonplanar (e.g., may have different heights at different cross-sections of the sole structure 612) in order to follow the sides of the first sole layer 638, for example.

The first sole layer 638 may be a resilient foam, and includes multiple projections 658A and 658B that are integral extensions of the first sole layer 638, each projection paired with one of the cushioning components 640A, 640B. For example, the first sole layer 638 includes a base portion 638A and projections 658A and 658B extend through the respective apertures 662A and 662B in the cushioning components 640A and 640B. The base portion 638A fills the chamber 650 at the protruding shape 643C in the example shown. Each of the cushioning components 640A and 640B also includes a lip 671A and 671B around the respective apertures 662A and 662B, similar to lip 571.

Each projection 658A and 658B is nonlinear along its longitudinal axis, bowing first laterally outward and then laterally inward from the base portion 638A to a respective terminal end 659A, 659B. The lips 671A and 671B angle laterally outward in correspondence with the projections 658A and 658B, respectively. This configuration helps to influence the collapse of the sole structure 612 under compressive loading.

The sole structure 612 includes a second sole layer 634 disposed such that the cushioning components 640A, 640B are between the first sole layer 638 and the second sole layer 634. The second sole layer 634 may be (but is not limited to) an elastomeric foam material. The second sole layer 634 is formed with slight recesses 635A and 635B in which portions of the respective protruding shapes 643A and 643B nest. The second sole layer 634 also forms a protrusion 635C between the recesses 635A and 635B that may interface with the protruding shape 643C during compressive loading.

The projections 658A and 658B are secured to the second sole layer 634 at their terminal ends 659A and 659B, respectively. For example, the projections 658A, 658B may be adhered, bonded, thermally fused, or otherwise secured to the second sole layer 634. In this manner, the first and second sole layers 638, 634 are integrally connected by the projections 658A and 658B during the entire compressive loading and unloading cycle. The compression profile of the sole structure 612 is therefore influenced by the compression and unloading of the sole layer 638 during the entire duration of compression (inverting and reverting) of the protruding shapes 643A and 643B, may therefore be less staged than otherwise. The protruding shapes 643A and 643B may be considered to extend toward at least the portion of the projections 658A and 658B near the terminal ends 659A and 659B, respectively when the sole structure 612 is incorporated in an article of footwear and worn on a foot with the sole structure 612 positioned between the foot and a ground plane (e.g., with a foot overlying the first sole layer 638 and any components of the sole structure 612 (if any) above the first sole layer 638, and the ground plane underlying the second sole layer 634 and any components of the sole structure 612 (if any) below the second sole layer 634.

Figure 21:
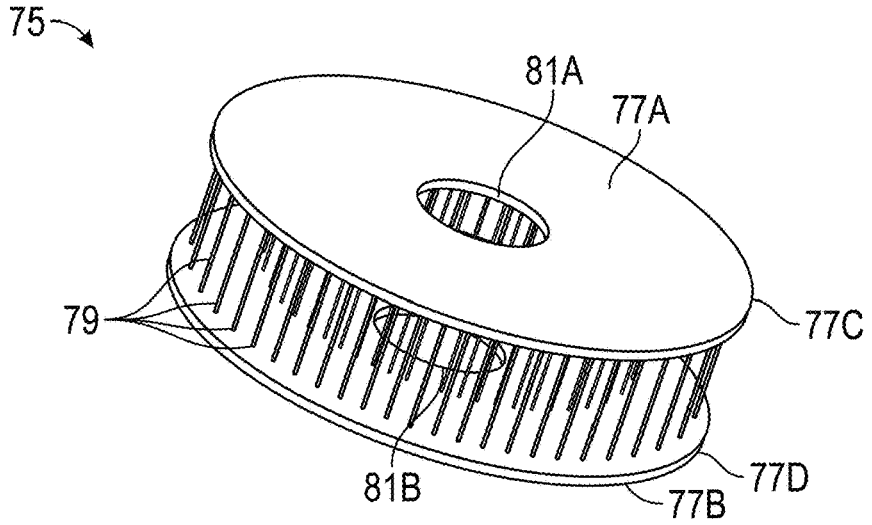
FIG. 21 is a perspective view of a tensile component with an aperture configured as a through hole.
Figure 22:
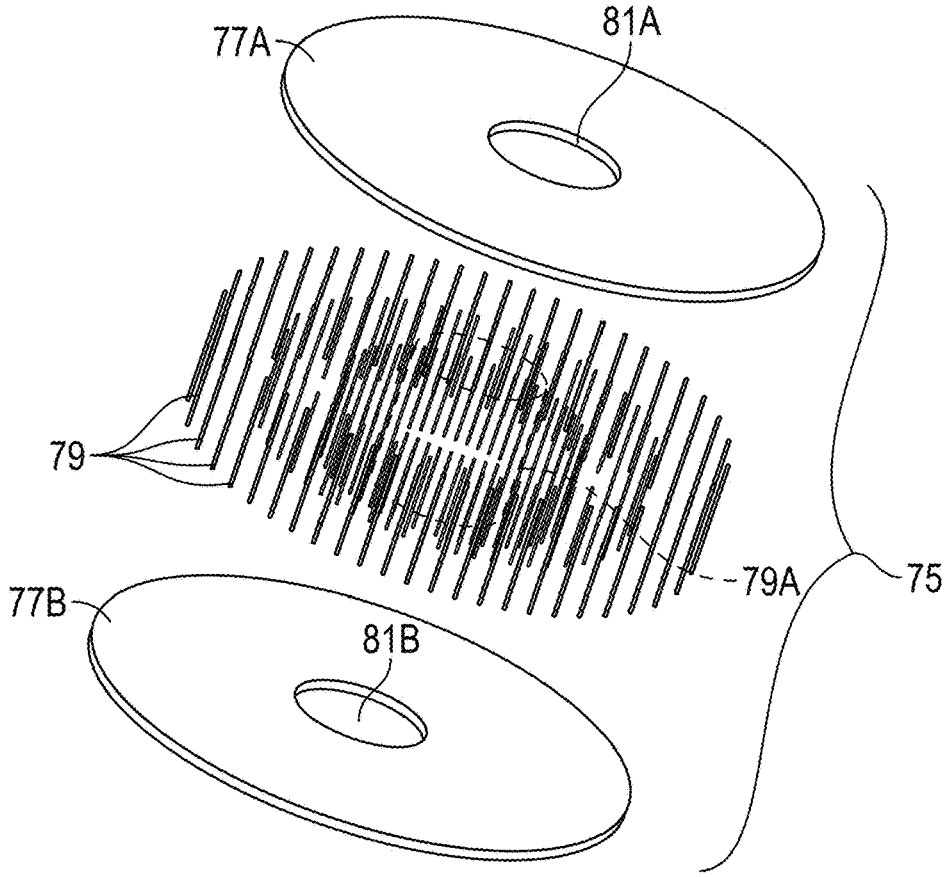
FIG. 22 is an exploded view of the tensile component of FIG. 21.

FIG. 21 is a perspective view of a tensile component 75 that includes a first tensile layer 77A, a second tensile layer 77B, and a plurality of tethers 79 extending between and connecting the first tensile layer 77A to the second tensile layer 77B. FIG. 22 is an exploded view of the tensile component 75. The tensile layers 77A and 77B may be polymeric plates or fabric. As shown, the tensile layers 77A and 77B have outer perimeters 77C and 77D, respectively, that have a like shape, such as a circular shape. The tethers 79 may also be referred to as fabric tensile members or threads and may be in the form of drop threads that connect the first tensile layer 77A and the second tensile layer 77B. The tensile component 75 may be formed as a unitary, one-piece textile element having a spacer-knit textile. As shown in FIGS. 21-22, the first and second tensile layers 77A and 77B each define apertures 81A and 81B, respectively, and the tethers 79 surround the apertures 81A and 81B (as indicated by the cylindrical space 79A in FIG. 22) such that a through hole (formed by apertures 81A, 81B, and cylindrical space 79A) extends through the tensile component 75.

Figure 23:
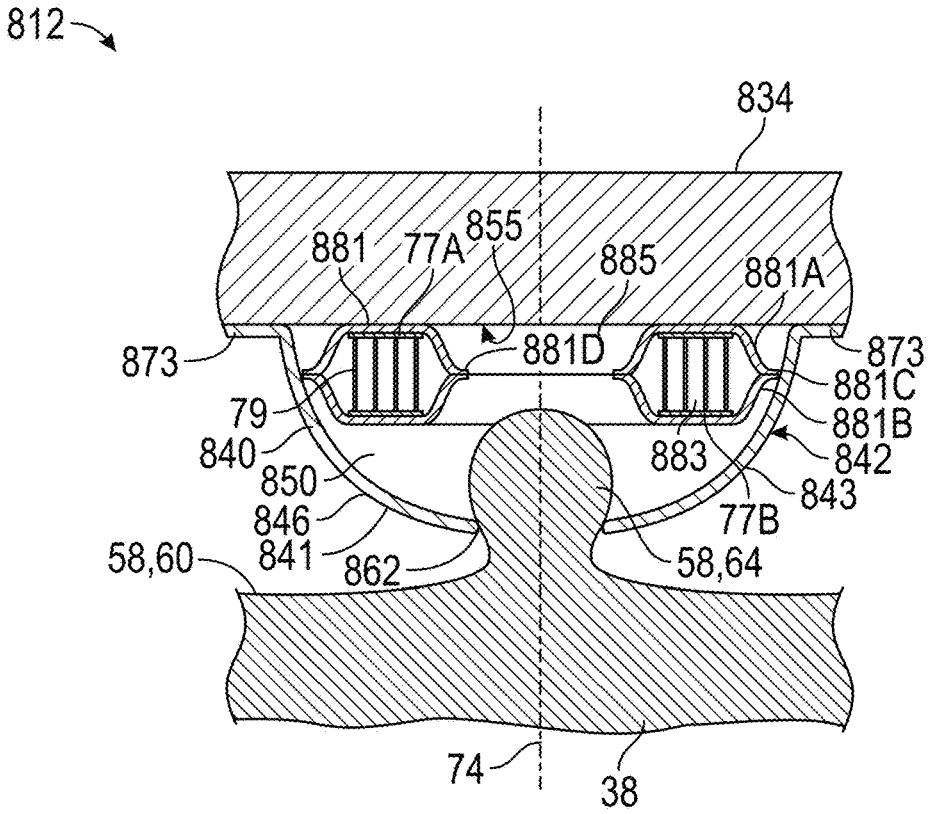
FIG. 23 is a fragmentary cross-sectional view of a portion of a sole structure including a bladder disposed in a chamber of a cushioning component and the tensile component of FIG. 22 disposed within the bladder.

FIG. 23 is a fragmentary cross-sectional view of a portion of a sole structure 812 that includes a sole component 38 as described with respect to FIG. 2, a sole layer 834 similar to sole layer 34 except without a recess 55, and a cushioning component 840 similar to cushioning component 540 except not showing a lip 571 (although a lip could be included). Like reference numbers are used to indicate like components. The cushioning component 840 includes a sheet 846 that defines a body 841 with an outer surface 842 having a protruding shape 843, that is shown as a protruding dome shape but is not limited to a dome shape. The sheet 846 at least partially surrounds a chamber 850 and is configured to have the protruding shape 843 in the absence of a compressive load of at least a predetermined magnitude. The cushioning component 840 may function similarly to the cushioning component 40 or any of the other cushioning components described herein. For example, the cushioning component 840 may at least partially invert when under a compressive load of at least the predetermined magnitude, and may be configured to revert back to the protruding shape 843 when the compressive load is removed. In the example shown, the sheet 846 has a perimeter flange 873 that is secured to the sole layer 834. The cushioning component 840 is shown as a single sheet, without a sheet such as sheet 44 of FIG. 2.

FIG. 23 shows that the sole structure 812 also includes a bladder 881 disposed in the chamber 850. Such a bladder may be referred to as an "internal" bladder as it is disposed within the chamber 850 of the cushioning component 840. The bladder 881 defines an interior cavity 883 and is configured to retain a fluid in the interior cavity 883. The bladder 881 may be configured from two polymeric sheets 881A and 881B bonded to one another at an outer peripheral flange 881C and an inner peripheral flange 881D to seal the interior cavity 883. The polymeric sheets 881A, 881B may include any of the materials described with respect to the sheets 44 and 46, for example.

The internal bladder 881 is shown with the polymeric sheet 881A secured to the sole layer 834, with the cushioning component 840 positioned between the sole layer 834 and the sole component 38. For example, the polymeric sheet 881A may be bonded to the surface 855 of the sole layer 834 prior to bonding the flange 873 of the cushioning component 840 to the sole layer 834. Alternatively or in addition, the internal bladder 881 could be secured to the inner surface of the cushioning component 840. Stated differently, the internal bladder 881 is secured to at least one of the sole layer 834 or the cushioning component 840.

The bladder 881 defines an aperture 885 inward of the inner peripheral flange 881D such that the bladder 881 has an annular shape (e.g., a donut shape) with the aperture 885 configured as a through hole. The aperture 885 may also be referred to as a second aperture or as a through hole. In the embodiment shown, the peripheral flange 881C extends around the entire outer perimeter of the interior cavity 883 (e.g., outwardly surrounding the interior cavity 883) and the peripheral flange 881D extends around the entire inner perimeter of the interior cavity 883 generally in an X-Y plane of the polymeric bladder 881, where the Z plane is the height of the polymeric bladder 881 shown in FIG. 23.

In the example shown, the tensile component 75 is shown disposed within the interior cavity 883 with the first and second tensile layers 77A and 77B secured to opposing inner surfaces of the respective sheets 881A, 881B. The first tensile layer 77A is bonded to the inner surface of the first polymeric sheet 881A, and the second tensile layer 77B is bonded to the inner surface of the second polymeric sheet 881B. The tethers 79 restrain separation of the first and second polymeric sheets 881A and 881B to the maximum separated positions shown in FIG. 23, which depicts the polymeric bladder 881 with the interior cavity 883 inflated and sealed under a given inflation pressure of gas in the interior cavity 883, so that the polymeric bladder 881 is in an inflated state. The outward force on the first and second polymeric sheets 881A and 881B due to the pressurized gas in the interior cavity 883 places the tethers 79 in tension, and the tethers 79 prevent the tensile layers 77A, 77B and polymeric sheets 881A, 881B from further outward movement away from one another. However, the tethers 79 do not present resistance to compression when under a compressive load.

In the unloaded state of FIG. 23 the aperture 62 in the outer surface of the cushioning component 840 is a first aperture, the bladder 881 defines a second aperture 885, and the projection 58 extends through a first aperture 862 of the cushioning component 840 and into the second aperture 885. Stated differently, the projection 58 extends into the chamber 850 through the aperture 862 in the cushioning component 840 and extends at least partially in the aperture 885 in the bladder 881.

Figure 24:
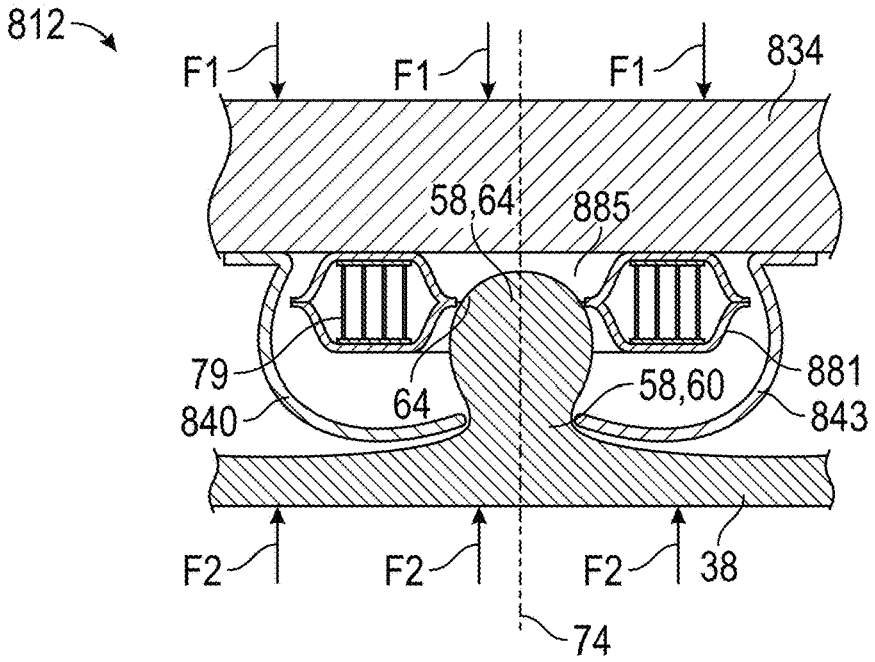
FIG. 24 is a fragmentary cross-sectional view of the portion of the sole structure of FIG. 23 under a compressive load.

FIG. 24 is a fragmentary cross-sectional view of the portion of the sole structure 812 of FIG. 23 under a compressive load F1 with a reaction load F2 as described with respect to FIG. 3, with the compressive load of a sufficient magnitude to cause the protruding dome shape 843 to at least partially invert. The enlarged head 64 moves further into the chamber 850 and into the aperture 885. Under the compressive load F1, the bladder 881 is shown not yet under compression, with the tethers 79 remaining under tension.

Figure 25:
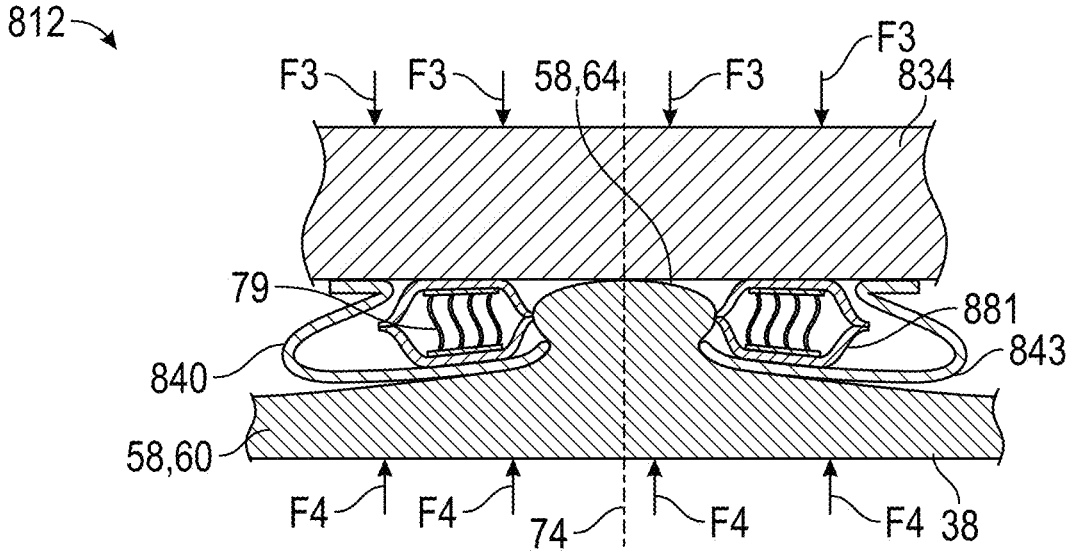
FIG. 25 is a fragmentary cross-sectional view of the portion of the sole structure of FIG. 24 under a compressive load greater than the compressive load of FIG. 24.

FIG. 25 is a fragmentary cross-sectional view of the portion of the sole structure 812 of FIG. 24 under a compressive load F3 (and equal reaction load F4) greater than the compressive load F1 of FIG. 24. The protruding shape 843 may be further inverted and either or both of the sole layer 834 and the sole component 38 may also compress (e.g., decrease in height as shown in FIG. 25) depending on their relative stiffnesses. This may cause pressure in the chamber 850 to increase. Under the compressive load F3, the polymeric sheets 881A and 881B move closer together as the interior cavity 883 reduces in height and the tethers 79 collapse (e.g., go slack).

When the compressive load is removed, the cushioning component 840 reverts back to the unloaded state of FIG. 23, with protruding shape 843 reverting to the shape of FIG. 23, and the internal bladder 881 also returning to the shape shown in FIG. 23, with the tethers 79 again under tension. The cushioning component 840 is urged to revert back to the unloaded state of FIG. 23 due to internal bias of the material of the cushioning component 840 and by any pressure in the chamber 850, if it is pressurized. Pressure in the interior cavity 883 urges the bladder 881 to return to the unloaded state shown in FIG. 23 when the compressive load and reaction load are sufficiently reduced or removed.

Figure 26:
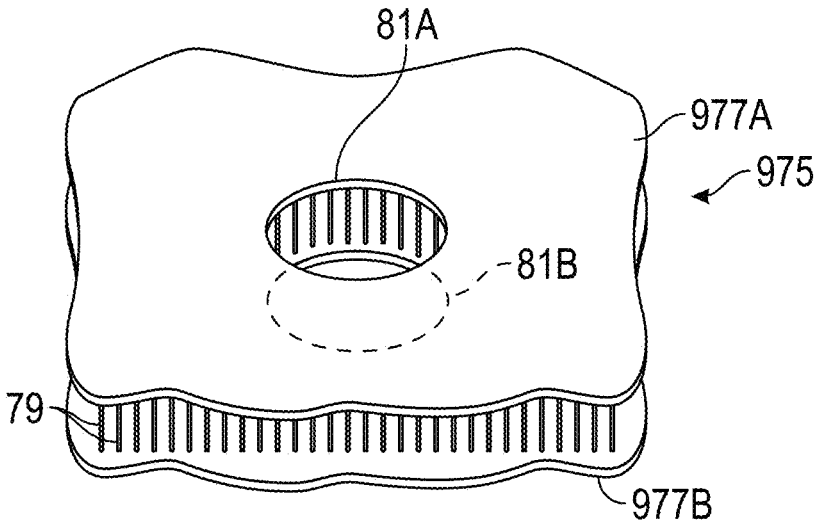
FIG. 26 is a fragmentary perspective view of another tensile component with an aperture configured as a through hole.

FIG. 26 is a fragmentary perspective view of another tensile component 975. The tensile component 975 includes first and second tensile layers 977A and 977B which are the materials as described with respect to tensile layers 77A and 77B, each defining the apertures 81A and 81B, respectively, and secured to one another by tethers 79. The outer perimeters of the tensile layers 977A and 977B are not shown but may be similar to the outer perimeters 77C and 77D, or the tensile layers 977A and 977B may be larger, with multiple similar apertures 81A and 81B as described with respect to FIG. 31.

Figure 27:
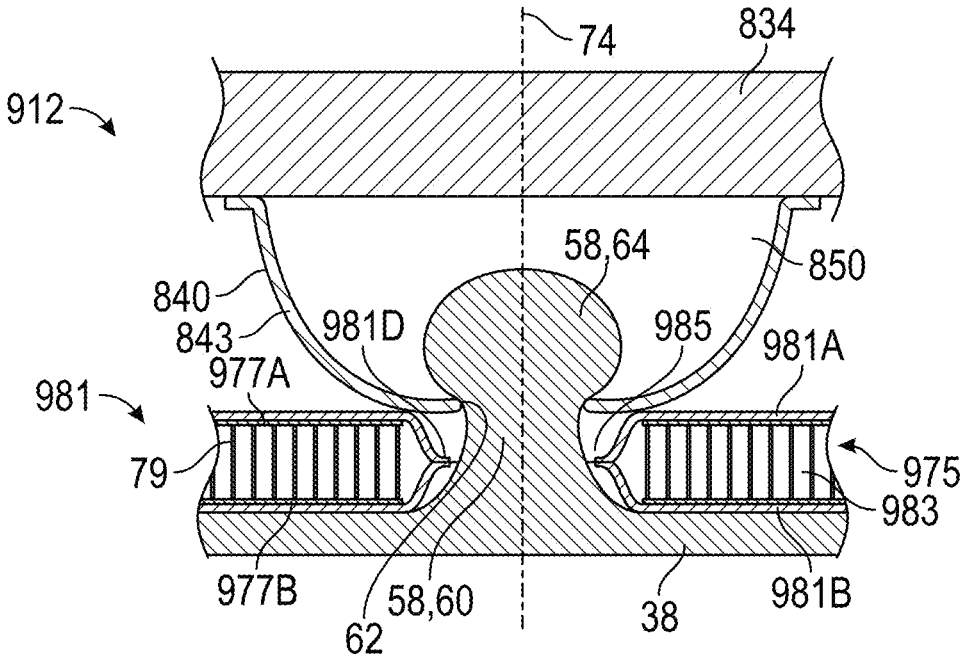
FIG. 27 is a fragmentary cross-sectional view of a portion of a sole structure including a cushioning component, a bladder disposed externally of the cushioning component, and the tensile component of FIG. 26 disposed within the bladder.

FIG. 27 is a fragmentary cross-sectional view of a portion of a sole structure 912 including the cushioning component 840 described with respect to FIGS. 23-25, a bladder 981 disposed externally of the cushioning component 840, and the tensile component 975 of FIG. 26 disposed within the bladder 981 with the tensile layers 977A and 977B secured to opposing inner surfaces of the bladder 981. The bladder 981 may be referred to herein as an "external" bladder as it is external to the chamber 850 of the cushioning component 840.

The bladder 981 defines an interior cavity 983 and is configured to retain a fluid in the interior cavity 983. The bladder 981 may be configured from two polymeric sheets 981A and 981B bonded to one another at an outer peripheral flange (not shown in FIG. 27 or 28 but represented as peripheral flange 981C in FIG. 31). and an inner peripheral flange 981D to seal the interior cavity 983. The polymeric sheets 981A, 981B may include any of the materials described with respect to the sheets 44 and 46, for example.

The external bladder 981 is shown with the polymeric sheet 981B secured to the sole component 38 and with the external bladder 981 positioned adjacent to the protruding shape 843. More specifically, the external bladder 981 is shown disposed having a portion at least partially between the protruding shape 843 and the sole component 38 (e.g., in alignment with the protruding shape 843 and the sole component 38 in a vertical direction (Z plane) in FIG. 27). Alternatively or in addition, the external bladder 981 could be secured to the protruding shape 843. If the positions of the sole component 38 and the sole layer 834 were reversed and the projection 58 was replaced with a projection like projection 658A, for example, the external bladder 981 could be secured to the sole layer 834 in such an example.

The bladder 981 defines an aperture 985 inward of the inner peripheral flange 981D such that the aperture 985 is configured as a through hole. The aperture 985 may also be referred to as a second aperture or as a through hole. In the embodiment shown, the outer peripheral flange 981C (shown in FIG. 31) extends around the entire outer perimeter of the interior cavity 983 and the inner peripheral flange 981D extends around the entire inner perimeter of the interior cavity 983 generally in an X-Y plane of the polymeric bladder 981, where the Z plane is the height of the polymeric bladder 981 shown in FIG. 27.

In the example shown, the tensile component 975 is shown disposed within the interior cavity 983 with the first and second tensile layers 977A and 977B secured to opposing inner surfaces of the respective polymeric sheets 981A, 981B. The first tensile layer 977A is bonded to the inner surface of the first polymeric sheet 981A, and the second tensile layer 977B is bonded to the inner surface of the second polymeric sheet 981B. The tethers 79 restrain separation of the first and second polymeric sheets 981A and 981B to the maximum separated positions shown in FIG. 27, which depicts the polymeric bladder 981 with the interior cavity 983 inflated and sealed under a given inflation pressure of gas in the interior cavity 983, so that the polymeric bladder 981 is in an inflated state. The outward force on the first and second polymeric sheets 981A and 981B due to the pressurized gas in the interior cavity 983 places the tethers 79 in tension, and the tethers 79 prevent the tensile layers 977A, 977B and polymeric sheets 981A, 981B from further outward movement away from one another but the tethers 79 do not present resistance to compression when under a compressive load.

Figure 28:
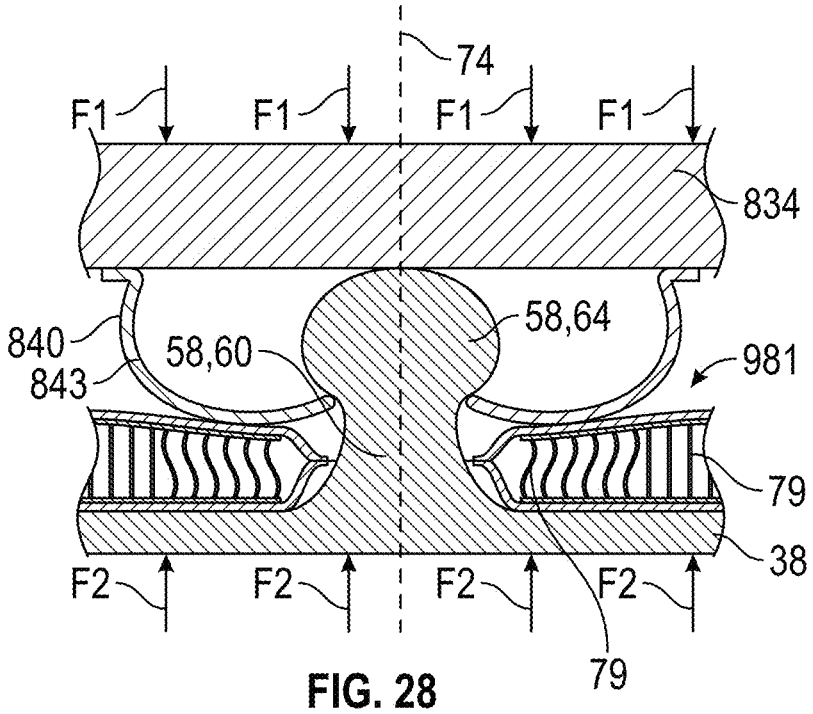
FIG. 28 is a fragmentary cross-sectional view of the portion of the sole structure of FIG. 27 under a compressive load.

As shown in FIGS. 27-28, the protruding shape 843 of the cushioning component 840 may at least partially nest in, nest on, and/or extend into the aperture 985 of the external bladder 981. Additionally, the projection 58 extends through the aperture 985 of the external bladder 981 and through the aperture 62 of the cushioning component 840. In embodiments in which the sole structure 912 includes multiple cushioning components each having a protruding shape as described, such as shown in FIG. 31, the external bladder 981 has multiple additional apertures (e.g., through holes), and each corresponding with a respective one of the protruding shapes of the multiple cushioning components and the projections of the sole layer.

FIG. 28 is a fragmentary cross-sectional view of the portion of the sole structure 912 of FIG. 27 under the compressive load F1 and reaction load F2 of a sufficient magnitude to cause the protruding shape 843 of the cushioning component 840 to compress against the external bladder 981 and to at least partially invert, as well as to cause the external bladder 981 to resiliently compress with at least some of the tethers 79 going slack. Either or both of the sole layer 834 and the sole component 38 may also compress under the load F1, or may compress only under an even greater compressive load, depending upon the relative stiffnesses of the components.

Figure 29:
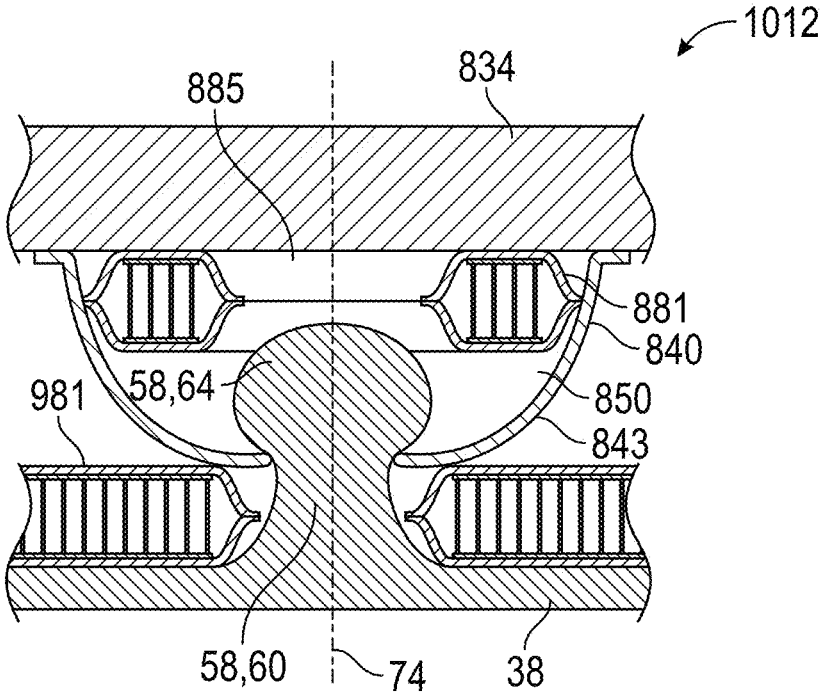
FIG. 29 is a fragmentary cross-sectional view of a portion of a sole structure including the bladder of FIG. 23 as an internal bladder and the bladder of FIG. 27 as an external bladder.
Figure 30:
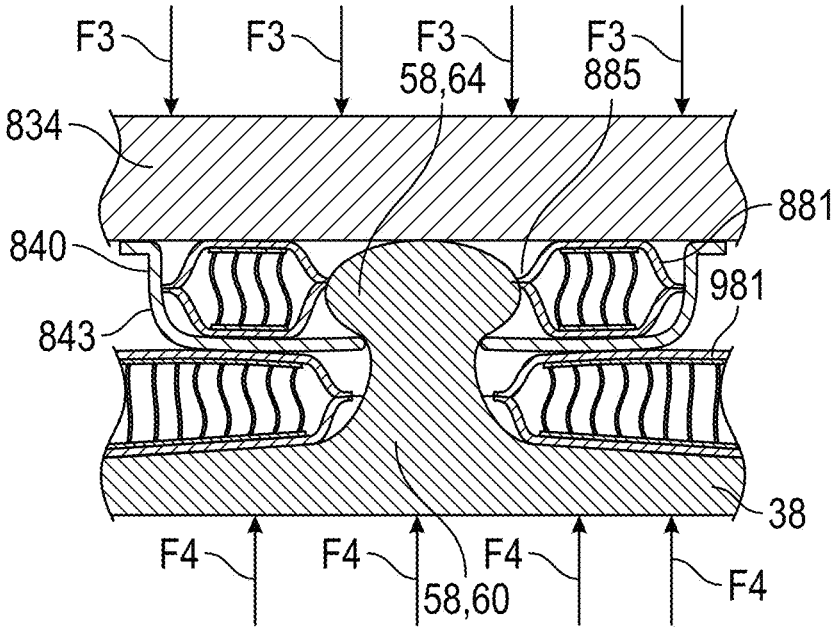
FIG. 30 is a fragmentary cross-sectional view of the portion of the sole structure of FIG. 29 under a compressive load.

FIG. 29 is a fragmentary cross-sectional view of a portion of a sole structure 1012 that includes both the internal bladder 881 of FIG. 23 and the external bladder 981 of FIG. 27, shown in the absence of a compressive load. FIG. 30 is a fragmentary cross-sectional view of the portion of the sole structure of FIG. 29 under the compressive load F3 and reaction load F4, causing compression of both the protruding shape 843, the internal bladder 881, and the external bladder 981.

Figure 31:
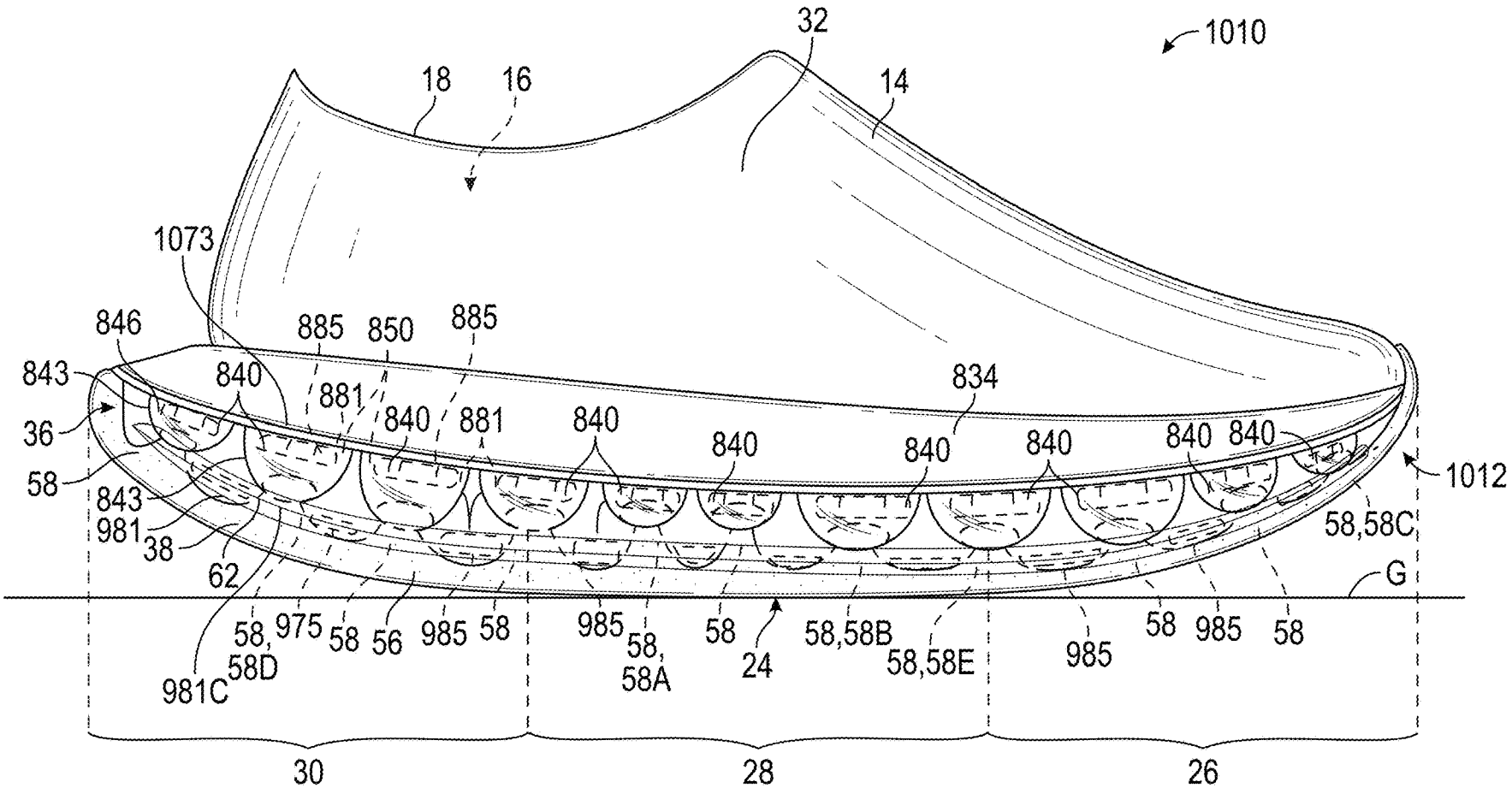
FIG. 31 is a medial side view of an article of footwear including a sole structure having multiple cushioning components with internal bladders and including an external bladder.

FIG. 31 is a medial side view of an article of footwear 1010 including the sole structure 1012 of FIG. 29 and showing the external bladder 981 with the tensile component 975 and defining multiple apertures 985 configured as additional through holes through which the projections 58 extend. Only some of the apertures 985 are labelled with reference numbers in FIG. 31. The outer peripheral flange 981C of the external bladder 981 is shown. A unitary sheet 846 defines multiple cushioning components 840, like that of FIGS. 23-30, each having an outer surface at least a portion of which has a protruding shape 843 in the absence of a compressive load of at least a respective predetermined magnitude on the cushioning component 840 and each defining a chamber 850 with an aperture 62 extending through the protruding shape 843. Only one of the apertures 62 and chambers 850 is labelled in FIG. 31. The protruding shape 843 of each of the plurality of cushioning components 840 compresses against the external bladder 981 around a respective one of the additional through holes 985 under the compressive load F1 such as shown in FIG. 28.

The sole component 38 includes multiple projections 58, each paired with a respective cushioning component 840 and extending through the aperture 62 and into the chamber 850. An internal bladder 881 as in FIG. 23 is disposed within each of the chambers 850. The internal bladders 881 may be secured to the lower surface of the sole layer 834 prior to securing a perimeter flange 1073 of the sheet 846 to the sole layer 834. The perimeter flange 1073 defines the outer perimeter of the sheet 846 and, as is evident in FIG. 31, the outer perimeter is nonplanar (e.g., the outer perimeter at the perimeter flange 1073 is higher at the heel region 30 than at the forefoot region 26, and slightly lower in the midfoot region 28). In another example, the internal bladders 881 could instead be disposed within the chambers 850 prior to securing the sheet 846 to the sole layer 834.

Figure 32:
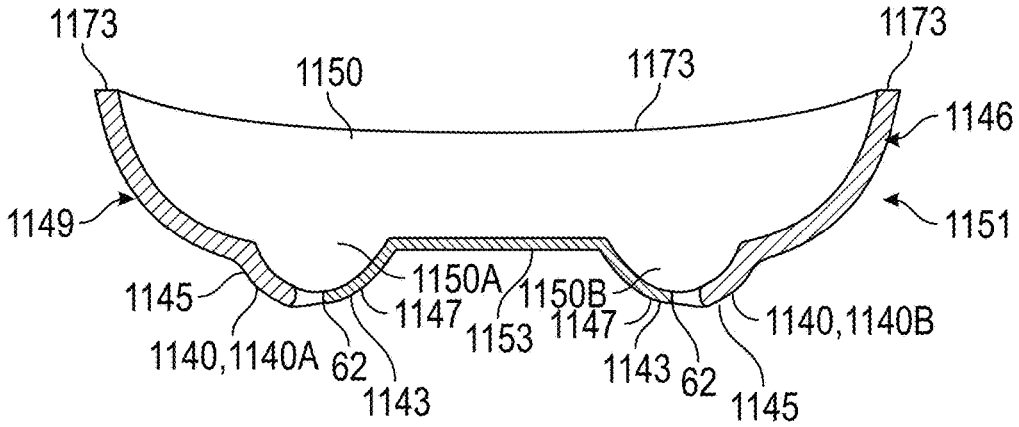
FIG. 32 is a cross-sectional view of a sheet defining multiple cushioning components taken at lines 32-32 in FIG. 33.

FIG. 32 is a cross-sectional view of a sheet 1146 defining multiple cushioning components 1140 that are integral portions of the single sheet 1146. Only some of the cushioning components 1140 are labelled in FIG. 33, and it is apparent that the cushioning components 1140 are in each of the forefoot region 26, the midfoot region 28, and the heel region 30. The outer perimeter 1173 of the single sheet 1146 is nonplanar. For example, the outer perimeter 1173 may have a curvature that enables the single sheet 1146 to be disposed underfoot in a sole structure, while also wrapping upward along the sides, rear, and/or front of the sole structure, such as onto a sole layer 834 in FIG. 31 similar to the outer perimeter (at perimeter flange 1073) of the sheet 846. Each of the multiple cushioning components 1140 includes a respective protruding shape 1143 and at least partially defines a respective chamber 1150, as indicated by chambers 1150A and 1150B in FIG. 32, for example. The sheet 1146 is configured so that at least some of the respective chambers 1150, such as chambers 1150A and 1150B blend into and are a portion of a common chamber 1150. By placing the cushioning components of a single sheet close to one another, such as with the protruding shapes immediately adjoining, a multi-lobed chamber may be defined by the sheet if desired for cushioning purposes, such as a tri-lobe or other configuration, for example.

As shown in FIG. 32, a thickness of the single sheet 1146 is greater along a first portion of at least one of the cushioning components 1140 than along a second portion of the cushioning component 1140. For example, each of the cushioning components 1140A and 1140B has a first portion 1145 that is a laterally-outward portion and a second portion 1147 that is a laterally inward portion. The first portion 1145 (the laterally outward portion) of each cushioning component 1140 is nearer to an outer perimeter 1173 of the sheet 1146 and of the sole structure in which the sheet 1146 is utilized than to a center of the sole structure (e.g., at a portion 1153). For example, the thicker first portion 1145 may be nearer to the medial side 1149 or the lateral side 1151 than the second portion 1147, with the thinner second portion 1147 further inward toward a longitudinal axis of the sole structure, which is the same as the longitudinal axis of the sheet 1146 in FIG. 33 (an axis extending from the forefoot region 26 to the heel region 30 along a longitudinal midline). Similarly, the thicker first portion 1147 of cushioning components at the front of the sole structure (e.g., at the front of the forefoot region 26 in FIG. 33) may be nearer the outer perimeter 1173 at the front of the sole structure than the second portion 1147, and the thicker first portion 1147 of the rearmost cushioning component 1140 in the heel region 30 shown in FIG. 33 may be nearer to the outer perimeter 1173 at the rear of the sole structure (e.g., at the rear of the heel region 30 in FIG. 33). Because a thinner portion may resiliently deform under a lesser compressive load than a thicker portion, strategically providing the thicker portions 1145 nearer to the outer perimeter may direct the inversion or collapse of the protruding shapes 1143 under compression as desired to provide greater stability during compressive loading. For example, each cushioning component 1140 may tend to collapse more at the thinner portion 1147 than at the thicker portion 1145 under the same compressive load on each. As shown in FIG. 32, the greater wall thickness may extend along the sides to the outer perimeter 1173 and a portion 1153 of the sheet 1146 between the cushioning components 1140 may be relatively thin as shown in FIG. 32.

Figure 35:
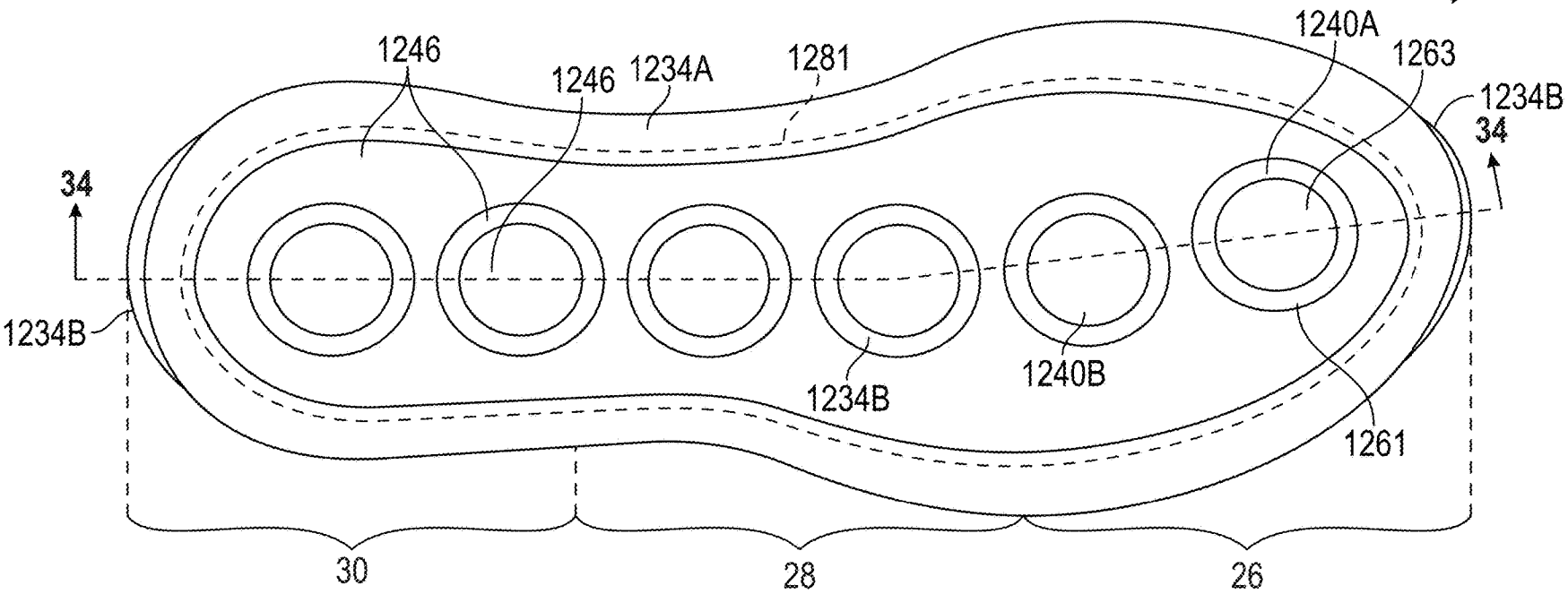
FIG. 35 is a top view of the sole structure of FIG. 34.

FIG. 34 is a cross-sectional view taken at lines 34-34 in FIG. 35 of another example of a sole structure 1212 having multiple cushioning components 1240 each having a body 1241 with a protruding shape 1243. As discussed herein, the cushioning components 1240 are configured for snap-through buckling. Additionally, the cushioning components 1240 are integral portions of a single sheet 1246. In other examples, some or all of the cushioning components 1240 need not be integral portions of the same sheet as the other cushioning components 1240. FIG. 35 is a top view of the sole structure 1212 of FIG. 34.

In the example shown in FIGS. 34-37, each of the cushioning components 1240 are of the same size, and are distributed in the forefoot region 26, the midfoot region 28, and the heel region 30 of the sole structure 1212. In other examples, the cushioning components 1240 may be different sizes and/or maybe in only one or only two of the forefoot region 26, the midfoot region 28, and the heel region 30.

In the example shown, the sole structure 1212 also includes a bladder 1281, a sole layer 1234A configured as a midsole, and a sole layer 1234B configured as an outsole. An additional sole layer or layers, such as an insole, may also be included in the sole structure 1212 and may overlie the sheet 1246 and cushioning components 1240, for example. As shown in FIGS. 34-35, the sheet 1246 with the cushioning components 1240 overlie the bladder 1281. The bladder 1281 overlies the sole layer 1234A, which encapsulates the sides and bottom of the bladder 1281. The bladder 1281 includes a tensile component 1275 having tensile layers 1277A and 1277B secured to opposing inner surfaces of the bladder 1281, and tethers 79 extending between the tensile layers 1277A and 1277B across an internal cavity 1283 that may retain fluid at a pressure at or above ambient, as described with respect to the similar components of bladders 881 and 981, for example. The bladder 1281 may be formed from first and second polymeric sheets 1281A and 1281B bonded to one another at a peripheral flange 1281C.

In the example shown, each cushioning component 1240 includes a body 1241 defining a chamber 1250 and the outer surface 1242 with the protruding shape 1243. The body 1241 has an annular sidewall section 1261 and a relatively flat end section 1263. Only one of the cushioning components 1240 is labelled with these features in FIGS. 34-35, but each includes like features.

A respective resilient member 1287 is shown disposed within the chamber 1250 of each cushioning component 1240. The resilient member 1287 may be secured to the inner surface of the body 1241 and/or to the outer surface of the bladder 1281, or may simply be contained within the chamber 1250 without securement to any of the components defining the chamber 1250. As shown, the resilient members 1287 may have different shapes and configurations, such as shown with resilient members 1287A, 1287B, and 1287C. Resilient member 1287A has two voids, resilient member 1287B has no voids, and resilient member 1287C has one void. A resilient member 1287 with fewer voids will be stiffer and compress less easily relative to a resilient member shaped otherwise the same but with a greater number of voids. The resilient member 1287 may be, for example, a foam cushioning component, as shown. Alternatively, the resilient member 1287 could be a bladder defining a fluid-filled chamber, and may have a tensile component as described herein within the chamber.

Figure 36:
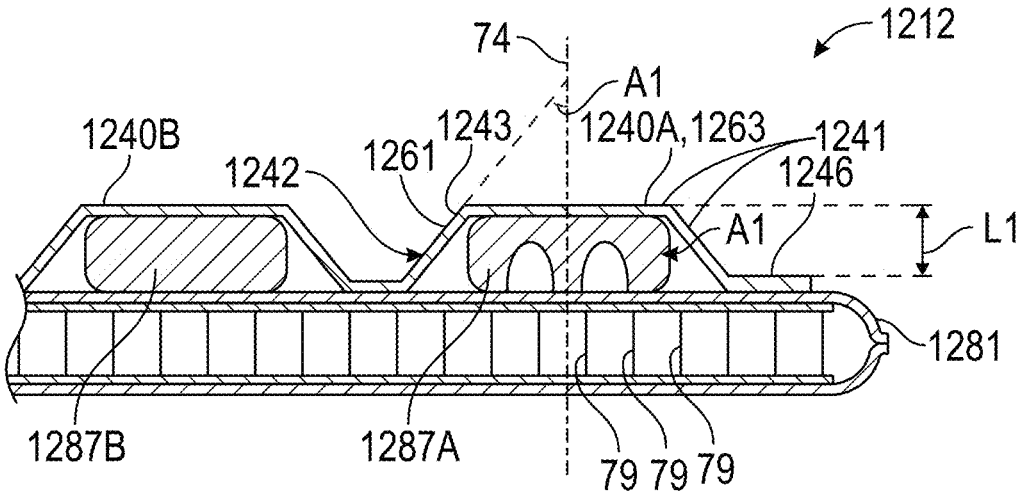
FIG. 36 is a partial fragmentary view of some of the components of the sole structure of FIGS. 34-35.

FIGS. 34-36 show the cushioning components 1240 in an absence of applied loads (such as compressive loads applied along the longitudinal axis 74 of the body 1241), referred to as an expanded configuration of the cushioning component 1240. With particular reference to FIG. 36, in the absence of such compressive loading, the annular sidewall section 1261 has an equilibrium state at a first position and at a first angle A1 relative to the longitudinal axis 74 of the body 1241. For example, "an equilibrium state" is the position of the annular sidewall section 1261 along the longitudinal axis 74 and the angle A1 of the annular sidewall section 1261. It should be appreciated that the annular sidewall section 1261 need not have a linear shape along the outer surface 1242. For example, the annular sidewall section 1261 may be bowed outward (e.g., convex at the outer surface 1242) in the equilibrium state. In such instances, the angle of the annular sidewall section relative to the longitudinal axis is measured by utilizing a line extending through a point where the annular sidewall section intersects with the surrounding portion of the sheet 1246 and a point where the annular sidewall section 1261 intersects with the end section 1263.

The material of the body 1241 "self-biases" the annular sidewall section 1261 to remain at the equilibrium state (at the first position of FIGS. 34-36 and at the first angle A1 shown in FIG. 36) in the absence of applied loads. In some implementations, the body 1241 is configured for snap-through buckling. For example, the angled annular sidewall section 1261 and the end section 1263 along with the material and thickness of the body 1241 may cause the annular sidewall section 1261 to elastically deform by snap-through buckling to a collapsed configuration shown in FIG. 37 when under the compressive load F1 of at least the predetermined magnitude. Reaction load F2 is also shown. As shown, the annular sidewall section 1261 at least partially inverts as well as becomes nonplanar along the outer surface 1242 (e.g., folds or crumples). The body 1241 has a first length L1 along the longitudinal axis 74 of the cushioning component 1240A in the expanded configuration (the equilibrium state) and a second length L2 along the longitudinal axis 74 in the collapsed configuration, the second length L2 less than the first length L1. The first length L1 and the second length L2 are measured from the top of the sheet 46 surrounding the annular sidewall section 1261 to the top of the end section 1263.

Figure 37:
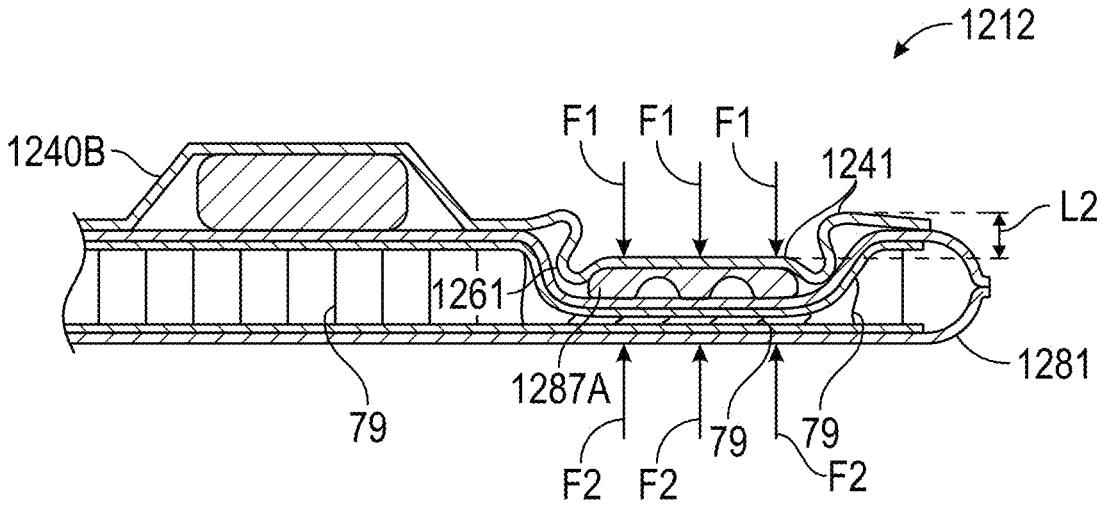
FIG. 37 is a partial fragmentary view of the components of FIG. 36 showing a compressive load applied to one of the cushioning components and resulting snap-through buckling.

When the compressive load F1 is removed, the annular sidewall section 1261 will return to the equilibrium state of FIGS. 34-35. FIG. 37 illustrates that the bladder 1281 as well as the resilient member 1287A also compress under the compressive load F1. For example, the resilient member 1287A may be an elastomeric foam member that may be disposed within the chamber 1250 and may absorb some of the compressive load and limit the buckling of the body 1241 at the annular sidewall section 1261 by limiting the travel distance along the longitudinal axis 74. The compression of the bladder 1281 also absorbs some of the compressive load and limits the buckling of the body 1241. The compression of both the resilient member 1287A and the bladder 1281 is a resilient deformation, storing energy that returns the bladder 1281 and the resilient member 1287A to the unloaded states shown in FIGS. 34-35. The compression of the bladder 1281 and the resilient member 1287A and the stored energy therein helps to also urge the cushioning component 1240A and the annular sidewall section 1261 thereof back to the equilibrium state. Stated differently, the return of the resilient member 1287A and the bladder 1281 when the compressive load F1 is removed or lessened may also assist with urging the annular sidewall section 1261 back to the equilibrium state. More specifically, the cushioning component 1240A will return to the configuration shown in FIG. 34.

The body 1241 may provide a haptic indicator of the snap-through buckling. FIGS. 36 and 37 illustrate the ability of the sheet 1246 including multiple cushioning components 1240 to provide haptic feedback to the wearer indicative of the relative location of the loading underfoot. For example, if the wearer applies the compressive load to the cushioning component 1240A but the cushioning component 1240B is subjected to a lesser load or to no loading, the snap-through buckling is isolated to the cushioning component 1240A. Any haptic feedback (e.g., sound, feel, etc.) will thus be provided at the location of the particular cushioning component 1240A. Accordingly, a wearer attempting to learn a particular foot placement, foot loading, or foot roll pattern may be trained by the haptic indicator feedback. In the embodiment of FIGS. 34-35, the cushioning components 1240 are close to the wearer's foot (e.g., are packaged above the bladder 1281, referred to as top-loaded), which may best enable the wearer to sense the haptic indicator.

Figure 38:
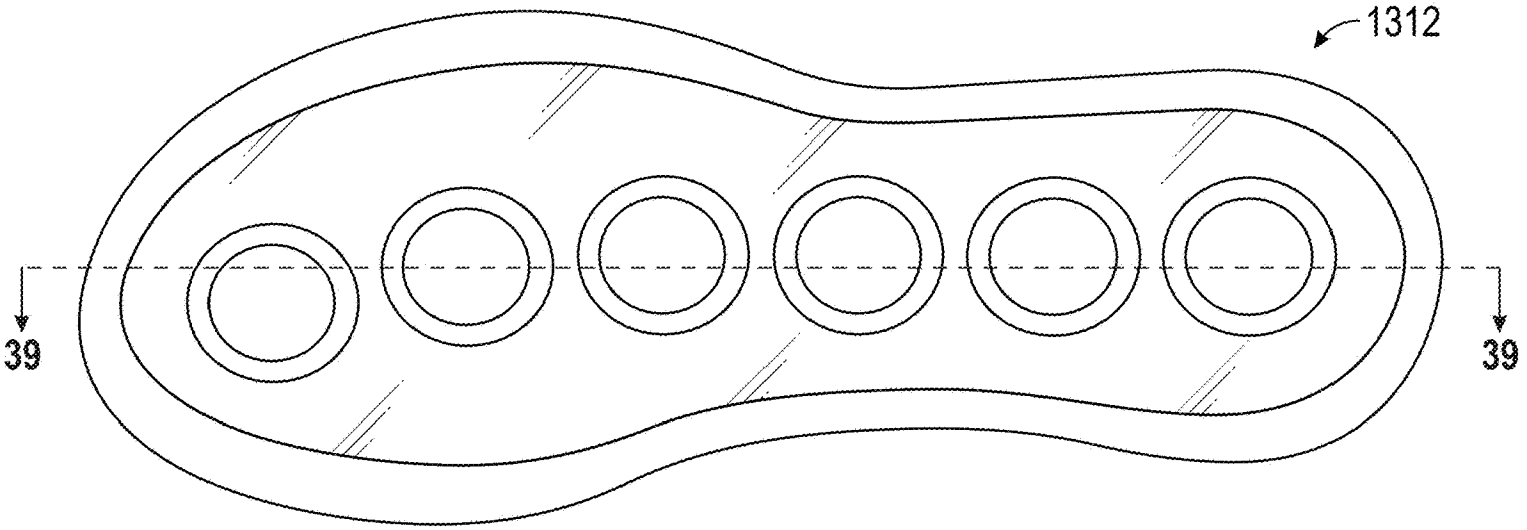
FIG. 38 is a bottom view of a portion of a sole structure having multiple cushioning components configured for snap-through buckling with an outsole shown in FIG. 39 removed.
Figure 39:
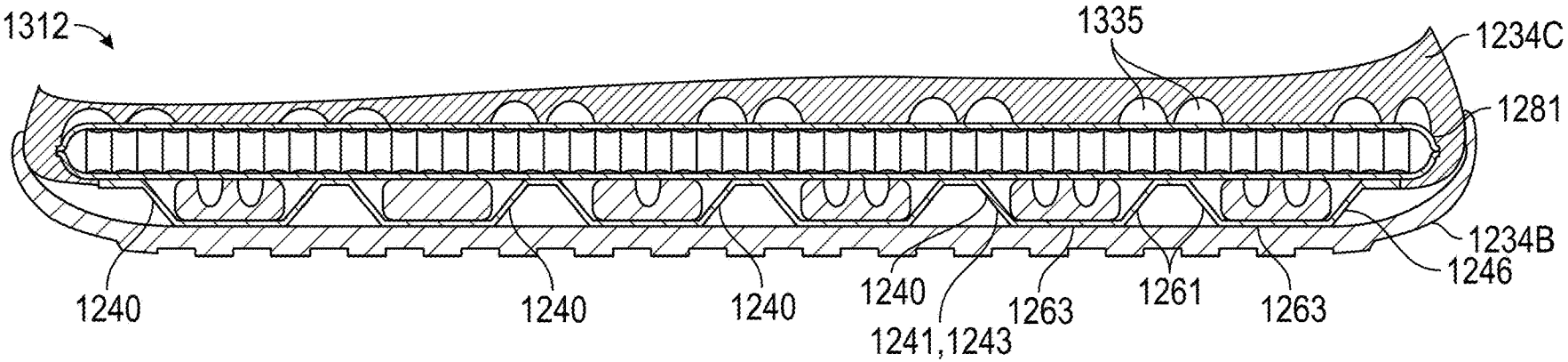
FIG. 39 is a cross-sectional view of the sole structure of FIG. 38 taken at lines 39-39 in FIG. 38 and showing the outsole.

FIGS. 38-39 illustrate another example of a sole structure 1312 that includes many of the components described with respect to the sole structure 1212. FIG. 38 is a bottom view of a portion of the sole structure 1312 with an outsole 1234B shown in FIG. 39 removed. FIG. 39 is a cross-sectional view of the sole structure 1312 of FIG. 38 taken at lines 39-39 in FIG. 38 and showing the outsole 1234B. The sole structure 1312 includes the bladder 1281 and the outsole 1234B of the sole structure 1212, as well as the sheet 1246 with the cushioning components 1240 and the resilient members 1287 disposed in the chambers 1250 of the cushioning components 1240, except that the sheet 1246 and cushioning components 1240 are disposed between the bladder 1281 and the outsole 1234B rather than at a top side of the bladder 1281. Additionally, a sole layer 1234C, such as a foam midsole layer, overlies the bladder 1281. Although no additional sole layer is illustrated between the cushioning components 1240 and the outsole 1234B, one or more sole layers may be disposed therebetween.

The cushioning components 1240 of the sole structure 1312 will function as described with respect to the sole structure 1212, exhibiting snap-through buckling under a compressive load of at least a predetermined magnitude, except that the reaction load F2 resulting from a foot-applied load F1 will be the compressive load that results in snap-through buckling of the angled sidewall section of a particular cushioning component 1240, with travel of the cushioning component 1240 relatively upward into the bladder 1281 rather than downward as indicated in FIG. 37 in the sole structure 1212.

The sole layer 1234C is illustrated as having some open areas 1335 (e.g., areas not containing foam) in order to increase flexibility of the sole layer 1243C. However, the open areas 1335 are generally disposed as vertically centered over portions of the sheet between end sections 1263 of adjacent cushioning components 1240 and the sole layer 1234C is kept relatively solid at portions vertically aligned with the end sections 1263. This best directs the compressive loading due to a foot compressing downward on the sole layer 1234C, including the upward reaction load on the cushioning components 1240, to occur on the end sections 1263 in order to cause the snap-through buckling. Stated differently, because the sole layer 1234C is relatively free of open areas 1335 centered over the end sections 1263, compressive loading will be more concentrated at the end sections 1263 and the annular sidewall sections 1261 will be more free to deform by snap-through buckling as designed. The annular sidewall section 1261 will buckle upward toward the bladder 1281 in a manner that will look like an inversion of the illustration of snap-though buckling in FIG. 36.

The sheet 1246 and cushioning components 1240 may be used in any of the sole structures described herein. For example, cushioning components 40, 540, 640A, 640B, 840, and/or 1140 may be replaced with cushioning components 1240.

Figure 40:
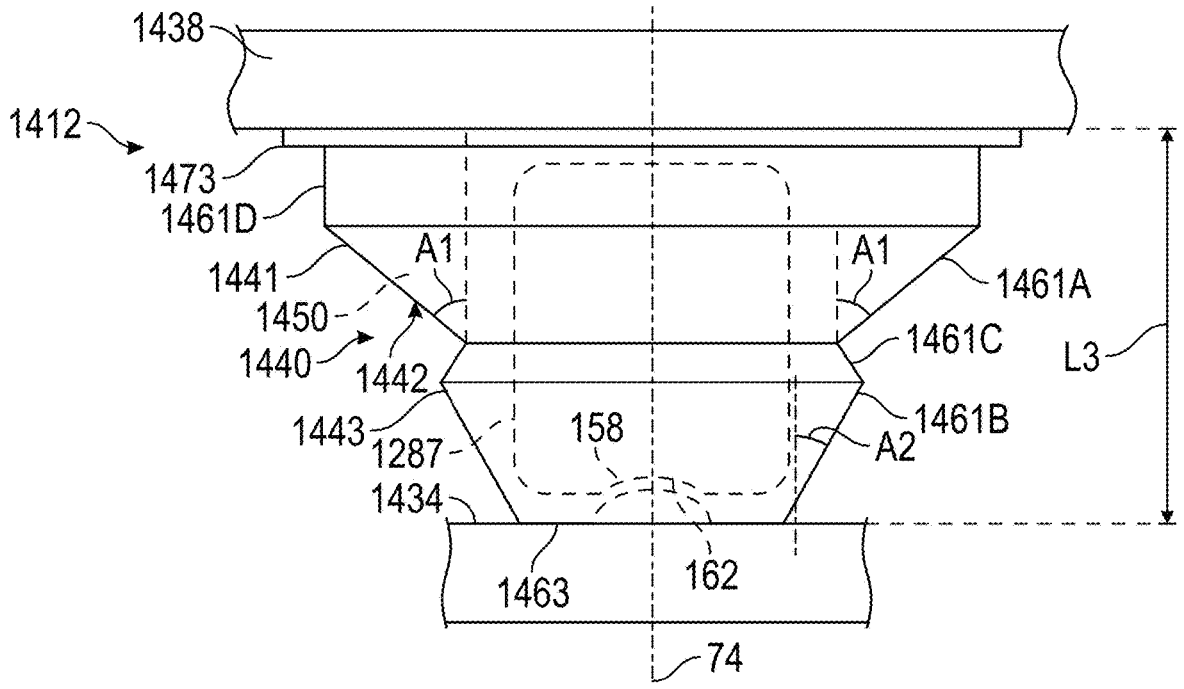
FIG. 40 is a fragmentary side view of a sole structure having a cushioning component configured to elastically deform by snap-through buckling.

FIG. 40 is a fragmentary side view of another example of a sole structure 1412 having a cushioning component 1440 configured to elastically deform by snap-through buckling. The sole structure 1412 includes a first sole layer 1438, a sole component 1434, and the cushioning component 1440. The cushioning component 1440 has a body 1441 that includes a first annular sidewall section 1461A, a second annular sidewall section 1461B, an intermediate annular sidewall section 1461C, and an end annular section 1461D and an end wall 1463. The intermediate annular sidewall section 1461C spaces the first annular sidewall section 1461A apart from the second annular sidewall section 1461B along the longitudinal axis 74 of the body 1441. The end annular section 1461D extends relatively parallel to the longitudinal axis 74. The outer surface 1442 of the body 1441 has the protruding shape 1443 shown in FIG. 40 in the absence of a compressive load of at least a predetermined magnitude on the cushioning component 1440. The body 1441 at least partially defines a chamber 1450 at least partially surrounded by the outer surface 1442. The body 1441 also includes a peripheral flange 1473 extending from the end annular section 1461D at an outer perimeter of the body 1441 and that is secured to the sole layer 1438 such as by adhesive or bonding. In an implementation having multiple cushioning components 1440 as integral portions of a single sheet, the flange 1473 would be an outer perimeter of the sheet.

The sole component 1434 is shown having a projection 158 that interfaces with a recess 162 in the outer surface 1442 of the cushioning component 1440 at the end wall 1463, similar to the projection 158 and recess 162 as described with respect to the example cushioning component 140 of FIG. 8. The recess 162 and end wall 1463 are best shown in the bottom view of the cushioning component 1440 in FIG. 43. Alternatively, the end wall 1463 could be bonded or adhered to the sole component 1434 without a projection or recess. Alternatively, a projection that is an integral extension of the first sole layer 1438 could extend through an aperture in the end wall 1463 and be secured to the sole component 1434, similar to the projection 658A of the first sole layer 638 described with respect to FIG. 20.

A resilient member 1287 like those described with respect to FIGS. 34-38 is shown disposed within the chamber 1450. Alternatively or in addition, a bladder could be disposed in the chamber 1450. In still other examples, the chamber 1450 could have no resilient member or other cushioning member therein.

The body 1441 is configured for multiple instances of snap-through buckling to occur in series as the body 1441 includes more than one annular sidewall section 1461A, 1461B that have equilibrium states and that experience snap-through buckling, and the body 1441 is configured so that the different annular sidewall sections 1461A and 1461B will deform by snap-through buckling under compressive loads of different magnitudes.

Figure 41:
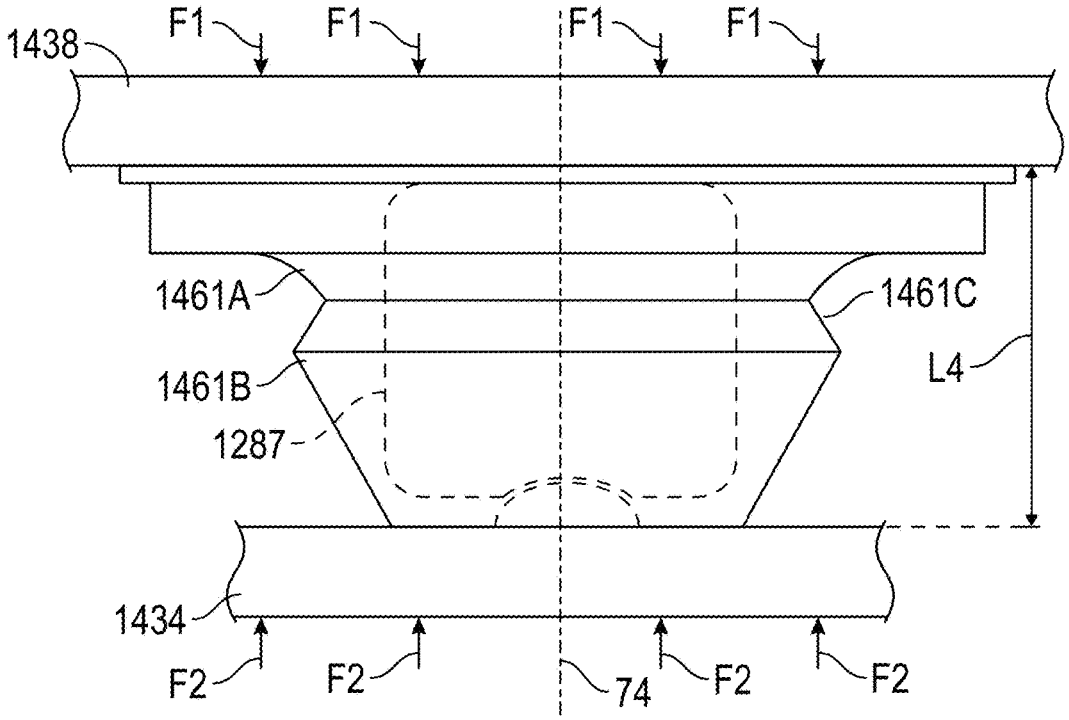
FIG. 41 is a fragmentary side view of the sole structure of FIG. 40 under a compressive load with snap-through buckling occurring at a first annular sidewall section of the cushioning component.

FIG. 40 shows an expanded configuration of the cushioning component 1440, which is when the cushioning component 1440 is not under a compressive load. In this configuration, the first annular sidewall section 1461A has an equilibrium state at a first position and at a first angle A1 relative to the longitudinal axis 74 of the body in the expanded configuration of the cushioning component 1440. The second annular sidewall section 1461B has an equilibrium state disposed at a second angle A2 relative to the longitudinal axis 74 of the body 1441 (e.g., a vertical line in FIG. 40) in the expanded configuration of the cushioning component 1440 shown in FIG. 40. A magnitude of the first angle A1 is different than a magnitude of the second angle A2. As shown in FIG. 40, the first angle A1 is larger than the second angle A2, making the first annular sidewall section 1461A incline less steeply than the second annular sidewall section 1461B. In such a configuration, the first annular sidewall section 1461A may tend to elastically deform to a collapsed state by snap-through buckling at a compressive load F1 (and equal reaction load F2) that is less than the compressive load at which snap-through buckling of the second annular sidewall section 1461B will occur. Stated differently, the second annular sidewall section 1461B is configured to elastically deform by snap-through buckling to a collapsed configuration when under a compressive load of a different magnitude than the compressive load at which the first annular sidewall section 1461A elastically deforms. The intermediate annular sidewall section 1461C will adopt a different angle relative to the longitudinal axis 74 as well when the first annular sidewall section 1461A collapses, as shown in FIG. 41. The length of the body 1441 along the longitudinal axis 74 will shorten from a first length L3 to a second length L4.

Figure 42:
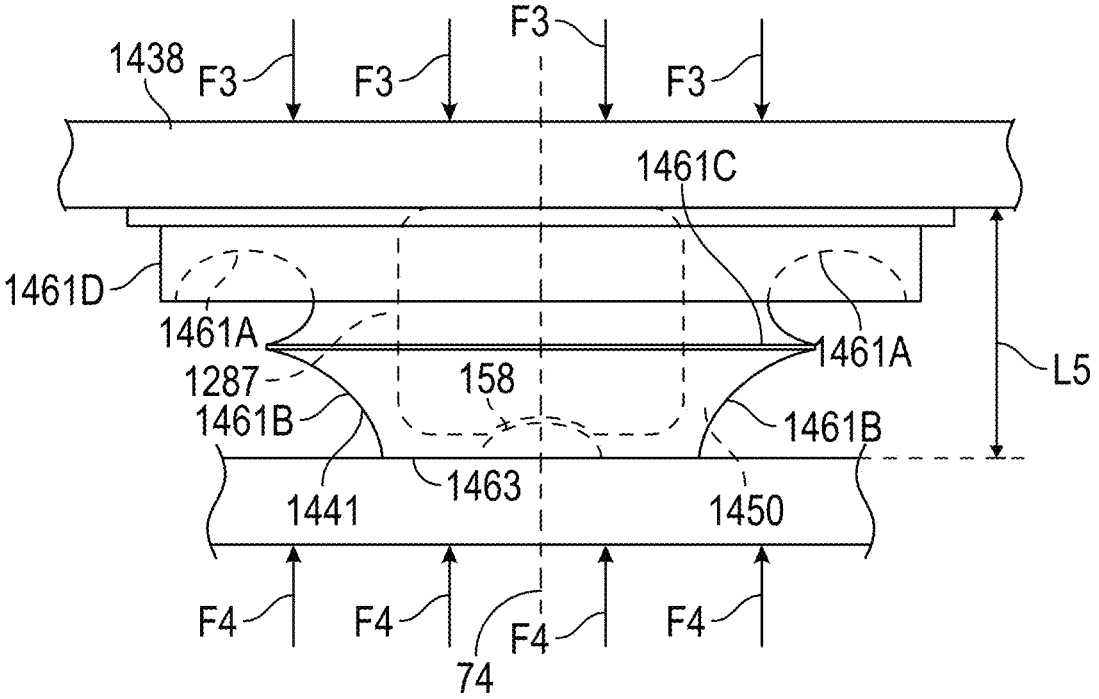
FIG. 42 is a fragmentary side view of the sole structure of FIGS. 40-41 under a greater compressive load than in FIG. 41 with snap-through buckling occurring at a second annular sidewall portion of the cushioning component.
Figure 43:
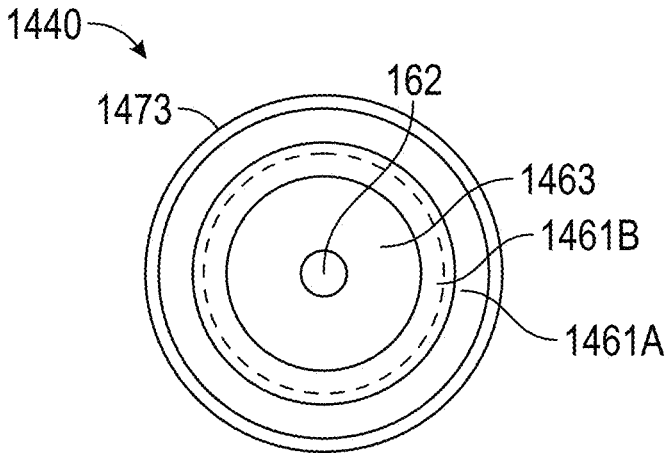
FIG. 43 is a bottom view of the cushioning component of FIG. 40.

Referring to FIG. 42, under a greater compressive load F3 and equal reaction load F4, the second annular sidewall section 1461B collapses by snap-through buckling to a collapsed state. The first annular sidewall section 1461A may continue buckling and partially inverting such that it nests in a space inward of the end annular section 1461D. The intermediate annular sidewall section 1461C may become nearly horizontal. With this second occurrence of snap-through buckling in series after the first snap-through buckling (e.g., snap-through buckling of the second annular sidewall section 1461B after the first annular sidewall section 1461A has already buckled), the length of the body 1441 along the longitudinal axis 74 is further shortened to a third length L5 that is less than the second length L4.

The body 1441 may provide a haptic indicator of the snap-through buckling at the first stage (e.g., when the first annular sidewall section 1461A collapses as shown in FIG. 41) and then a second haptic indicator of the snap-through buckling at the second stage (e.g., when the second annular sidewall section 1461B collapses as shown in FIG. 42). The haptic indicator can be in any of the forms described with respect to the cushioning component 1240.

As the body 1441 collapses, the resilient member 1287 becomes resiliently compressed by a first amount when the first annular sidewall section 1461A experiences snap-through buckling and the length of the body 1441 decreases to the second length LA, and then by a greater second amount when the second annular sidewall section 1461B experiences snap-through buckling and the length of the body 1441 further decreases to the third length L5. The resilient member 1287 is sized to engage the sole layer 1438 at one end of the chamber 1450 and the end wall 1463 (or at least the projection 158) at the other end of the chamber 1450 when snap-through buckling occurs such that it is compressed as the length of the body 1441 decreases. Similarly as discussed with respect to the cushioning component 1240, the resilient member 1287 limits the movement of the annular sidewall sections 1461A, 1461B during compression (e.g., by providing resistance to further decreasing the length of the body 1441 much shorter than the third length L5, and assists with moving the annular sidewall sections 1461A and 1461B back to the equilibrium state of FIG. 40 upon removal of the compressive load as the energy stored in the resilient member 1287 due to its compression is released when the compressive load is removed.

Although the cushioning component 1440 is shown with two annular sidewall sections that experience snap-through buckling, a cushioning component within the scope of the disclosure could have three or more annular sidewall sections that experience snap-through buckling at compressive loads of the same magnitude or of different magnitudes. Additionally, the first annular sidewall section 1461A is configured to collapse by snap-through buckling under a lesser compressive load than the second annular sidewall section 1461B, the magnitude of the angles A1 and A2 could be switched so that the second annular sidewall section 1461B collapses by snap-through buckling at a lesser compressive load than the first annular sidewall section 1461A.

The cushioning component 1440 could be used in place of the cushioning component in any of the sole structures described herein. For example, cushioning component 40, 540, 640A, 640B, 840, 1140 and/or 1240 may be replaced with cushioning component 1440. Additionally, any of the sole structures described herein having multiple cushioning components could have different ones of the cushioning components 40, 540, 640A, 640B, 840, 1140, 1240 and/or 1240. As one non-limiting example, cushioning component 40 (or more than one cushioning component 40) might be used in one region of a sole structure, such as the forefoot region 26, cushioning component 840 (or more than one cushioning component 840) could be used in another region such as the midfoot region 28, and cushioning component 1240 (or more than one cushioning component 1240) could be used in another region such as the heel region 30. Any other combination of the cushioning components described herein could be used. Moreover, a single sheet that includes multiple cushioning components as integral portions of the single sheet could include multiple cushioning components of any of these different types rather than all of the same type.

Figure 44:
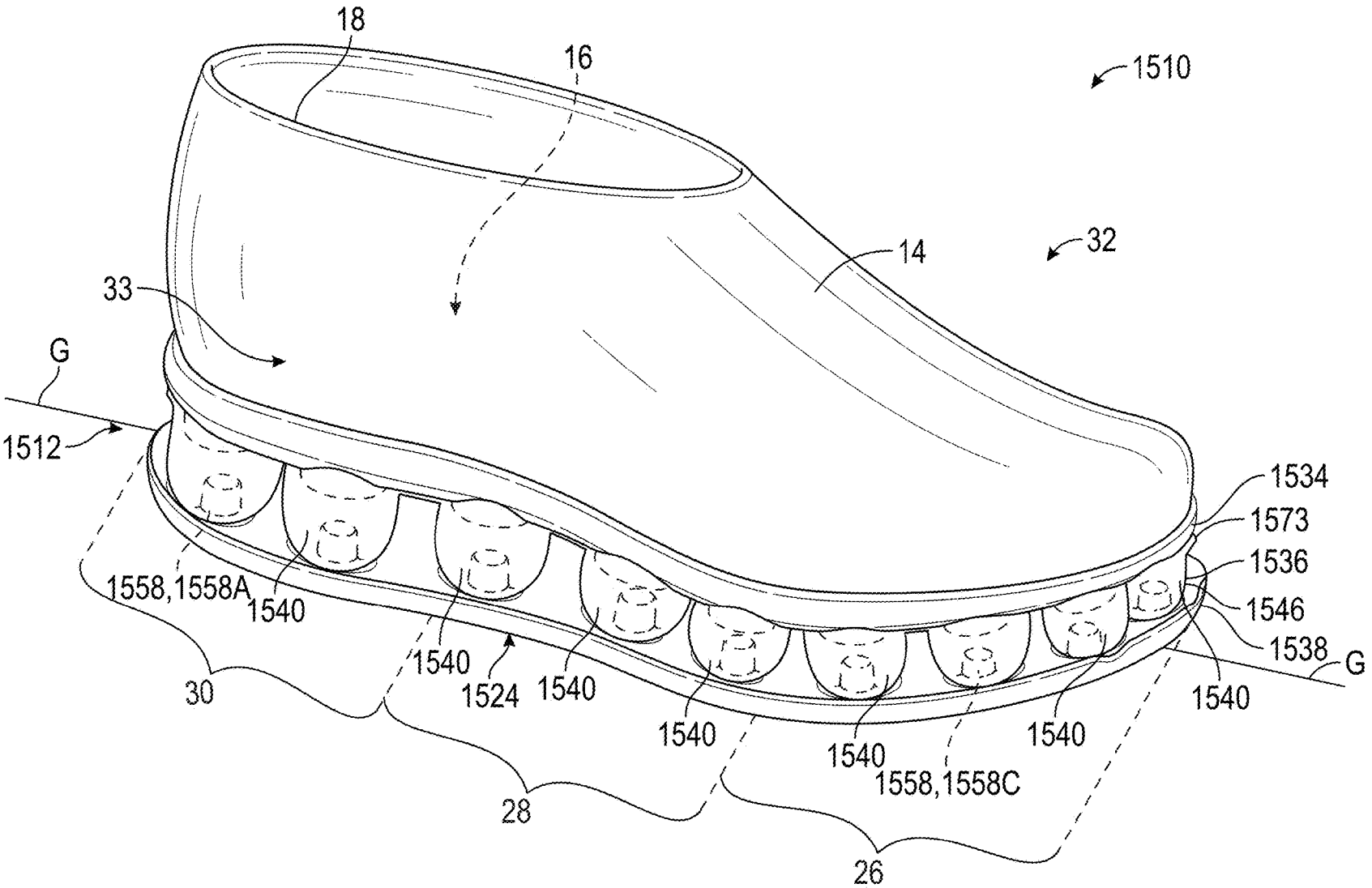
FIG. 44 is a perspective lateral side view of an article of footwear including a sole structure having multiple cushioning components.

FIG. 44 is a perspective lateral side view of an article of footwear 1510 including a sole structure 1512 and an upper 14 secured to the sole structure 1512. The upper 14 is as described with respect to the article of footwear 10 of FIG. 1. The article of footwear 1510 includes a forefoot region 26, midfoot region 28, heel region 30, medial side 32 and lateral side 33 as described with respect to the article of footwear 10.

Figure 45:
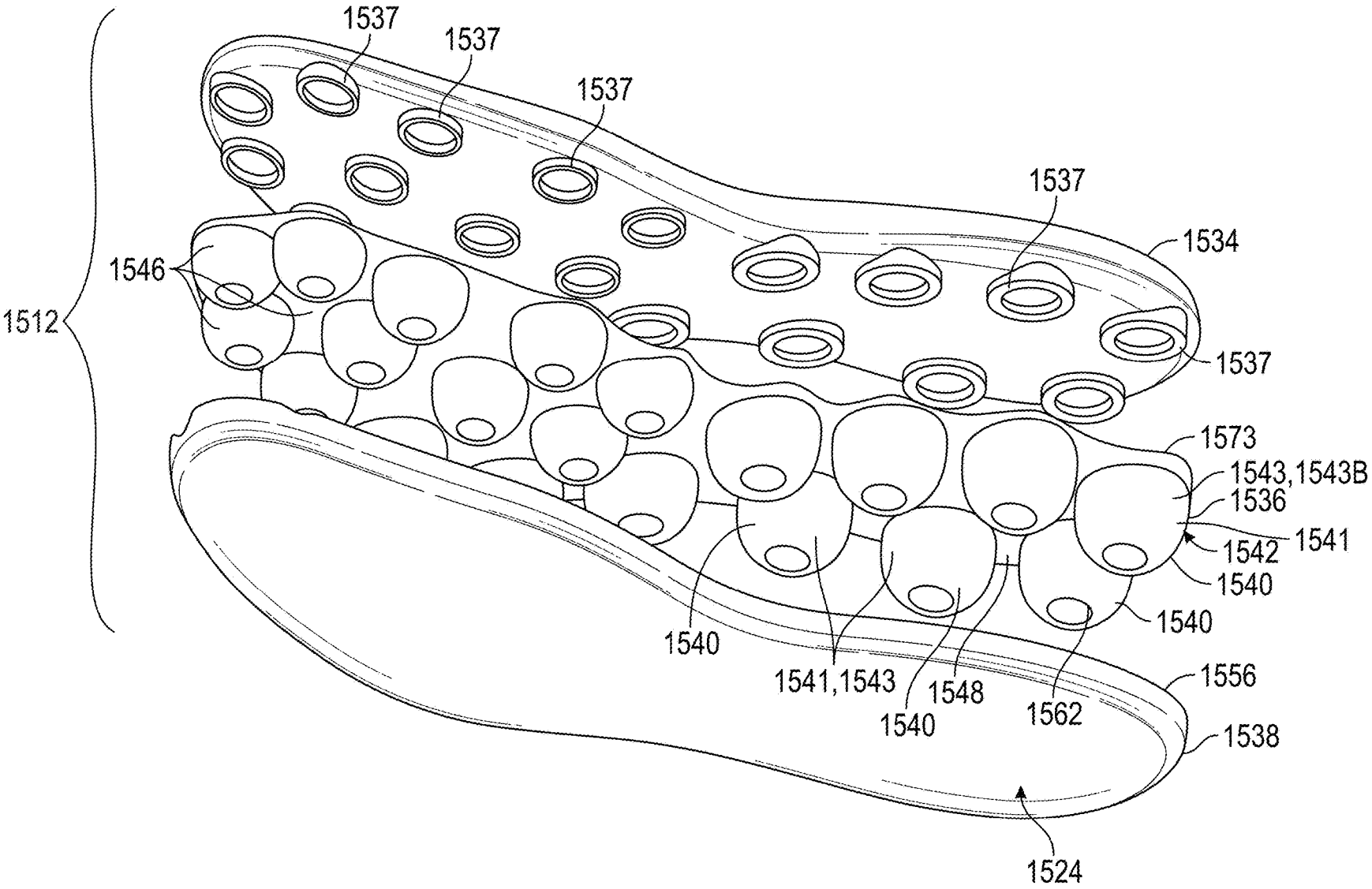
FIG. 45 is a perspective exploded view showing a bottom and medial side of the sole structure of FIG. 44.
Figure 46:
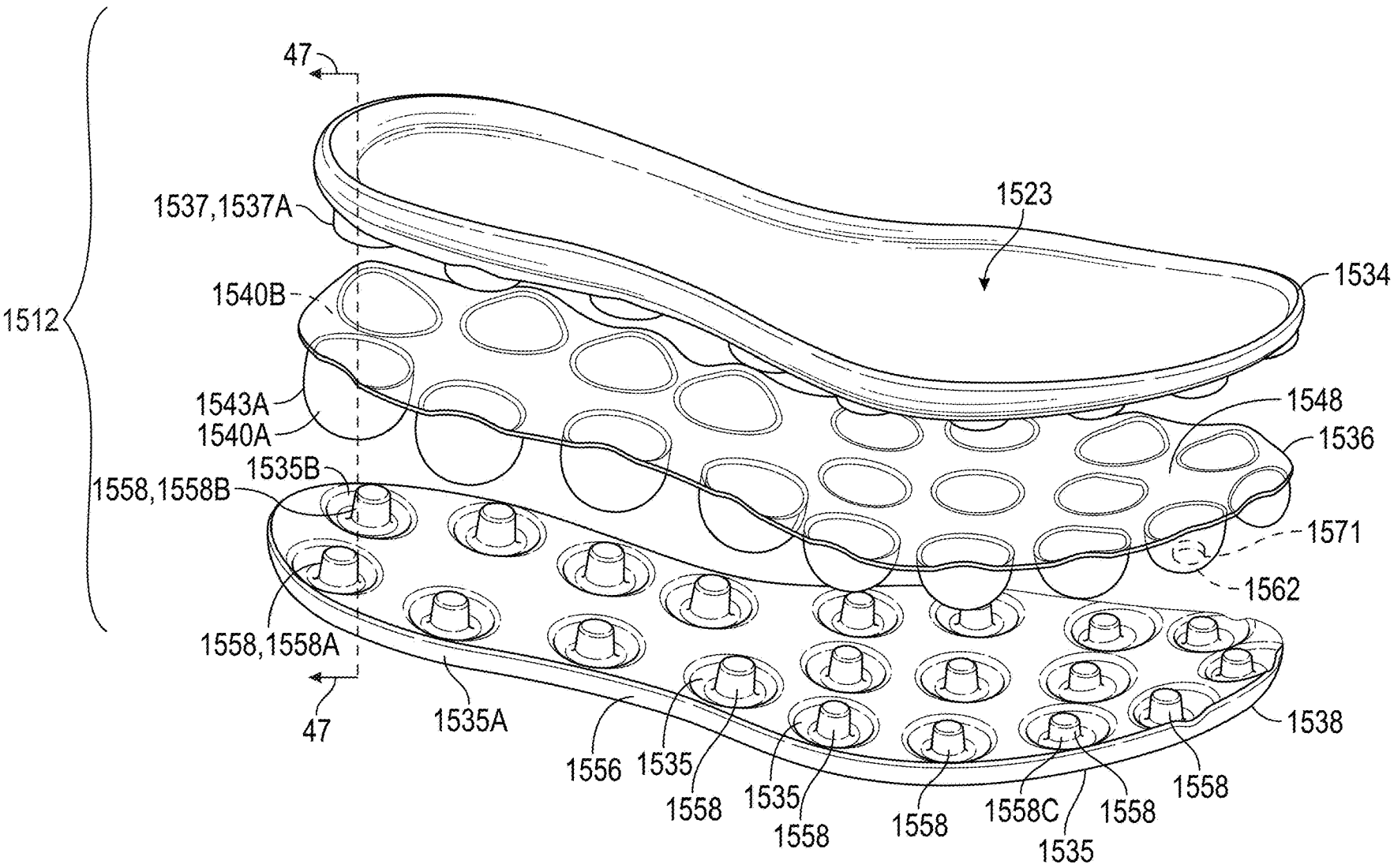
FIG. 46 is a perspective exploded view showing the top and lateral side of the sole structure of FIG. 44.

In order from the top (i.e., the proximal side of the sole structure 1512 nearest the foot-receiving cavity 16 at surface 1523 in FIG. 46) to the bottom (i.e., the distal side of the sole structure 1512 at a ground contact surface 1524 in FIG. 45), the sole structure 1512 includes a first layer 1534, a second layer 1536, and a third layer 1538, each of which is discussed further herein. The third layer 1538 is also referred to herein as a sole component. These components of the sole structure 1512 function as a system having various beneficial properties discussed herein and may be referred to together as a midsole system. Each layer 1534, 1536, and 1538 may alternatively be referred to as a sole layer or as a midsole layer. The first layer 1534 has a proximal surface 1523 on which a foot is supported (or over which other components, such as a strobel, an insole, or a bottom portion of the upper 14 extend). An outsole (not shown) or multiple outsole components may be secured to the bottom of the sole component 1538 or the sole component 1538 may form the ground contact surface 1524 of the sole structure 1512, as shown, functioning as part of the midsole system and also as an outsole.

Each of the first layer 1534, the second layer 1536, and the sole component 1538 extends in the forefoot region 26, the midfoot region 28, and the heel region 30. The first layer 1534 is shown as a foam layer providing resilient cushioning. The first layer 1534 overlies the second layer 1536 and has a distal side interfacing with a proximal side of the second layer 1536 in the forefoot region 26, the midfoot region 28, and the heel region 30. The second layer 1536 underlies the first layer 1534, and has a distal side interfacing with a proximal side of the sole component 1538 in the forefoot region 26, the midfoot region 28, and the heel region 30. The second layer 1536 is configured as a single sheet defining multiple cushioning components 1540, an outer perimeter, also referred to as a perimeter flange 1573, and webbing 1548 between the cushioning components 1540, as shown in FIG. 45. The second layer 1536 is secured to the first layer 1534 at the perimeter flange 1573 and at the webbing 1548. The second layer 1536 may be secured to the sole component 1538 such as by thermal bonding and/or with adhesive, or otherwise, around or at projections 1558 of the second layer 1536.

FIG. 45 is a perspective exploded view showing the bottom and medial side of the sole structure 1512 and FIG. 46 is a perspective exploded view showing the top and lateral side of the sole structure 1512. Each of the first layer 1534 and sole component 1538 is a one-piece foam component that may be injection molded or otherwise formed from any of the elastomeric foam materials described with respect to sole component 38. As shown in FIG. 45, the first layer 1534 has integral annular protrusions 1537 extending at a distal side in each of the forefoot, midfoot, and heel regions, only some of which are labelled with a reference number in FIG. 45. Each of the annular protrusions 1537 align with a respective one of the cushioning components 1540 and extends into a respective chamber 1550 defined by the cushioning component 1540, as shown with respect to two of the annular protrusions 1537A and 1537B extending into the respective chambers 1550A and 1550B of two of the cushioning components 1540A and 1540B in FIG. 47, for example.

Figure 47:
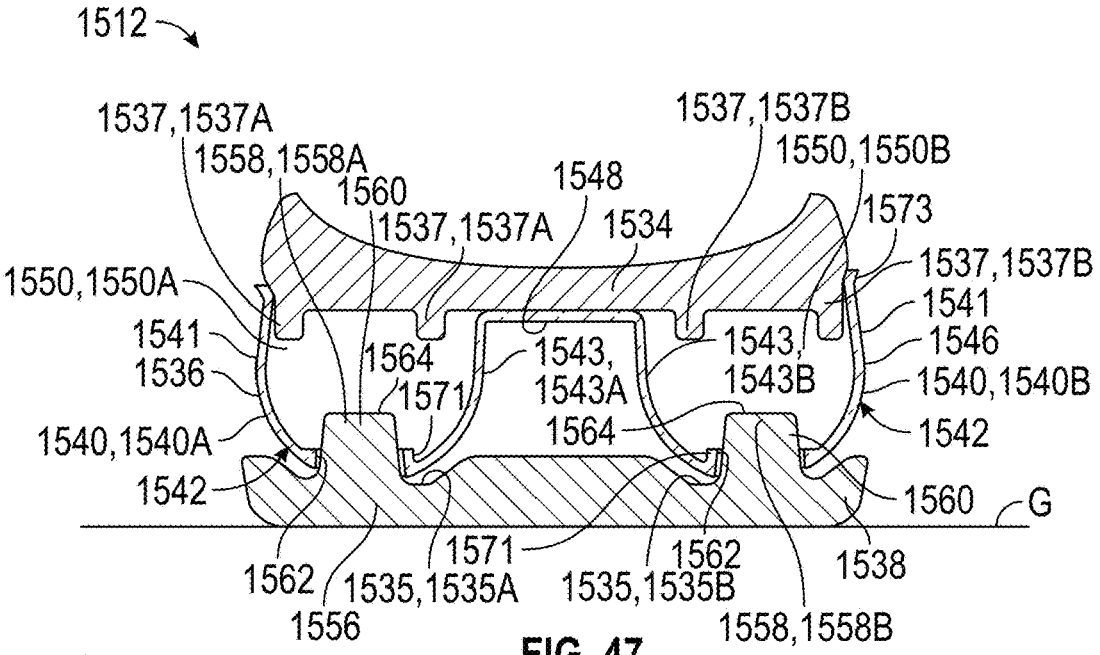
FIG. 47 is a cross-sectional view of the sole structure of FIG. 46 taken at lines 47-47 in FIG. 46.

The second layer 1536 is a single sheet 1546 with an outer surface 1542 defining multiple cushioning components 1540 each defined at a portion of an outer surface 1542 of the second layer 1536. The outer surface 1542 includes the entire outer surface of each of the cushioning components 1540 as well as the outer surface of the remainder of the second layer 1536 (e.g., at the perimeter flange 1573 and webbing 1548 discussed herein). The portion of the outer surface 1542 at each of the cushioning components 1540 has a body 1541 that has a protruding shape 1543 (only some are labelled in FIG. 45) when the cushioning component 1540 is unloaded (e.g., not under a compressive load, as in FIG. 47) or at least in the absence of at least a compressive load of at least a predetermined magnitude on the cushioning component 1540 (e.g., when a compressive load on the cushioning component 1540 is less than a threshold compressive load) as further discussed herein. The protruding shape 1543 may be, but is not limited to, a protruding dome shape. Additionally, each of the cushioning components 1540 includes an aperture 1562 that is surrounded by a lip 1571 that is configured and functions as described with respect to the cushioning component 540. Examples of the lip 1571 is best shown in FIG. 47. Only one lip 1571 is indicated in FIG. 46 for simplicity in the drawings.

In the example shown, the perimeter flange 1573 is secured to the sole layer 1534. The outer perimeter (i.e., the perimeter flange 1573) is nonplanar (e.g., may have different heights at different cross-sections of the sole structure 1512) in order to follow the sides of the first sole layer 1534, for example. For example, the outer perimeter has a curvature that enables the single sheet 1546 to be disposed underfoot in the sole structure 1512, while also wrapping upward along the sides, rear, and/or front of the sole structure 1512, such as onto the sole layer 1534 in FIG. 44.

The sole component 1538 includes a base 1556 that includes multiple projections 1558. Each of the projections 1558 aligns with a respective one of the cushioning components 1540 and extends toward the protruding shape 1543 and, more particularly, through the aperture 1562 of the cushioning component 1540. The sole component 1538, including the projections 1558 and base 1556, may be an elastomeric foam and a unitary foam component (such as a unitary injection-molded foam component) or may be a plurality of fused expanded foam pellets.

The sole component 1538 also forms recesses 1535 that surround the projections 1558. For example, FIG. 47 shows two of the recesses 1535A and 1535B as annular depressions surrounding the respective projections 1558A and 1558B.

In the embodiment shown in FIGS. 44-49, the protruding shapes 1543 of the cushioning components 1540 extend generally downward and the projections 1558 extend generally upward when the sole structure 1512 is incorporated in the article of footwear 1510 and worn on a foot with the sole structure 1512 positioned between the foot and the ground plane G.

As is apparent in FIGS. 44 and 46, the projections 1558 vary in height in at least one of the forefoot region 26, the midfoot region 28, or the heel region 30 of the sole structure 1512 relative to other projections 1558 in the same region or in a different one of the regions. It is apparent, for example, that the projection labeled 1558A in the heel region 30 has a height that is greater than a height of the projection labelled 1558C, which is in the forefoot region 26. The projections 1558 in the heel region 30 may also vary in height from one another, as may the projections 1558 in the forefoot region 26 and/or in the midfoot region 28.

Figure 48:
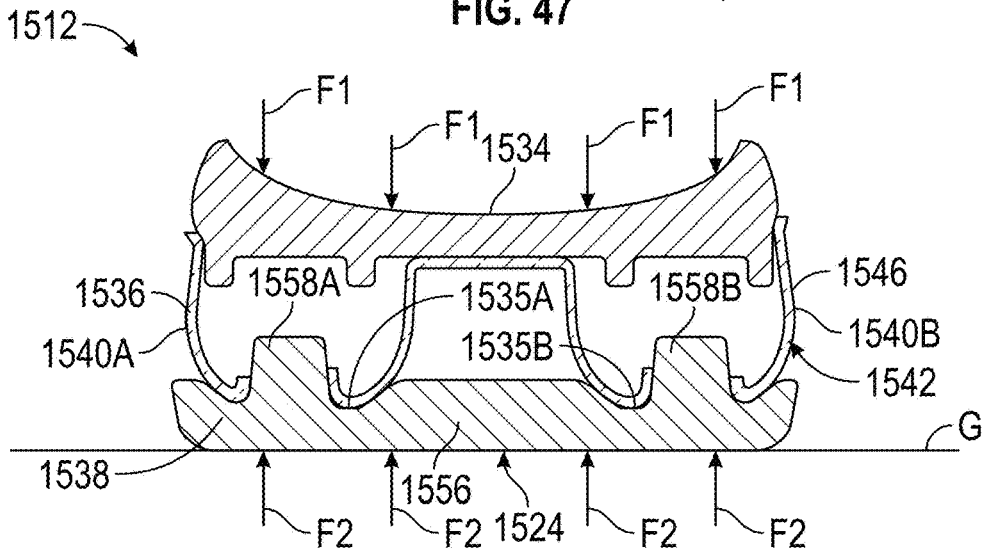
FIG. 48 is a cross-sectional view of the sole structure of FIG. 47 under a compressive load.
Figure 49:
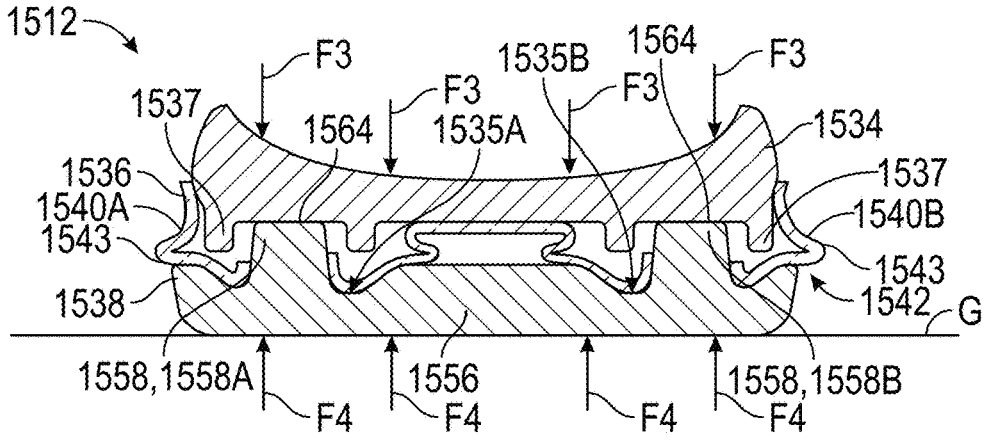
FIG. 49 is a cross-sectional view of the sole structure of FIG. 48 under a compressive load.

FIG. 47 is a cross-sectional view of the sole structure 1512 of FIG. 46 taken at lines 47-47 in FIG. 46 and in the absence of at least a threshold compressive load. FIG. 48 shows the sole structure 1512 under a compressive load of at least a threshold compressive load. FIG. 49 shows the sole structure 1512 under a greater compressive load than in FIG. 48.

FIG. 47 shows the projections 1558A, 1558B extending into the respective chambers 1550A, 1550B defined by the respective protruding shapes 1543A, 1543B. The chambers 1550A, 1550B are shown isolated from one another by the webbing 1548 but, in other configurations, could be in communication with one another. Although shown slightly spaced apart from the projections 1558A, 1558B for purposes of illustration, the lips 1571 of the respective cushioning components 1540A, 1540B may be adhered or otherwise bonded to the projections 1558A, 1558B. Additionally, a portion of the outer surface 1542 of the protruding shapes 1543A, 1543B near the lips 1571 may be adhered or otherwise bonded to the sole component 1538 in the recesses 1535A, 1535B, respectively.

A respective protruding shape 1543 compresses around and is made to at least partially invert by the sole component 1538 when the sole structure 1512 is under a compressive load of at least a predetermined magnitude at that cushioning component 1540 (referred to herein as a threshold compressive load), such as it may be when under dynamic compressive loading due to impact of the ground contact surface 1524 of the sole structure 1512 with the ground plane G. The cushioning component 1540 resiliently deforms, with the inverted portion of the outer surface 1542 reverting back to the protruding shape 1543 as the cushioning component 1540 is unloaded (e.g., the magnitude of the compressive load lessens) as shown and discussed with respect to FIGS. 47-49. As configured, the protruding shapes 1543 each have a base portion subjected to hoop tensile forces and a crown portion subjected to hoop compressive forces under compressive loading as described with respect to the cushioning component 40.

The projections 1558, such as projections 1558A and 1558B include a stem 1560 that is relatively circular at a cross-section taken perpendicular to its height, and may taper slightly in width from a width at the base 1556 to a narrowest portion at the end 1564 of the respective stem 1560. Although the projections 1558 are not shown with enlarged heads within the chambers 1550, in another example, the stems 1560 may each have an enlarged head at the end 1564 of the stem 1560 that seal the chamber 1550 at the aperture. The aperture 1562 may be sealed to the projection 1558 in some examples, or not sealed, such that the chamber 1550 is open to atmosphere.

FIG. 48 shows the portion of the sole structure 1512 of FIG. 47 under an example of compressive loading with a downward load F1 distributed on the first layer 1534 by the weight of the wearer during impact with the ground plane G and a reaction load F2 of the same magnitude as the downward load F1 resulting from the ground plane G acting on the ground contact surface 1524 of the sole component 1538. Depending on their relative stiffnesses, compression of the first layer 1534, the cushioning components 1540 of the second layer 1536, and the sole component 1538 will progress serially or in parallel. The performance of the sole structure 1512 under compressive loading is described with respect to the cushioning components 1540A and 1540B but applies equally to each of the cushioning components 1540 when loaded as described.

Assuming that the compressive load F1 is at least the predetermined magnitude, the cushioning components 1540A, 1540B will begin to compress around the projections 1558A, 1558B and further against and onto the base 1556 in the recesses 1535A, 1535B as shown in FIG. 48. Specifically, the outer surface 1542 of the sheet 1546 at the protruding shapes 1543 of the cushioning components 1540 compresses against the base 1556.

As compressive loading progresses, such as under a compressive load F3 greater than compressive load F1, and equal reaction load F4, shown in FIG. 49, the protruding shape 1543 of the outer surface 1542 of each of the cushioning components 1540A, 1540B that is subjected to the compressive load F3 partially inverts with the outer surface 1542 resting against the surface of the base 1556 at the recesses 1535A, 1535B surrounding the projections 1558A, 1558B.

As shown, the ends 1564 of the projections 1558 may interface with the first layer 1534 within the annular protrusions 1537. Stated differently, the projections 1558 will bear loading of the first layer 1534 (e.g., the inverted protruding shapes 1543 are sufficiently reduced in height so that the projections 1558 touch the distal surface of the first layer 1534). Upon removal of the compressive load (and reaction load), the inverted portion of the outer surface 1542 reverts back to the protruding dome shapes 1543.

In some implementations, an additional resilient member, such as a resilient foam member or a bladder, may be disposed within the chamber 1550 of one or more of the protruding shapes 1543 around the projection 1558 to assist the inverted portion to revert back to the protruding shape 1543 when the compressive load is removed.

The compression profile of the sole structure 1512 at one of the cushioning components 1540 may include a constant stiffness (e.g., a linear rate of change of load to displacement) during an initial stage of compression, a slight drop in stiffness when the protruding shape 1543 inverts around the projection 1558, and then a non-linear stiffness, such as an exponentially increasing rate of change of load to displacement in compression as the outer surface 1542 of the cushioning component 1540 "bottoms out" against the base 1556 of the sole component 1538 and the projection 1558 interfaces with the first sole layer 1534.

Each protruding shape 1543 has a protruding dome width as described with respect to the embodiment of FIG. 6. Like the sole structure 12, a ratio of the projection width of a projection 1558 to the protruding dome width of a protruding shape 1543 may vary in at least one of the forefoot region 26, the midfoot region 28, or the heel region 30 of the sole structure 1512. Like the sole structure 12, the ratio of the projection width of the projections 1558 to the protruding dome width of the cushioning components 1540 of the sole structure 1512 may vary between one of the forefoot region 26, the midfoot region 28, or the heel region 30 and at least one different one of the forefoot region 26, the midfoot region 28, or the heel region 30. Moreover, the volume and/or width and/or height of the projections 1558 may vary in any of or between any of the forefoot region 26, the midfoot region 28, and the heel region 30.

Figure 33:
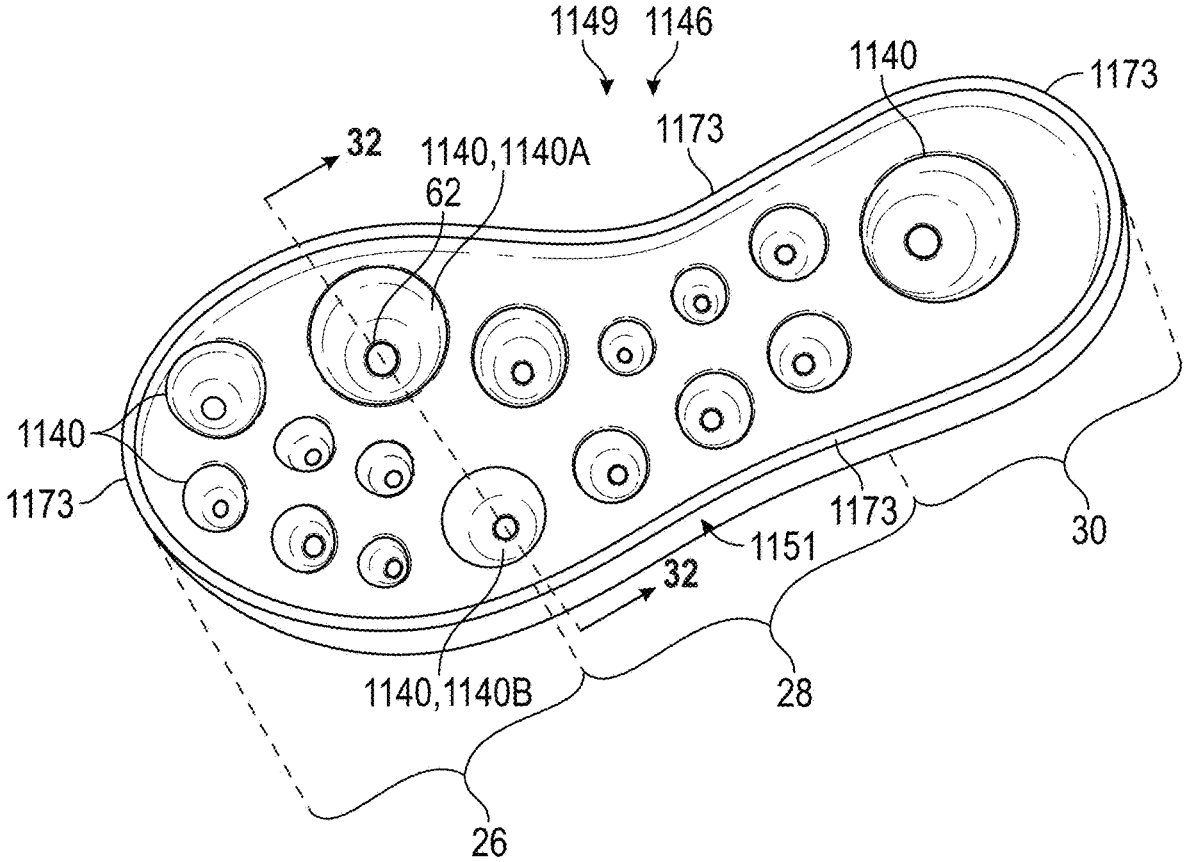
FIG. 33 is a perspective view of the sheet of FIG. 32.

A thickness of the single sheet 1546 may be greater along laterally-outward portions of the cushioning components 1540 (e.g., portions that border the medial or lateral sides or the front or rear of the sole structure 1512) than along laterally inward portions, as shown and described with respect to the sheet 1146 of FIGS. 32-33.

Figures 50, 51, 52, 53, 54:
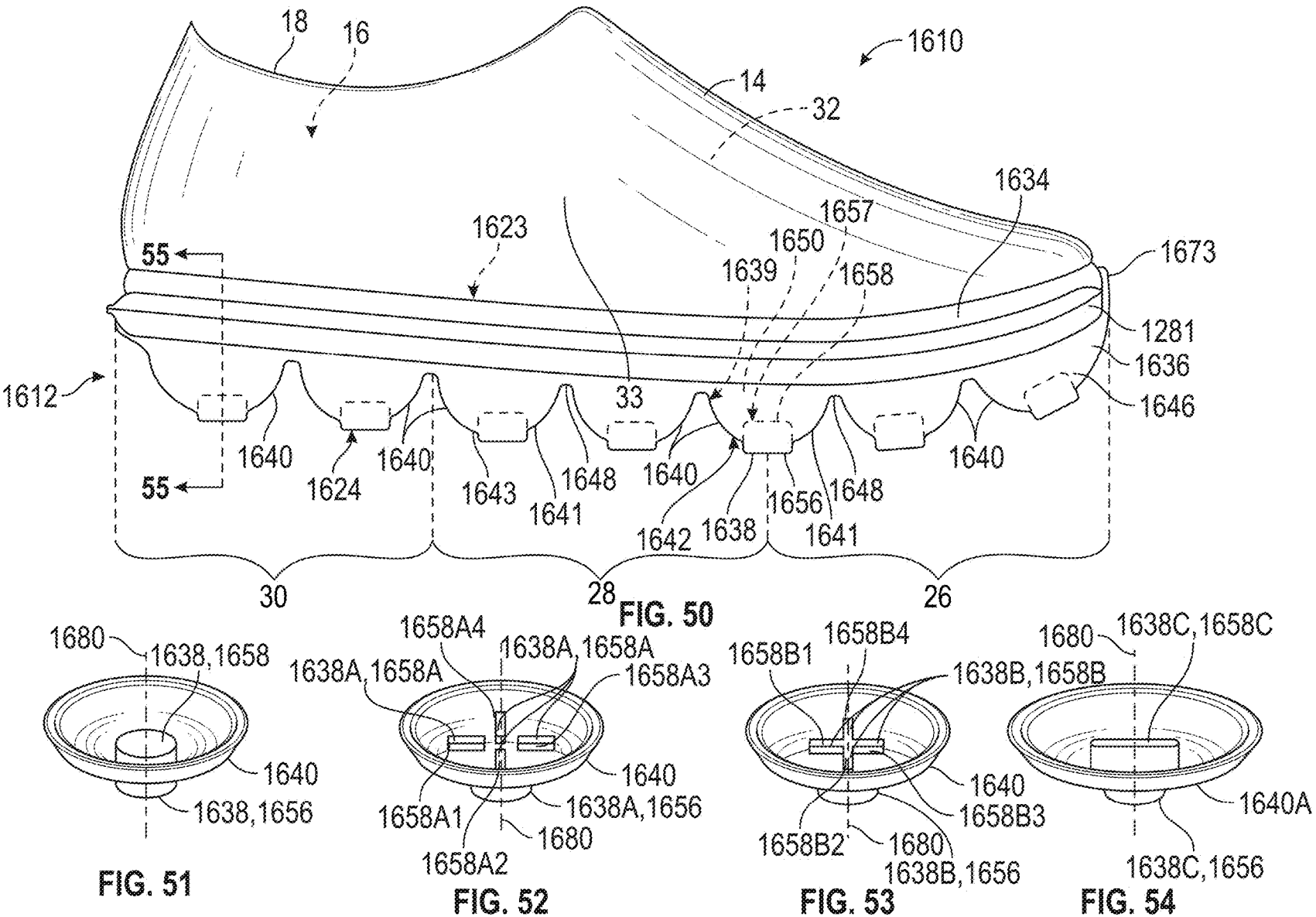
FIG. 50 is lateral side view of an article of footwear including a sole structure having a sole layer with a plurality of cushioning components, each having a sole component including a projection.
FIG. 51 is a perspective view of an example of a cushioning component, sole component, and projection as a monolithic structure for the sole structure of FIG. 50.
FIG. 52 is a perspective view of another example of a cushioning component, sole component, and projection as a monolithic structure for the sole structure of FIG. 50.
FIG. 53 is a perspective view of another example of a cushioning component, sole component, and projection as a monolithic structure for the sole structure of FIG. 50.
FIG. 54 is a perspective view of another example of a cushioning component, sole component, and projection as a monolithic structure for the sole structure of FIG. 50.

FIG. 50 is lateral side view of another article of footwear 1610 including a sole structure 1612 and an upper 14 secured to the sole structure 1612. The upper 14 is as described with respect to the article of footwear 10 of FIG. 1. The article of footwear 1610 includes a forefoot region 26, a midfoot region 28, a heel region 30, a medial side 32 and a lateral side 33, as described with respect to the article of footwear 10.

Figure 55:
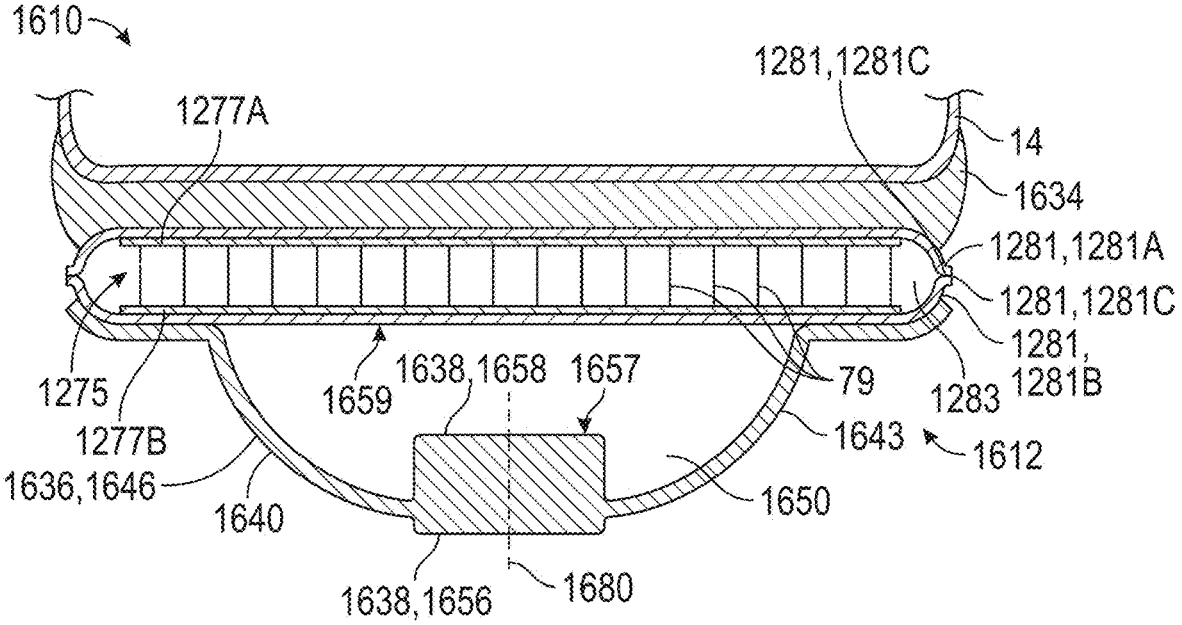
FIG. 55 is a cross-sectional view of the article of footwear of FIG. 50 taken at lines 55-55 in FIG. 50 in an unloaded state.

In order from the top (i.e., the proximal side of the sole structure 1612 nearest the foot-receiving cavity 16) to the bottom (i.e., the distal side of the sole structure 1612 at a ground contact surface 1624), the sole structure 1612 includes three sole layers including a cushioning layer 1634, the bladder 1281 as previously described, and a sole layer 1636, each of which is discussed further herein. As shown in FIG. 55, the bladder 1281 includes the first and second polymeric sheets 1281A, 1281B that are bonded to one another at the peripheral flange 1281C to define the internal cavity 1283 configured to retain a fluid at or above ambient pressure, and the tensile component 1275 is disposed within the internal cavity 1283 and secured to opposing inner surfaces of the bladder 1281. The tensile component 1275 includes the first and second tensile layers 1277A and 1277B and the tethers 79.

Alternatively, the bladder 1281 may be replaced by another sole layer, such as another foam sole layer. Still further, the bladder 1281 may be replaced by a bladder that does not include a tensile component Each of the cushioning layer 1634, the bladder 1281, and the sole layer 1636 extends in the forefoot region 26, the midfoot region 28, and the heel region 30. The cushioning layer 1634 may be foam, provides resilient cushioning, and overlies the bladder 1281 with a distal side interfacing with a proximal side of the bladder 1281 in the forefoot region 26, the midfoot region 28, and the heel region 30. The cushioning layer 1634 has a proximal surface 1623 on which a foot is supported (or over which other components, such as a strobel, an insole, or a bottom portion of the upper 14 extend). The bladder 1281 underlies the cushioning layer 1634, and has a distal side interfacing with a proximal side of the sole layer 1636 in the forefoot region 26, the midfoot region 28, and the heel region 30.

The sole layer 1636 is configured as a single sheet 1646 defining multiple cushioning components 1640, an outer perimeter, also referred to as a perimeter flange 1673, and webbing 1648 between the cushioning components 1640 (only some of the webbing 1648 is labelled). In other examples, some or all of the cushioning components 1640 need not be integral portions of the same sheet as the other cushioning components 1640. The sole layer 1636 is secured to the cushioning 1634 at the perimeter flange 1673 and at the webbing 1648 such as by thermal bonding and/or with adhesive, or otherwise.

Each of the multiple cushioning components 1640 has a body 1641 with a protruding shape 1643 (only one labelled as such in FIG. 50). Additionally, a respective sole component 1638 is disposed at the lower part of the body 1641 of each cushioning component 1640. More specifically, in the embodiment shown, a respective sole component 1638 is included as an integral part of each cushioning component 1640. Each sole component 1638 includes a projection 1658 and a ground-facing portion 1656 that are integral, monolithic parts of the cushioning component 1640 as a single unitary structure. That is, the single sheet 1646 that defines the cushioning components 1640 also defines the sole components 1638, including the projections 1658 and the ground-facing portions 1656. Each projection 1658 protrudes from an inner surface 1639 of a respective cushioning component 1640 into a chamber 1650 defined by the cushioning component 1640.

The ground-facing portion 1656 protrudes outward from the outer surface 1642 of the body 1641 of the cushioning component 1640. An outsole (not shown) or multiple outsole components may be secured to the bottom of the ground-facing portions 1656 or the ground-facing portions 1656 may form part of the ground contact surface 1624 of the sole structure 1612, as shown, functioning as part of the midsole system and also as an outsole.

The cushioning layer 1634, the bladder 1281, and the sole layer 1636 of the sole structure 1612 function as a system having various beneficial properties discussed herein and may be referred to together as a midsole system. Each of the cushioning layer 1634, the bladder 1281, and the sole layer 1636 may alternatively be referred to as a sole layer or as a midsole layer.

Figure 56:
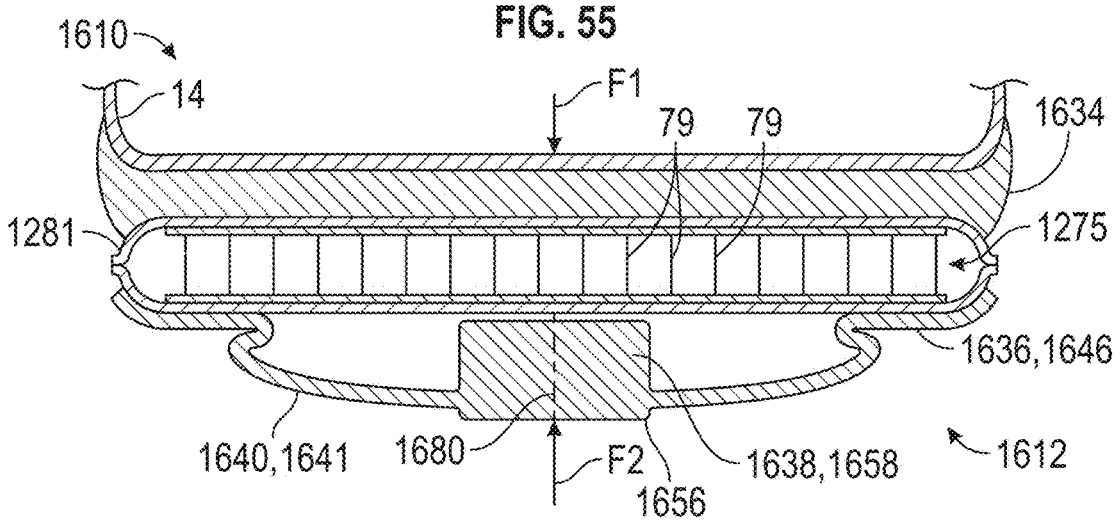
FIG. 56 is a cross-sectional view of the article of footwear of FIG. 55 in a loaded state under a compressive load of a predetermined magnitude.
Figure 57:
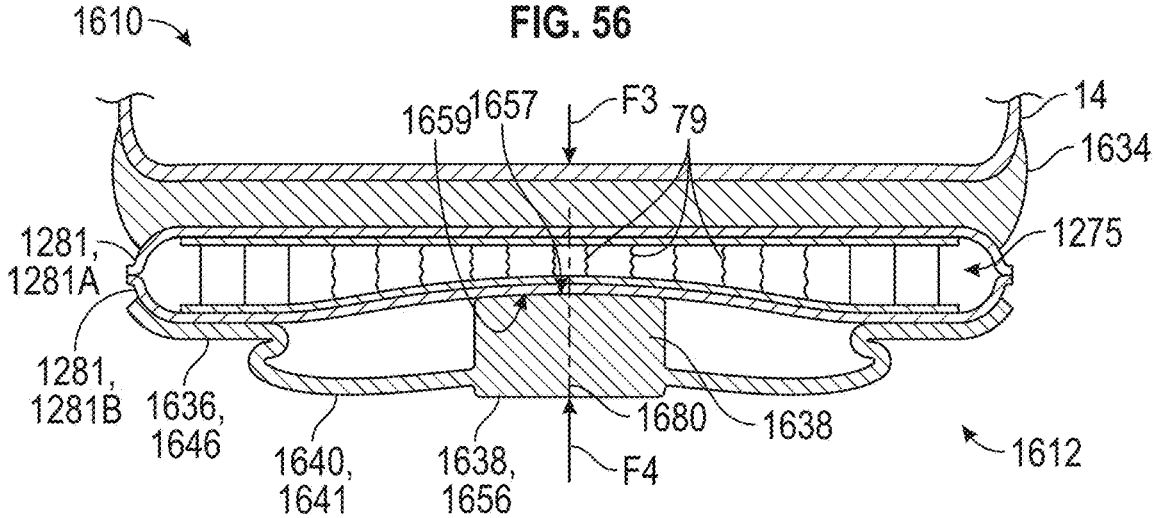
FIG. 57 is a cross-sectional view of the article of footwear of FIG. 55 in a loaded state under a compressive load greater than that of FIG. 56.

Under at least a predetermined threshold compressive load F1 and equal reaction load F2 (see FIG. 56) on a cushioning component 1640, the body 1641 will resiliently deform, and, under an increasing load F3 and equal reaction load F4 (see FIG. 57), move the projection 1658 into contact with the bladder 1281 as discussed with respect to FIGS. 55-57. At least where the projection 1658 contacts the bladder 1281, at least the directly overlying tethers 79 will go slack, as shown in FIG. 57. The projections 1658 may thus be referred to as actuators, as they actuate compression of the bladder 1281.

Accordingly, the cushioning profile (compressive force versus vertical displacement (e.g., compression)) of the sole structure 1612 includes a stage of deformation that may be generally linear as the protruding shape 1643 of the body 1641 compresses around the projection 1658, at least partially inverting the protruding shape 1643 by deforming and/or buckling, as shown in FIG. 56. In this stage, the initial contact load F1 and reaction load F2 is spent deforming the protruding shape 1643. This stage may be before, after, or concurrent with resilient deformation by compression of the foam cushioning layer 1634. During this stage, an upper surface 1657 (also referred to as a proximal surface) of the projection 1658 is spaced apart from and not in contact with the bladder 1281 because the height of the projection 1658 is less than a full height of the chamber 1650 in an unloaded state of the sole structure 1612.

After at least some deformation of the protruding shape 1643 (e.g., upon sufficient inversion of the protruding shape 1643), a subsequent stage of deformation illustrated in FIG. 57 begins under a greater compressive load F3 and reaction load F4 causing the projection 1658 to move into contact with the bladder 1281 (e.g., by the upper surface 1657 contacting the lower surface 1659 of the bladder 1281 at the second polymeric sheet 1281B, with the projection 1658 thereby transferring the compressive load F4 through the projection 1658 to the bladder 1281 and resiliently deforming the bladder 1281.

The energy return of the compressed bladder 1281 upon reduction of the compressive load may be influenced in part by how the compressive load is distributed to the bladder 1281. In other words, the pattern of tethers 79 forced to go slack by the projection 1658 may influence the energy return and is a result of the shape of the projection 1658. Projections having a shape that results in a greater ratio of the slack tethers in closer proximity to less slack or completely tensioned tethers may create a greater energy return, as the slack tethers may be more strongly urged to return to the tensioned state by the greater ratio of neighboring less slack or completely tensioned tethers. For example, if the tethers are distributed in rows, and a slack tether in one row is adjacent to a tensioned tether in another row rather than adjacent to another slack tether, the adjacent tensioned tether may help to urge the slack tether to return to the tensioned state more quickly upon removal of the compressive load.

FIG. 51 is a perspective view of an example of one of the cushioning components 1640 showing the sole component 1638 including the projection 1658 as a monolithic structure. The projection 1658 has a cylindrical shape around a center axis 1680 of the projection 1658. With reference to FIG. 56, the projection 1658 is shown still spaced apart from the bladder 1281 after deformation of the protruding shape 1643 by the predetermined threshold compressive load F1 and reaction load F2, and then moving into contact with the bladder 1281 at a compressive load F3 and reaction load F4 greater than the threshold compressive load F1 and reaction load F2 at which the protruding shape 1643 deforms. The projection 1658 moves along the center axis 1680 and, due to its cylindrical shape, tends to concentrate compression of the bladder 1281 creating a generally cone-shaped indentation in the bladder 1281 representing the area having tethers 79 that are made slack by the contact of the projection 1658 with the bladder 1281. With the most compressed portion of the bladder 1281 heavily concentrated above the projection 1658 and completely surrounded by other at least partially slack tethers 79, the energy return may be less rapid and/or more concentrated than in comparison to energy return with a projection having a shape that causes greater disbursement and less concentration of slackened tethers 79.

For example, FIG. 52 is a perspective view of another example of a cushioning component 1640 and sole component 1638A having the same ground-facing portion 1656 and a different projection 1658A as a monolithic structure for the sole structure 1612 of FIG. 50. The projection 1658A is noncylindrical about the center axis 1680 along which the sole component 1638A moves toward (and into contact with) and away from the bladder 1281. More specifically, the projection 1658A includes four arms 1658A1, 1658A2, 1658A3, and 1658A4 arranged equally spaced from one another in an array about the center axis 1680. Because the four arms 1658A1, 1658A2, 1658A3, and 1658A4 are discrete and not connected with one another (other than via the body 1641), the arms 1658A1, 1658A2, 1658A3, and 1658A4 may be considered four separate projections. Tethers between the arms 1658A1, 1658A2, 1658A3, and 1658A4 will not be slackened or will be less slackened than those directly above where the arms contact the bladder 1281. Additionally, the arms 1658A1, 1658A2, 1658A3, and 1658A4 extend further from the center axis 1680 than does the projection 1658. The geometry of the projection 1658A may cause a quicker return of the slacked tethers 79 of the bladder 1281 to their unloaded geometry and/or a compression and return over a broader surface area than would the projection 1658.

FIG. 53 is a perspective view of another example of a cushioning component 1640 and sole component 1638B having the same ground-facing portion 1656 and a different projection 1658B as a monolithic structure for the sole structure 1612 of FIG. 50. The projection 1658B is noncylindrical about the center axis 1680 along which the sole component 1638B moves toward (and into contact with) and away from the bladder 1281. The projection 1658B is configured with four spaced arms 1658B1, 1658B2, 1658B3, and 1658B4 similar to arms 1658A1, 1658A2, 1658A3 and 1658A4 except that the arms 1658B1, 1658B2, 1658B3, and 1658B4 are connected to one another at the center axis 1680, forming a single projection rather than for discrete projections. The projection 1658B has the same advantages as described with respect to the projection 1658A.

FIG. 54 is a perspective view of another example of a cushioning component 1640A and sole component 1638C having the same ground-facing portion 1656 and a different projection 1658C as a monolithic structure for the sole structure 1612 of FIG. 50. The projection 1658C is noncylindrical about the center axis 1680 along which the sole component 1638C moves toward (and into contact with) and away from the bladder 1281. Additionally, the cushioning component 1640A is elongated relative to the cushioning components 1640 of FIGS. 51-53, having a more oval shape. Generally, an elongated cushioning component 1640 has a protruding shape that is less dome-like and may deform more easily than a dome-like protruding shape having the same pressure in the internal chamber. The elongated cushioning component 1640A may tend to more easily deform at its midsection than near its two rounded ends.

Figure 58:
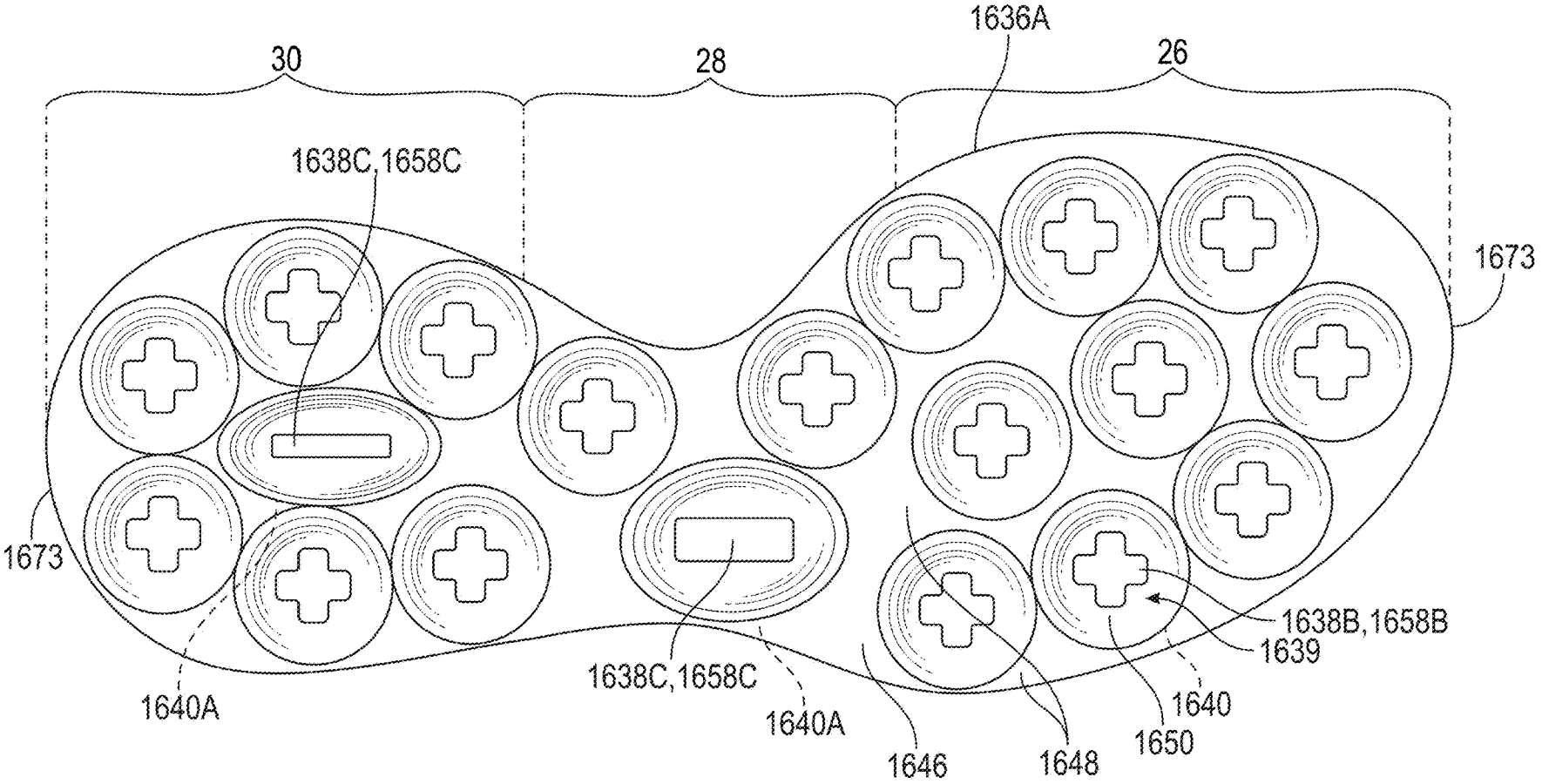
FIG. 58 is a top view of an alternative sole layer for the sole structure of FIG. 50 including a plurality of cushioning components each having a sole component and projection as a monolithic structure.

FIG. 58 is a top view of an alternative sole layer 1636A that may be used as an alternative to the sole layer 1636 in FIG. 50. The sole layer 1636A includes multiple cushioning components 1640, some of which are labeled 1640A, that each having a sole component (some labelled 1638B, 1638C) with a ground-facing portion protruding outward from the outer surface of the cushioning component like ground-facing portion 1656 of FIGS. 51-54) (not shown in the top view of FIG. 58) and a projection protruding inward from the inner surface 1639 of the cushioning component into the chamber 1650 (e.g., some projections 1658B, 1658C are labelled) as a monolithic structure. As shown, the projections as well as the cushioning components may have different shapes and sizes in the forefoot region 26, the midfoot region 28, and/or the heel region 30 to respond to different loading patterns in the regions 26, 28, and 30 and influence energy return in the regions 26, 28, and 30.

The sole structures and sole layers disclosed herein thus enable targeted and tuned cushioning via the geometry of the protruding dome shapes of the cushioning components as well as the geometry of the projections and the base of the sole layer that interface with the protruding dome shapes. The protruding dome shapes repeatedly invert and revert due to the projections upon compressive loading and unloading of the sole structure.

The following Clauses provide example configurations of a sole structure for an article of footwear, a method of manufacturing a sole structure, and an article of footwear disclosed herein.

Clause 1. A sole structure for an article of footwear comprising: a cushioning component having an outer surface and at least partially defining a chamber at least partially surrounded by the outer surface, at least a portion of the outer surface having a protruding shape in the absence of a compressive load of at least a predetermined magnitude on the cushioning component; and a sole component including a projection that either: extends through an aperture in the outer surface of the cushioning component and within the chamber; or interfaces with a recess in the outer surface of the cushioning component; or protrudes from an inner surface of the cushioning component into the chamber.

Clause 2. The sole structure of clause 1, wherein: the sole component includes a base; the projection extends from the base; and the outer surface of the cushioning component compresses against the base.

Clause 3. The sole structure of clause 2, wherein at least a portion of the projection gradually tapers in width from the base toward the protruding shape.

Clause 4. The sole structure of any of clauses 1-3, wherein the projection partially inverts the protruding shape of the outer surface of the cushioning component under the compressive load, the outer surface of the cushioning component compressing on and/or around the projection, and the outer surface of the cushioning component reverting back to the protruding shape upon removal of the compressive load.

Clause 5. The sole structure of clause 4, wherein: the protruding shape of the outer surface of the cushioning component is a protruding dome shape that includes a base portion subjected to hoop tensile forces under compressive loading and a crown portion extending outward from the base portion and subjected to hoop compressive forces under compressive loading; and the crown portion inverts relative to the base portion under the compressive load and resiliently returns to extending outward from the base portion upon removal of the compressive load.

Clause 6. The sole structure of any of clauses 1-3, wherein the cushioning component includes a lip surrounding the aperture at the chamber.

Clause 7. The sole structure of clause 6, wherein the lip extends inward into the chamber.

Clause 8. The sole structure of any of clauses 1-3, wherein a portion of the projection extending within the chamber is wider than the aperture.

Clause 9. The sole structure of clause 8, wherein the projection is bonded to an inner surface of the chamber and seals the aperture.

Clause 10. The sole structure of any of clauses 1-3, further comprising: a bladder disposed within the chamber; the bladder optionally including a tensile component secured to opposing inner surfaces of the bladder.

Clause 11. The sole structure of clause 10, wherein: the aperture in the outer surface of the cushioning component is a first aperture; the bladder defines a second aperture extending at least partially through the bladder; and the projection extends through the first aperture and into the second aperture.

Clause 12. The sole structure of clause 10, further comprising: a sole layer positioned with the cushioning component between the sole layer and the sole component; and wherein the bladder is secured to at least one of the sole layer or the cushioning component.

Clause 13. The sole structure of clause 10, wherein the bladder is a first bladder, and further comprising: a second bladder disposed external to the chamber and adjacent to the protruding shape; wherein the second bladder optionally includes a second tensile component secured to opposing inner surfaces of the second bladder.

Clause 14. The sole structure of clause 13, wherein the second bladder defines a third aperture, and the protruding shape compresses against the second bladder around the third aperture under the compressive load.

Clause 15. The sole structure of any of clauses 1-3, further comprising: a bladder disposed external to the chamber and adjacent to the protruding shape; the bladder optionally including a tensile component secured to opposing inner surfaces of the bladder.

Clause 16. The sole structure of any of clauses 1-3, wherein the sole component is a first sole layer and the projection is an integral extension of the first sole layer; and the sole structure further comprising: a second sole layer disposed such that the cushioning component is between the first sole layer and the second sole layer; and wherein the projection extends through the aperture in the protruding shape and is secured to the second sole layer.

Clause 17. The sole structure of any of clauses 1-3, wherein: the cushioning component includes a body defining the chamber and the outer surface with the protruding shape; the body has an annular sidewall section that has an equilibrium state at a first position and at a first angle relative to a longitudinal axis of the body in an expanded configuration of the cushioning component; the annular sidewall section is configured to elastically deform by snap-through buckling to a collapsed configuration when under the compressive load; and the body has a first length along the longitudinal axis of the body in the expanded configuration and a second length along the longitudinal axis of the body in the collapsed configuration, the second length less than the first length.

Clause 18. The sole structure of clause 17, wherein the body provides a haptic indicator of the snap-through buckling.

Clause 19. The sole structure of any of clauses 17-18, wherein: the annular sidewall section is a first annular sidewall section, and the body further includes a second annular sidewall section spaced apart from the first annular sidewall section along the longitudinal axis of the body; wherein the second annular sidewall section has an equilibrium state disposed at a second angle relative to the longitudinal axis of the body in the expanded configuration of the cushioning component, wherein a magnitude of the first angle is different than a magnitude of the second angle such that the second annular sidewall section is configured to elastically deform by snap-through buckling to a collapsed configuration when under a compressive load of a different magnitude than the compressive load at which the first annular sidewall section elastically deforms.

Clause 20. The sole structure of any of clauses 17-18 further comprising: a resilient member disposed within the chamber.

Clause 21. The sole structure of any of clauses 1-3, wherein the recess is concave and a portion of the projection interfacing with the recess is convex.

Clause 22. The sole structure of any of clauses 1-3, wherein the chamber is sealed and is at a pressure above ambient pressure when in an unloaded state.

Clause 23. The sole structure of any of clauses 1-3, wherein the chamber is at ambient pressure when in an unloaded state.

Clause 24. The sole structure of any of clauses 1-3, wherein the protruding shape is a first protruding shape, and the outer surface of the cushioning component has a second protruding shape extending outward in a direction opposite from the first protruding shape.

Clause 25. The sole structure of clause 24, wherein the cushioning component includes a first sheet defining the first protruding shape and a second sheet fixed to the first sheet and defining the second protruding shape.

Clause 26. The sole structure of any of clauses 1-3, wherein the protruding shape extends toward the projection when the sole structure is incorporated in an article of footwear and worn on a foot with the sole structure positioned between the foot and a ground plane.

Clause 27. The sole structure of any of clauses 1-3, wherein: the cushioning component is one of a plurality of cushioning components included in the sole structure, each having an outer surface at least a portion of which has a protruding shape in the absence of a compressive load of at least a respective predetermined magnitude on the cushioning component; and the projection is one of a plurality of projections included in the sole component, each of the projections paired with a respective one of the cushioning components such that the projection extends through the outer surface of the respective one of the cushioning components or interfaces with a recess in the outer surface of the respective one of the cushioning components such that the respective one of the cushioning component compresses around the projection upon application of the compressive load of at least the respective predetermined magnitude on the respective one of the cushioning components, at least partially inverting the protruding shape of the respective one of the cushioning components.

Clause 28. The sole structure of clause 27, wherein the protruding shape of at least one of the cushioning components is a protruding dome shape.

Clause 29. The sole structure of clause 27, wherein: the projections vary in height in at least one of a forefoot region, a midfoot region, or a heel region of the sole structure; and/or a height of at least one of the projections in the forefoot region, the midfoot region, or the heel region is different than a height of at least one of the projections in a different one of the forefoot region, the midfoot region, or the heel region.

Clause 30. The sole structure of clause 27, wherein: each projection has a projection width at the outer surface of the respective one of the cushioning components toward which the projection extends; and each protruding shape of the outer surface of the respective one of the cushioning components toward which the projection extends has a protruding shape width; a ratio of the projection width of the projection to the protruding shape width of the cushioning component with which the projection is paired: varies in at least one of a forefoot region, a midfoot region, or a heel region of the sole structure; and/or varies between one of the forefoot region, the midfoot region, or the heel region and at least one different one of the forefoot region, the midfoot region, or the heel region.

Clause 31. The sole structure of clause 27, wherein: each projection has an area of interface with the outer surface of the respective one of the cushioning components toward which the projection extends; and each protruding shape of the outer surface of the respective one of the cushioning components toward which the projection extends has a protruding shape surface area; a ratio of the area of interface of the projection to the protruding shape surface area of the cushioning component with which the projection is paired: varies in at least one of a forefoot region, a midfoot region, or a heel region of the sole structure; and/or varies between one of the forefoot region, the midfoot region, or the heel region and at least one different one of the forefoot region, the midfoot region, or the heel region.

Clause 32. The sole structure of clause 27, wherein each of the projections is round in a cross-section perpendicular to a length of the projection.

Clause 33. The sole structure of clause 27, wherein each of the cushioning components defines at least a portion of the chamber or defines a separate chamber in fluid communication with the chamber.

Clause 34. The sole structure of clause 27, wherein each of the cushioning components defines at least a portion of the chamber or defines a separate chamber fluidly-isolated from the chamber.

Clause 35. The sole structure of clause 27, wherein each cushioning component of the plurality of cushioning components is an integral portion of a single sheet.

Clause 36. The sole structure of clause 35, wherein the single sheet includes an outer perimeter that is nonplanar.

Clause 37. The sole structure of clause 35, wherein: a thickness of the single sheet is greater along a first portion of one of the cushioning components than along a second portion the cushioning component; and the first portion is nearer to an outer perimeter of the sole structure than to a center of the sole structure.

Clause 38. A sole structure for an article of footwear comprising: a sole layer including a cushioning component having an outer surface and at least partially defining a chamber at least partially surrounded by the outer surface, at least a portion of the outer surface having a protruding dome shape in the absence of at least a compressive load of at least a predetermined magnitude on the cushioning component; wherein the protruding dome shape includes a base portion and a crown portion protruding outward from the base portion; wherein the outer surface of the protruding dome shape has either an aperture or a recess in the crown portion; and wherein the crown portion of the protruding dome shape at least partially inverts relative to the base portion under the compressive load, and reverts back to protrude outward from the base portion upon removal of the compressive load.

Clause 39. The sole structure of clause 38, wherein: the cushioning component is one of a plurality of cushioning components included in the sole layer, each cushioning component having an outer surface at least a portion of which has a protruding dome shape in the absence of a compressive load of at least a respective predetermined magnitude on the cushioning component and each at least partially defining the chamber or a separate chamber; and wherein application of the compressive load of at least the respective predetermined magnitude on the cushioning component at least partially inverts the protruding dome shape of the cushioning component.

Clause 40. The sole structure of clause 39, wherein at least some of the plurality of cushioning components are different sizes.

Clause 41. The sole structure of clause 39, wherein each protruding dome shape has a protruding dome width; and at least some of the protruding dome widths are different from one another.

Clause 42. The sole structure of clause 39, wherein: the sole layer has a forefoot region, a midfoot region, and a heel region; and the cushioning components vary size in at least one of the forefoot region, the midfoot region, or the heel region and/or vary between one of the forefoot region, the midfoot region, or the heel region and at least one different one of the forefoot region, the midfoot region, or the heel region.

Clause 43. The sole structure of clause 39, wherein the plurality of cushioning components include cushioning components having relatively large sizes that are disposed to align with a heel, metatarsal joints, and/or a big toe of a wearer of an article of footwear when the sole layer is incorporated into an article of footwear.

Clause 44. The sole structure of any of clauses 39-43, wherein the separate chamber of at least one of the cushioning components is in fluid communication with the chamber.

Clause 45. The sole structure of any of clauses 39-43, wherein the separate chamber of at least one of the cushioning components is fluidly-isolated from the chamber.

Clause 46. The sole structure of clause 38, wherein the protruding dome shape is a first protruding shape, and the outer surface of the cushioning component has a second protruding dome shape extending outward in a direction opposite from the first protruding dome shape.

Clause 47. The sole structure of clause 46, wherein the cushioning component includes a first sheet defining the first protruding dome shape and a second sheet fixed to the first sheet and defining the second protruding dome shape such that the chamber is bounded by the first protruding dome shape and the second protruding dome shape.

Clause 48. A method of manufacturing a sole structure, the method comprising: providing a sole layer including a cushioning component having an outer surface and at least partially defining a chamber at least partially surrounded by the outer surface, at least a portion of the outer surface having a protruding shape in the absence of at least a compressive load of at least a predetermined magnitude on the cushioning component; and positioning a sole component so that a projection of the sole component either extends through an aperture in the outer surface of the cushioning component and within the chamber or interfaces with a recess in the outer surface of the cushioning component.

Clause 49. The method of clause 48, further comprising: securing the projection to the cushioning component.

Clause 50. The method of clause 49, wherein securing the projection to the cushioning component includes heating the projection.

Clause 51. The method of clause 50, wherein heating the projection expands foam material of the projection to bond the projection to the cushioning component within the chamber and seal the aperture.

Clause 52. The method of any of clauses 48-51, further comprising: pressurizing the chamber with gas or air.

Clause 53. The method of any of clauses 48-52, further comprising: prior to providing the sole layer, forming the sole structure by bonding a first polymeric sheet to a second polymeric sheet to define the chamber and the protruding shape.

Clause 54. A sole structure for an article of footwear comprising: a cushioning component having an outer surface and at least partially defining a chamber at least partially surrounded by the outer surface, at least a portion of the outer surface having a protruding shape in the absence of a compressive load of at least a predetermined magnitude on the cushioning component; a sole component disposed external to the cushioning component; and an external bladder disposed external to the chamber and between the sole component and the protruding shape and against the protruding shape; and wherein the protruding shape of the cushioning component compresses against the external bladder under the compressive load.

Clause 55. The sole structure of clause 54, further comprising: a tensile component disposed within an interior cavity of the external bladder and secured to opposing inner surfaces of the external bladder.

Clause 56. The sole component of clause 54, wherein: the external bladder defines an aperture; and wherein the protruding shape compresses against the external bladder around the aperture under the compressive load.

Clause 57. The sole component of clause 56, wherein: the cushioning component is one of a plurality of cushioning components included in the sole structure, each having an outer surface at least a portion of which has a protruding shape in the absence of a compressive load of at least a respective predetermined magnitude on the cushioning component; the aperture in the external bladder is a first through hole, and the external bladder defines a plurality of additional through holes; and wherein the protruding shape of each of the plurality of cushioning components compresses against the external bladder around a respective one of the additional through holes under the compressive load.

Clause 58. A sole structure for an article of footwear comprising: a cushioning component including a body, the body having an outer surface and at least partially defining a chamber at least partially surrounded by the outer surface, at least a portion of the outer surface having a protruding shape in the absence of a compressive load of at least a predetermined magnitude on the cushioning component; and a sole component that interfaces with the outer surface of the cushioning component; the body has an annular sidewall section that has an equilibrium state at a first position and at a first angle relative to a longitudinal axis of the body in an expanded configuration of the cushioning component; the annular sidewall section is configured to elastically deform by snap-through buckling to a collapsed configuration when under the compressive load; and the body has a first length along the longitudinal axis of the body in the expanded configuration and a second length along the longitudinal axis of the body in the collapsed configuration, the second length less than the first length.

Clause 59. The sole structure of clause 58, wherein the body provides a haptic indicator of the snap-through buckling.

Clause 60. The sole structure of any of clauses 58-59, wherein: the annular sidewall section is a first annular sidewall section, and the body further includes a second annular sidewall section spaced apart from the first annular sidewall section along the longitudinal axis of the body; wherein the second annular sidewall section has an equilibrium state disposed at a second angle relative to the longitudinal axis of the body in the expanded configuration of the cushioning component, wherein a magnitude of the first angle is different than a magnitude of the second angle such that the second annular sidewall section is configured to elastically deform by snap-through buckling to a collapsed configuration when under a compressive load of a different magnitude than the compressive load at which the first annular sidewall section elastically deforms.

Clause 61. The sole structure of any of clauses 58-60 further comprising: a resilient member disposed within the chamber.

Clause 62. The sole structure of clause 1, wherein the sole component and the projection are an integral, monolithic part of the cushioning component as a single, unitary structure with the sole component including both a ground-facing portion protruding outward from the outer surface of the cushioning component and the projection protruding inward from the inner surface of the cushioning component into the chamber.

Clause 63. The sole structure of clause 62, further comprising: a sole layer overlying the cushioning component; and wherein the cushioning component compresses around the projection upon application of the compressive load of at least the predetermined magnitude on the cushioning component, at least partially inverting the protruding shape.

Clause 64. The sole structure of clause 62, wherein, upon sufficient inversion of the protruding shape the projection contacts and resiliently deforms the sole layer.

Clause 65. The sole structure of clause 64, wherein the sole layer includes a bladder defining an interior cavity configured to retain a fluid at or above ambient pressure.

Clause 66. The sole structure of clause 65, further comprising: a tensile component disposed within the interior cavity and secured to opposing inner surfaces of the bladder.

Clause 67. The sole structure of clause 66, wherein: the protrusion has a center axis and moves along the center axis toward and away from the bladder during resilient deformation of the protruding shape; and the protrusion has a noncylindrical shape around the center axis.

Clause 68. The sole structure of clause 66, wherein: the protrusion has a center axis and moves along the center axis toward and away from the bladder during resilient deformation of the protruding shape; and the protrusion includes multiple arms extending outward from the center axis, the multiple arms pressing against the bladder during resilient deformation of the protruding shape.

Clause 69. The sole structure of clause 68, wherein the multiple arms include four arms spaced around the center axis.

Clause 70. A sole structure manufactured according to the method of any of clauses 48-53.

Clause 71. An article of footwear including the sole structure of any of clauses 1-47, and 54-69.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" particularly refers to a direction extending a length of a component. For example, a longitudinal direction of a shoe extends between a forefoot region and a heel region of the shoe. The term "forward" or "anterior" is used to particularly refer to the general direction from a heel region toward a forefoot region, and the term "rearward" or "posterior" is used to particularly refer to the opposite direction, i.e., the direction from the forefoot region toward the heel region. In some cases, a component may be identified with a longitudinal axis as well as a forward and rearward longitudinal direction along that axis.

The longitudinal direction or axis may also be referred to as an anterior-posterior direction or axis.

The term "transverse" particularly refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" particularly refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" particularly refers to the vertical direction pointing towards a top of the component, which may include an instep, a fastening region and/or a throat of an upper. The term "downward" or "downwards" particularly refers to the vertical direction pointing opposite the upwards direction, toward the bottom of a component and may generally point towards the bottom of a sole structure of an article of footwear.

The "interior" of an article of footwear, such as a shoe, particularly refers to portions at the space that is occupied by a wearer's foot when the shoe is worn. The "inner side" of a component particularly refers to the side or surface of the component that is (or will be) oriented toward the interior of the component or article of footwear in an assembled article of footwear. The "outer side" or "exterior" of a component particularly refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" particularly refer to the direction toward the interior of the component or article of footwear, such as a shoe, and the terms "outward" and "outwardly" particularly refer to the direction toward the exterior of the component or article of footwear, such as the shoe. In addition, the term "proximal" particularly refers to a direction that is nearer a center of a footwear component, or is closer toward a foot when the foot is inserted in the article of footwear as it is worn by a user. Likewise, the term "distal" particularly refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A sole structure for an article of footwear comprising:

a cushioning component having an outer surface and at least partially defining a chamber at least partially surrounded by the outer surface, at least a portion of the outer surface having a protruding shape in the absence of a compressive load of at least a predetermined magnitude on the cushioning component;

a sole component including a projection that either:

extends through an aperture in the outer surface of the cushioning component and within the chamber; or interfaces with a recess in the outer surface of the cushioning component; or protrudes from an inner surface of the cushioning component into the chamber; and a bladder disposed within the chamber;

wherein the aperture in the outer surface of the cushioning component is a first aperture;

wherein the bladder defines a second aperture extending at least partially through the bladder; and wherein the projection extends through the first aperture and into the second aperture.

2. The sole structure of claim 1, wherein:

the sole component includes a base;

the projection extends from the base; and the outer surface of the cushioning component compresses against the base.

3. The sole structure of claim 2, wherein at least a portion of the projection gradually tapers in width from the base toward the protruding shape.

4. The sole structure of claim 1, wherein the projection partially inverts the protruding shape of the outer surface of the cushioning component under the compressive load, the outer surface of the cushioning component compressing on and/or around the projection.

5. The sole structure of claim 1, wherein a portion of the projection extending within the chamber is wider than the aperture.

6. The sole structure of claim 1, further comprising:

a bladder disposed external to the chamber and adjacent to the protruding shape.

7. The sole structure of claim 1, wherein protruding shape includes a protruding dome shape.

8. The sole structure of claim 4, wherein:

the protruding shape of the outer surface of the cushioning component is a protruding dome shape and includes a base portion subjected to hoop tensile forces under compressive loading and a crown portion extending outward from the base portion and subjected to hoop compressive forces under compressive loading; and the crown portion inverts relative to the base portion under the compressive load and resiliently returns to extending outward from the base portion upon removal of the compressive load.

9. The sole structure of claim 1, further comprising:

a sole layer positioned with the cushioning component between the sole layer and the sole component; and wherein the bladder is secured to at least one of the sole layer or the cushioning component.

10. The sole structure of claim 1, wherein the bladder is a first bladder, and further comprising:

a second bladder disposed external to the chamber and adjacent to the protruding shape; wherein the second bladder includes a tensile component secured to opposing inner surfaces of the second bladder.

11. The sole structure of claim 10, wherein the second bladder defines a third aperture, and the protruding shape compresses against the second bladder around the third aperture under the compressive load.

12. The sole structure of claim 6, wherein the bladder is secured to the protruding shape.

13. The sole structure of claim 1, wherein the bladder includes a tensile component secured to opposing inner surfaces of the bladder.

14. A sole structure for an article of footwear comprising:

a cushioning component having an outer surface and at least partially defining a chamber at least partially surrounded by the outer surface, at least a portion of the outer surface having a protruding shape in the absence of a compressive load of at least a predetermined magnitude on the cushioning component;

a sole component including a projection that either:

extends through an aperture in the outer surface of the cushioning component and within the chamber; or interfaces with a recess in the outer surface of the cushioning component; or protrudes from an inner surface of the cushioning component into the chamber; and a bladder disposed external to the chamber, between the sole component and the protruding shape, and adjacent to the protruding shape.

15. The sole structure of claim 14, wherein the bladder includes a tensile component secured to opposing inner surfaces of the bladder.

16. The sole structure of claim 14, wherein the bladder is secured to at least one of the cushioning component or the sole component.

17. The sole structure of claim 14, wherein:

the sole component includes a base;

the projection extends from the base; and the outer surface of the cushioning component compresses against the base.

18. The sole structure of claim 17, wherein at least a portion of the projection gradually tapers in width from the base toward the protruding shape.

19. The sole structure of claim 17, wherein the projection partially inverts the protruding shape of the outer surface of the cushioning component under the compressive load, the outer surface of the cushioning component compressing on and/or around the projection.

20. The sole structure of claim 14, wherein protruding shape includes a protruding dome shape.

* * * * *